US005977055A

United States Patent [19]

Trinh et al.

[11] Patent Number: 5,977,055

[45] Date of Patent: Nov. 2, 1999

[54] HIGH USAGE OF FABRIC SOFTENER COMPOSITIONS FOR IMPROVED BENEFITS

[75] Inventors: Toan Trinh, Maineville, Ohio; Ronald Joseph Miller, Jr., Lansing, Mich.; Maureen Higgins DesMarais; Errol Hoffman Wahl, both of Cincinnati, Ohio; Alessandro Corona, III, Maineville, Ohio; Richard Thomas Owen, Issaquah, Wash.; Kathleen Joan Conrad, Fairfield; Chad James Oler, Cincinnati, both of Ohio; Hugo Jean Marie Demeyere, Merchtem, Belgium; Dean Larry DuVal, Kobe; Mitsuyo Okamoto, Ashiya, both of Japan

[73] Assignee: The Procter & Gamble Company, Cincinnati, Ohio

[21] Appl. No.: 09/013,794

[22] Filed: Jan. 26, 1998

Related U.S. Application Data

[63] Continuation-in-part of application No. PCT/US97/18933, Oct. 21, 1997.

[60] Provisional application No. 60/028,906, Oct. 21, 1996.

[51] Int. Cl.[6] ..... C11D 1/62

[52] U.S. Cl. ..... 510/515; 510/521

[58] Field of Search ..... 510/504, 521–522, 510/515

[56] References Cited

U.S. PATENT DOCUMENTS

| | | | |
|---|---|---|---|
| 5,500,138 | 3/1996 | Bacon et al. | 252/8.8 |
| 5,652,206 | 7/1997 | Bacon et al. | 510/101 |
| 5,770,557 | 6/1998 | Bruhnke | 510/515 |
| 5,804,219 | 9/1998 | Trinh et al. | 424/719 |

*Primary Examiner*—Yogendra Gupta
*Assistant Examiner*—John R. Hardee
*Attorney, Agent, or Firm*—Robert B. Aylor

[57] ABSTRACT

Softener actives provide color maintenance benefits for fabrics. In order to inform the consumer, the compositions containing fabric softener actives are placed in packages in association with information that advises the consumer of the benefit. Highly unsaturated fabric softener active compounds, preferably containing ester linkages, are used at levels of at least about 3 grams of fabric softener active per kilogram of fabric deposited on said fabric to provide improved softening, anti-static benefits, wear benefits, color maintenance, etc., without unacceptable oily/greasy feel and/or unacceptable rewettability.

17 Claims, No Drawings

HIGH USAGE OF FABRIC SOFTENER COMPOSITIONS FOR IMPROVED BENEFITS

This application is a continuation-in-part of the application Toan (nmn) Trinh, Ronald Joseph Miller, Jr., Maureen Higgins DesMarais, Errol Hoffman Wahl, Alessandro (nmn) Corona, III, Richard Thomas Owen, Kathleen Joan Conrad, and Chad James Oler, PCT/U.S. Ser. No. 97/18933, filed Oct. 21, 1997, which was a continuation-in-part of the Provisional Application, Ser. No. 60/028,906, filed Oct. 21, 1996.

TECHNICAL FIELD

The present invention relates to the usage of high levels of softener compounds, preferably certain highly unsaturated softener compounds, to provide fabric care benefits. The compounds are preferably formulated into translucent, or, more preferably, clear, aqueous, concentrated, liquid softening compositions useful for softening cloth. It especially relates to processes utilizing textile softening compositions containing highly unsaturated and/or branched, preferably biodegradable, fabric softener compounds for use in the rinse cycle of a textile laundering operation to provide at least one benefit selected from excellent fabric-softening, static-control, fabric appearance maintenance, anti-wrinkling benefits and improved fiber integrity benefits, without adversely affecting fabric water absorbency and/or greasy/oily fabric feel and/or fabric staining. The preferred highly unsaturated compounds, especially in clear compositions are also characterized by, e.g., reduced staining of fabric, excellent water dispersibility, rewettability, and/or storage and viscosity stability at sub-normal temperatures, i.e., temperatures below normal room temperature, e.g., 25° C. The compositions are packaged in association with instructions for use at higher levels to provide the various benefits.

BACKGROUND OF THE INVENTION

The use of fabric softening compounds to treat fabrics for the purposes of static control and providing softness benefits is known. However, it has not been recognized that fabric softeners can provide some color maintenance for colored fabrics.

Concentrated clear compositions containing ester and/or amide linked fabric softening actives are disclosed in co-pending application Ser. No. 08/679,694, filed Jul. 11, 1996 in the names of E. H. Wahl, T. Trinh, E. P. Gosselink, J. C. Letton, and M. R. Sivik, for Fabric Softening Compound/Composition, said application being incorporated herein by reference. The preferred fabric softener actives in said applications are all biodegradable ester-linked materials, containing, as long hydrophobic groups, unsaturated and/or branched chains.

SUMMARY OF THE INVENTION

It has been discovered that softener actives used at high levels, e.g., about 50% more than normal, provide some unexpected results in terms of fabric care benefits. More specifically, the use of more than about 150%, preferably from about 200% to about 600%, more preferably from about 250% to about 500%, and even more preferably from about 300% to about 400%, of normal usage provides at least one benefit selected from improved color protection; reduced wrinkling; improved fiber integrity; improved softness; and reduced static; preferably without adversely affecting water absorbency and/or fabric feel and/or fabric staining. These high levels of fabric softener active have been shown to provide noticeable color maintenance, protection, and/or recovery for colored fabrics, especially cotton fabrics, improved anti-wrinkling benefit, improved fiber integrity, and improved antistatic benefits, in addition to a high level of softness, especially when added to the rinse water. It is highly desirable to use a rinse added fabric softener composition, especially liquid compositions.

In a preferred aspect, the invention comprises the process of applying to (treating) fabrics, especially those comprising colored fabrics, especially cotton and cotton blend fabrics, e.g., cotton/polyester blends, a highly unsaturated fabric softener active having two long hydrocarbon chains, preferably containing at least two $C_6$–$C_{22}$ hydrocarbyl groups, but no more than one being less than $C_{12}$ and then the other is at least $C_{16}$, with an Iodine Value (IV) of from about 70 to about 140, more preferably from about 80 to about 130; and most preferably from about 90 to about 115, and/or branched chains.

The softener actives herein preferably, have long hydrocarbon chains that, if present in a fatty acid, said fatty acid would have a titer of less than about 30° C., preferably less than about 25° C., more preferably less than about 20° C., and even more preferably less than about 18° C. Said softener active is preferably selected from the actives disclosed hereinafter.

The typical recommended usage of current fabric softeners is about 2.4 g (softener active)/kg (fabric) or lower, with the recommended usage for extra softness being about 3.15 g/kg. Both usage levels of these current fabric softeners will provide some color maintenance. However, continuous usage at the higher levels with current fabric softeners will cause the fabrics to feel too greasy/oily to some consumers and will diminish the ability of the fabrics to absorb water quickly. The preferred use of highly unsaturated, and/or highly branched fabric softener actives allows the use of higher levels of fabric softener actives on a regular basis to provide color maintenance/appearance benefits, improved anti-wrinkling, fabric wear protection, improved softening, anti-static benefits, etc., without causing any adverse feel/rewettability issues. The level of fabric softener active (as defined by the ratio of grams of softener active to kilograms of fabric) needed to provide some fabric softenening is at least about 1, but improved performance of benefits disclosed herein requires a level of fabric softener active of at least about 3, typically at least from about 3.3 to about 14, preferably from about 4 to about 14, more preferably from about 5 to about 12, and even more preferably from about 6 to about 10 g/kg fabric.

The nature of the fabric care benefits is such that it is highly desirable to use the higher levels of softener to obtain the benefits. However, the unobviousness of these benefits, and the cost associated with respect to the higher levels requires that the products that can be used to provide the benefits be packaged in containers in association with instructions to use the higher levels of softener needed to provide the benefits and with the information as to what level provides what benefits. For some benefits the level is important. Therefore, the invention also comprises packages containing fabric softener active, said packages being in association with information that will inform the consumer, by words and/or by pictures, that use of the compositions will provide fabric care benefits which include color maintenance benefits, and, where the fabric softener actives are highly unsaturated and/or branched, this information can comprise the claim of superiority without appreciable loss of water absorbency and/or undesirable fabric "feel". In a highly desirable variation, the package bears the information that informs the consumer that the use of the fabric softener active provides color maintenance and/or color restoration for fabrics.

DETAILED DESCRIPTION OF THE INVENTION

I. THE PROCESS

As discussed before, softener actives, especially those described herein containing at least two $C_6$–$C_{22}$ hydrocarbyl groups, but no more than one being less than $C_{12}$ and then the other is at least $C_{16}$, the groups having an IV from about 70 to about 140, and/or being branched, preferably unsaturated, can provide surprisingly good benefits when used at a level of at least 50% more than the typical usage, i.e., about 1.5–2.5 gram of softener active per kilogram of fabrics. More specifically, the use of more than about 150%, preferably from about 200% to about 600%, more preferably from about 250% to about 500%, and even more preferably from about 300% to about 400%, of normal usage provides at least one benefit selected from improved color protection and/or maintenance, e.g., recovery and/or restoration; reduced wrinkling; improved fiber integrity; improved softness; and reduced static. When the preferred softener actives described herein are used, the benefits can be obtained without adversely affecting water absorbency and/or fabric feel and/or fabric staining.

The more traditional highly saturated softener actives, or intermediate saturated actives, can provide some of the same benefits. E.g., the use of at least 50% more than the normal usage of any softener provides some improved color protection of fabrics. Normally however, such higher usage of these conventional softeners causes an unacceptable loss in water absorbency and/or causes the fabric to feel greasy/oily. Even higher usages cause even more problems.

The level of color protection goes up as almost a straight line with increased usage. It is important therefore to use as much as possible for the maximum color protection. Softness, anti-static effects, and wrinkle reduction also improve with more softener usage in the same way that the color protection improves. Even at three times the normal usage, there is still improvement from more softener. The benefits are greatest for cotton.

The most unobvious benefit occurs when the usage is more than twice normal usage, e.g., more than two and a half times normal usage, preferably at least three times normal usage and even more at four times normal usage. At these levels, the fabric is actually protected from damage, even in the following wash cycle. This benefit can be seen in the lack of lint in the lint filter after the fabric is dried in an automatic laundry dryer. The popularity of durable press (DP) cotton garments continues to grow. DP finishes are popular in heavy garments such as men's slacks—currently representing 45% of men's cotton slacks and 25% of all men's slacks. DP finish contains DMDHEU crosslinked with celluloses within cotton fibers to provide easy care (less wrinkles). The crosslinking of the cellulose chains produces fiber stiffness, leading to a greater propensity to abrasion vs. non-DP garments. The result: DP garments look worn/abraded in a few laundering cycles (≦5) vs. non DP garments. Use of products of this invention can reduce garment abrasion, especially DP treated fabrics, with the result of fabrics looking newer and lasting longer.

Additionally, it is highly desirable for color protection to optionally have at least an effective amount of one additional color protecting ingredient selected from the group consisting of: chlorine scavenger, which provides protection from tap water in the laundry process; dye transfer inhibitors which can provide additional protection from fabrics that "bleed" fugitive dyes in the laundry process; dye fixatives which provide some stability to dyes on fabrics being laundered; chelant for metals like copper that cause hue shifts in dyes; soil release polymers which reduces the deposition and/or redeposition of visible soil to improve the overall fabric appearance; and mixtures thereof. Mixtures of color protectants are desirable, since more than one damage mechanism usually exists. It is also useful, in some instances, to add sun-fade protection, as disclosed in U.S. Pat. No. 5,474,691, Severns, issued Dec. 12, 1995, for DRYER-ADDED FABRIC TREATMENT ARTICLE OF MANUFACTURE CONTAINING ANTIOXIDANT AND SUNSCREEN COMPOUNDS FOR SUN FADE PROTECTION OF FABRICS.

II. PACKAGE WITH INSTRUCTIONS FOR USAGE

The nature of these benefits is such that it is highly desirable to use the higher levels of softener to obtain the benefits. However, as discussed hereinbefore, the unobviousness of these benefits, and the cost associated with respect to the higher levels requires that the products that can be used to provide the benefits be packaged in containers in association with instructions to use the higher levels of softener needed to provide the benefits, which include at least one benefit selected from improved color protection; reduced wrinkling; improved fiber integrity; improved softness; and reduced static; without adversely affecting water absorbency and/or fabric feel and/or fabric staining, and with the information as to what level provides what benefits. For some benefits the level is important. For example, usage at less than two times normal usage can actually cause more fiber loss. It is essential for fiber protection to use at least about two and a half times normal usage.

It is also important to assure the consumer that the usage at such high levels is safe, e.g., not causing adverse effects such as loss of fabric water absorbency, oily/greasy fabric feel, and/or fabric staining which the consumer commonly experiences with conventional, commercially available fabric softener compositions. Without the assurance, the consumer may not obtain the full benefits available. Thus, it is important that the packages containing fabric softener active, are in association with information that will inform the consumer, by words and/or by pictures, that use of the compositions will provide fabric care benefits which include color and/or appearance maintenance benefits, and, this information can comprise the claim of superiority without appreciable loss of water absorbency and/or undesirable "feel" and/or fabric staining. In a highly desirable variation, the package bears the information that informs the consumer that the use of at least about one and a half times the normal usage of the fabric softener active provides color maintenance and/or color restoration for fabrics and/or highly improved softening and/or improved anti-static effects, even as good as obtained normally by dryer added softener products and/or improved anti-wrinkle benefits and/or that the use of a level of fabric softener at a level of at least about two and a half times normal usage will provide fabric wear benefits.

III. FABRIC SOFTENING ACTIVE

The process herein uses compositions that contain as an essential component from about 2% to about 80%, preferably from about 13% to about 75%, more preferably from about 17% to about 70%, and even more preferably from about 19% to about 65% by weight of the composition, of a fabric softener active, either the normal ones, or, preferably, the preferred ones selected from the compounds identified hereinafter, and mixtures thereof for liquid rinse-added fabric softener compositions. For dryer-added compositions, the levels are from 1% to 99% by weight of the compositions, preferably from about 1% to about 80%, more preferably from about 20% to about 70%, and even more preferably from about 25% to about 60% of fabric softening component. For spray-on compositions the levels are from about 0.05% to about 10%, preferably from about 0.1% to about 7%, more preferably from about 0.5% to about 5%.

Fabric softener actives that can be used herein are disclosed, at least generically for the basic structures, in U.S. Pat. No. 3,408,361, Mannheimer, issued Oct. 29, 1968; U.S. Pat. No. 4,709,045; Kubo et al., issued Nov. 24, 1987; U.S. Pat. No. 4,233,451, Pracht et al., issued Nov. 11, 1980; U.S. Pat. No. 4,127,489, Pracht et al., issued Nov. 28, 1979; U.S. Pat. No. 3,689,424, Berg et al., issued Sep. 5, 1972; U.S. Pat. No. 4,128,485, Baumann et al., issued Dec. 5, 1978; U.S. Pat. No. 4,161,604, Elster et al., issued Jul. 17, 1979; U.S. Pat. No. 4,189,593, Wechsler et al., issued Feb. 19, 1980; U.S. Pat. No. 4,339,391, Hoffman et al., issued Jul. 13, 1982 U.S. Pat. No. 3,861,870, Edwards and Diehl; 4,308,151, Cambre; U.S. Pat. No. 3,886,075, Bernardino; U.S. Pat. No. 4,233,164, Davis; U.S. Pat. No. 4,401,578, Verbruggen; U.S. Pat. No. 3,974,076, Wiersema and Rieke; U.S. Pat. No. 4,237,016, Rudkin, Clint, and Young; U.S. Pat. No. 4,885,102, Yamamura et al.., issued Dec. 5, 1989; U.S. Pat. No. 4,937,008, Yamamura et al., issued Jun. 26, 1990; and U.S. Pat. No. 5,133,885, Contor et al., issued Jul. 28, 1992; Case 4768C, Trinh et al.; and European patent applications 91/336,267, Rutzen et a.l. and 91/423,894, Contor et al. and International Patent WO 91/01295, Trius et al., published Feb. 7, 1991, all of said patents and applications being incorporated herein by reference. For dryer-added compositions, the actives disclosed in copending application Ser. No. 08/937,536, filed Sep. 25, 1997, for DRYER-ADDED FABRIC SOFTENER COMPOSITION USAGE TO PROVIDE COLOR AND OTHER FABRIC APPEARANCE BENEFITS by J. W. Smith, A. Corona, T. Trinh, and R. Wu (Procter & Gamble Case No. 6855) are especially suitable, said application being incorporated herein by reference.

Other preferred fabric softening agents for liquid rinse-added compositions are disclosed in U.S. Pat. No. 4,661,269, issued Apr. 28, 1987, in the names of Toan Trinh, Errol H. Wahl, Donald M. Swartley and Ronald L. Hemingway, said patent being incorporated herein by reference.

Examples of suitable amine softeners that can be used in the present invention are disclosed in copending application Ser. No. 60,054,141, filed Jul. 29, 1997, for CONCENTRATED, STABLE, PREFERABLY CLEAR, FABRIC SOFTENING COMPOSITION CONTAINING AMINE FABRIC SOFTENER by K. A. Grimm, D. R. Bacon, T. Trinh, E. H. Wahl, and H. B. Tordil (Procter & Gamble Case No. 6776P), said application being incorporated herein by reference.

The preferred process of treating fabrics herein uses highly unsaturated and/or branched fabric softener active, preferably biodegradable, selected from the highly unsaturated and/or branched fabric softening actives identified hereinafter, and mixtures thereof. These highly unsaturated and/or branched fabric softening actives have the required properties for permitting high usage levels. Specifically, when deposited at high levels on fabrics, the highly unsaturated and/or branched fabric softening actives do not create a "greasy/oily" feel like the more conventional more fully saturated compounds. Moreover, the highly unsaturated and/or branched fabric softening actives provide fabrics which have excellent water absorbency after being dried. Other fabric softener actives that provide fabric softening and good water absorbency can also be used in the fabric softener compositions and processes of the present invention. Water absorbency, as measured by the Horizontal Gravimetric Wicking (HGW) test, as described herein after, of cotton terries treated at high usage levels with softener compositions of this invention should be at least about 75%, preferably at least about 85%, more preferably 100%, and even more preferably more than 100%, as absorbent as cotton terries not treated with a fabric softener composition. This relative water absorbency is referred to hereinafter as the HGW relative water absorbency. Furthermore, the preferred clear fabric conditioner compositions disclosed herein allow high level usage with minimal fabric staining which is commonly observed for conventional fabric softener compositions when used at high levels. The benefits provided by high usage include superior softness, static control, and, especially, maintenance of fabric appearance including recovery of fabric color appearance, improved color integrity, and anti-wrinkling benefits. As has been recently demonstrated, color maintenance is an important attribute in the consumer's mind. Colored garments that are otherwise wearable, are often discarded, or not worn, because they look unacceptable. This invention provides improved appearance to garments, especially cotton, which is currently the preferred fabric. The greatest improvement is observed when the fabrics are dried in a conventional automatic tumble dryer.

Preferred fabric softeners of the invention comprise a majority of compounds as follows:

The unsaturated compounds preferably have at least about 3%, e.g., from about 3% to about 30%, of softener active containing polyunsaturated groups. Normally, one would not want polyunsaturated groups in actives, since they tend to be much more unstable than even monounsaturated groups. The presence of these highly unsaturated materials makes it highly desirable, and for the preferred higher levels of polyunsaturation, essential, that the highly unsaturated and/or branched fabric softening actives and/or compositions herein contain antibacterial agents, antioxidants, and/or reducing materials, to protect the actives from degradation. The long chain hydrocabon groups can also comprise branched chains, e.g., from isostearic acid, for at least part of the groups. The total of active represented by the branched chain groups, when they are present, is typically from about 1% to about 100%, preferably from about 10% to about 70%, more preferably from about 20% to about 50%.

Preferred Diester Quaternary Ammonium Fabric Softening Active Compound (DEQA)

(1) The first type of DEQA preferably comprises, as the principal active, compounds of the formula $$\{R_{4-m}—N^+—[(CH_2)_n—Y—R^1]_m\}\ A^-$$

wherein each R substituent is either hydrogen, a short chain $C_1$–$C_6$, preferably $C_1$–$C_3$ alkyl or hydroxyalkyl group, e.g., methyl (most preferred), ethyl, propyl, hydroxyethyl, and the like, poly ($C_{2-3}$alkoxy) preferably polyethoxy group, benzyl, or mixtures thereof; each m is 2 or 3; each n is from 1 to about 4; each Y is —O— (O)C—, —C(O)—O—, —NR—C(O)—, or —C(O)—NR—; the sum of carbons in each $R^1$, plus one when Y is —O—(O)C— or —NR—C(O)—, is $C_{12}$–$C_{22}$, preferably $C_{14}$–$C_{20}$, with each $R^1$ being a hydrocarbyl, or substituted hydrocarbyl group. (As used herein, the "percent of softener active" containing a given $R^1$ group is based upon taking a percentage of the total active based upon the percentage that the given $R^1$ group is, of the total $R^1$ groups present.)

These biodegradable quaternary ammonium fabric softening compounds preferably contain the group $C(O)R^1$ which is derived, primarily from unsaturated fatty acids, e.g., oleic acid, the preferred polyunsaturated fatty acids, and/or saturated fatty acids, and/or partially hydrogenated fatty acids from natural sources, e.g., derived from animal fats or vegetable oils and/or partially hydrogenated vegetable oils, such as, canola oil, safflower oil, peanut oil, sunflower oil, corn oil, soybean oil, tall oil, rice bran oil, etc. In other preferred embodiments, the fatty acids have the following approximate distributions:

| Fatty Acyl Group | $FA^1$ | $FA^2$ | $FA^3$ | $FA^4$ | $FA^5$ |
|---|---|---|---|---|---|
| C12 | trace | trace | 0 | 0 | 0 |
| C14 | 3 | 3 | 0 | 0 | 0 |
| C16 | 4 | 4 | 5 | 5 | 5 |
| C18 | 0 | 0 | 5 | 6 | 6 |
| C14:1 | 3 | 3 | 0 | 0 | 0 |
| C16:1 | 11 | 7 | 0 | 0 | 3 |
| C18:1 | 74 | 73 | 71 | 68 | 67 |
| C18:2 | 4 | 8 | 8 | 11 | 11 |
| C18:3 | 0 | 1 | 1 | 2 | 2 |
| C20:1 | 0 | 0 | 2 | 2 | 2 |
| C20 and up | 0 | 0 | 2 | 0 | 0 |
| Unknowns | 0 | 0 | 6 | 6 | 7 |
| Total | 99 | 99 | 100 | 100 | 102 |
| IV | 86–90 | 88–95 | 99 | 100 | 95 |
| cis/trans (C18:1) | 20–30 | 20–30 | 4 | 5 | 5 |
| TPU | 4 | 9 | 9 | 13 | 13 |

Nonlimiting examples of FA's are as follows:

| Fatty Acyl Group | $FA^{10}$ |
|---|---|
| C14 | 0 |
| C16 | 4.7 |
| C18 | 4.2 |
| C14:1 | 0 |
| C16:1 | 0.3 |
| C18:1 | 78.3 |
| C18:2 | 10.3 |
| C18:3 | 0.2 |
| C20 + 22 | 0.7 |
| C20:1 + 22:1 | 1.1 |
| Unknowns | 0.2 |
| Total | 100 |
| IV | 95 |
| cis/trans (C18:1) | 3.67 |
| TPU | 10.5 |

| Fatty Acyl Group | $FA^{11}$ |
|---|---|
| C14 | 1 |
| C16 | 25 |
| C18 | 20 |
| C14:1 | 0 |
| C16:1 | 0 |
| C18:1 | 45 |
| C18:2 | 6 |
| C18:3 | 0 |
| Unknowns | 3 |
| Total | 100 |
| IV | 56 |
| cis/trans (C18:1) | 7 |
| TPU | 6 |

$FA^{10}$ is prepared from a slightly hydrogenated canola fatty acid, and $FA^{11}$ is prepared from a slightly hydrogenated tallow fatty acid. $FA^{11}$ is useful as part of a blend of fatty acids, since it is relatively inexpensive.

The Iodine Value (hereinafter referred to as "IV" as used herein, is based upon the Iodine Value of a "parent" fatty acid, or "corresponding" fatty acid, i.e., it is used to define a level of unsaturation for an $R^1$ group that is the same as the level of unsaturation that would be present in a fatty acid containing the same $R^1$ group) of the parent fatty acids of these $R^1$ group is preferably from about 70 to about 140, more preferably from about 80 to about 130; and even more preferably from about 90 to about 115, on the average.

It is preferred that at least a majority of the fatty acyl groups are unsaturated, e.g., from about 50% to 100%, preferably from about 55% to about 95%, more preferably from about 60% to about 90%, and that the total level of active containing polyunsaturated fatty acyl groups (TPU) be from about 3% to about 30%. The cis/trans ratio for the unsaturated fatty acyl groups is important, with a preferred cis/trans ratio of from 1:1 to about 50:1, the minimum being 1:1, preferably at least 3:1, and more preferably from about 4:1 to about 20:1.

The unsaturated, including the preferred polyunsaturated, fatty acyl groups not only provide surprisingly effective softening, but also provide better absorbency characteristics, good antistatic characteristics, and superior recovery after freezing and thawing. These highly unsaturated/branched materials provide excellent softening while minimizing loss of water absorbency and "greasy" fabric feel. These two characteristics allow one to use higher levels of softener than would be ordinarily desirable, which provides several additional benefits, including noticeable color maintenance, protection, and/or recovery for colored fabrics, especially colored cotton and cotton blend fabrics, improved anti-wrinkling benefit, improved fiber integrity, i.e., less damage to fabrics, improved antistatic benefits, and a high level of softness.

Although the polyunsaturated acyl groups are highly desirable, it has now been found that diester fabric softener actives (DEQA) containing these polyunsaturated acyl groups can cause off-odors on fabrics. These off-odors are especially noticeable when lower perfume levels are used in the finished product, or when no perfume is used. It is believed that the polyunsaturated acyl groups containing three unsaturated linkages autoxidize on fabric to form volatile short chain saturated and unsaturated aldehydes having malodors. The tri-unsaturated, e.g., C18:3, chains oxidize at a much faster rate than the di-unsaturated, e.g., C18:2, chains and are believed to be responsible for the majority of the off-odors. The malodors are especially bad when the fabrics are dried and/or stored in direct sunlight. It is believed that the light can cause photo-oxidation to occur, which again generates malodors due to the formation of the said aldehydes.

Accordingly, to limit malodor formation, it is preferred to reduce the level of the tri-unsaturated acyl groups in the starting fatty acid feedstock for making the DEQA to less than about 2%, preferably less than about 1%, and more preferably less than about 0.5%.

Polyunsaturated alkyl groups are preferably mostly di- and/or tri-unsaturated groups wherein the alkyl group contains two and/or three double bonds. As disclosed hereinbefore, the level of tri-unsaturated groups is preferably kept low.

The typical recommended usage of current fabric softeners is about 2.4 g (softener active)/kg (fabric) or lower, with the recommended usage for extra softness being about 3.15 g/kg. Both usage levels of these current fabric softeners will provide some color maintenance. However, continuous usage at the higher levels with current fabric softeners will cause the fabrics to feel too greasy/oily to some consumers and will diminish the ability of the fabrics to absorb water quickly. The preferred use of highly unsaturated, and/or highly branched fabric softener actives allows the use of higher levels of fabric softener actives on a regular basis to provide improved color maintenance/appearance benefits, improved anti-wrinkling, fabric wear protection, improved softening, anti-static benefits, etc., without causing any adverse feel/rewettability issues. The level of fabric softener active (as defined by the ratio of grams of softener active to kilograms of fabric) needed to provide some fabric softening is at least about 1, but improved performance of benefits disclosed herein requires a level of fabric softener active of at least about 3, typically at least from about 3.3 to about 14, preferably from about 4 to about 14, more preferably from about 5 to about 12, and even more preferably from about 6 to about 10 g/kg fabric.

The highly unsaturated materials are also easier to formulate into concentrated premixes that maintain their low viscosity and are therefore easier to process, e.g., pump, mixing, etc. These highly unsaturated materials with only a low amount of solvent that normally is associated with such materials, i.e., from about 5% to about 20%, preferably from about 8% to about 25%, more preferably from about 10% to about 20%, weight of the total softener/solvent mixture, are also easier to formulate into concentrated, stable dispersion compositions of the present invention, even at ambient temperatures. This ability to process the actives at low temperatures is especially important for the polyunsaturated groups, since it mimimizes degradation. Additional protection against degradation can be provided when the compounds and softener compositions contain effective antioxidants and/or reducing agents, as disclosed hereinafter.

It will be understood that substituents R and $R^1$ can optionally be substituted with various groups such as alkoxyl or hydroxyl groups, so long as the $R^1$ groups maintain their basically hydrophobic character. The preferred compounds can be considered to be biodegradable diester variations of ditallow dimethyl ammonium chloride (hereinafter referred to as "DTDMAC"), which is a widely used fabric softener. A preferred long chain DEQA is the DEQA prepared from sources containing high levels of polyunsaturation, i.e., N,N-di(acyl-oxyethyl)-N,N-dimethyl ammonium chloride, where the acyl is derived from fatty acids containing sufficient polyunsaturation.

As used herein, when the diester is specified, it can include the monoester that is present. Preferably, at least about 80% of the DEQA is in the diester form, and from 0% to about 20% can be DEQA monoester (e.g., in formula (1), m is 2 and one $YR^1$ group is either "H", —C(O)NR—, or "—C—(O)—OH"). For softening, under no/low detergent carry-over laundry conditions the percentage of monoester should be as low as possible, preferably no more than about 5%. However, under high, anionic detergent surfactant or detergent builder carry-over conditions, some monoester or monoamide can be preferred. The overall ratios of diester to monoester, or diamide to monoamide, are from about 100:1 to about 2:1, preferably from about 50:1 to about 5:1, more preferably from about 13:1 to about 8:1. Under high detergent carry-over conditions, the di/monoester ratio is preferably about 11:1. The level of monoester, or monoamide, present can be controlled in manufacturing the DEQA.

The above compounds, used as the biodegradable quaternized ester-amine or amido-amine, softening material in the practice of this invention, can be prepared using standard reaction chemistry. In one synthesis of a diester variation of DTDMAC, an amine of the formula $RN(CH_2CH_2OH)_2$ is esterified at both hydroxyl groups with an acid chloride of the formula $R^1C(O)Cl$, then quaternized with an alkyl halide, RX, to yield the desired reaction product (wherein R and $R^1$ are as defined hereinbefore). However, it will be appreciated by those skilled in the chemical arts that this reaction sequence allows a broad selection of agents to be prepared.

Yet another DEQA softener active that is suitable for the formulation of the concentrated, liquid fabric softener compositions of the present invention, has the above formula (1) wherein one R group is a $C_{1-4}$ hydroxy alkyl group, or polyalkoxy group, preferably hydroxy alkyl, more preferably hydroxyethyl, group. An example of such a hydroxyethyl ester active is di(acyloxyethyl)(2-hydroxyethyl)methyl ammonium methyl sulfate, where the acyl is derived from the fatty acids described hereinbefore, e.g., oleic acid.

The compositions can also contain DEQAs of formula (1) having more saturated hydrophobic groups.

The compositions can also contain medium-chain cationic ammonium fabric softening compound, including DEQAs having the above formula (1) and/or formula (2), below, wherein:

each Y is —O—(O)C—, —(R)N—(O)C—, —C(O)—N(R)—, or —C(O)—O—, preferably —O—(O)C—;

m is 2 or 3, preferably 2;

each n is 1 to 4, preferably 2;

each R is as defined hereinbefore;

each $R^1$, or $YR^1$ hydrophobic group is a saturated, $C_8$–$C_{14}$, preferably a $C_{12-14}$ hydrocarbyl, or substituted hydrocarbyl substituent (the IV is preferably about 10 or less, more preferably less than about 5), [The sum of the carbons in the hydrophobic group is the number of carbon atoms in the $R^1$ group, or in the $YR^1$ group when Y is —O—(O)C— or —(R)N—(O)C—.] and the counterion, $A^-$, is the same as above. Preferably $A^-$ does not include phosphate salts.

The saturated $C_8$–$C_{14}$ fatty acyl groups can be pure derivatives or can be mixed chainlengths.

Suitable fatty acid sources for said fatty acyl groups are coco, lauric, caprylic, and capric acids.

For $C_{12}$–$C_{14}$ (or $C_{11}$–$C_{13}$) hydrocarbyl groups, the groups are preferably saturated, e.g., the IV is preferably less than about 10, preferably less than about 5.

It will be understood that substituents R and $R^1$ can optionally be substituted with various groups such as alkoxyl or hydroxyl groups, and can be straight, or branched so long as the $R^1$ groups maintain their basically hydrophobic character.

(2) A second type of DEQA active has the general formula:

$$[R_3N^+CH_2CH(YR^1)(CH_2YR^1)]\ A^{31}$$

wherein each Y, R, $R^1$, and $A^-$ have the same meanings as before. Such compounds include those having the formula:

$$[CH_3]_3\ N^{(+)}[CH_2CH(CH_2O(O)CR^1)O(O)CR^1]\ Cl^{(-)}$$

where each R is a methyl or ethyl group and preferably each $R^1$ is in the range of $C_{15}$ to $C_{19}$. As used herein, when the diester is specified, it can include the monoester that is present. The amount of monoester that can be present is the same as in DEQA (1).

These types of agents and general methods of making them are disclosed in U.S. Pat. No. 4,137,180, Naik et al., issued Jan. 30, 1979, which is incorporated herein by reference. An example of a preferred DEQA of formula (2)

is the "propyl" ester quaternary ammonium fabric softener active having the formula 1,2-di(acyloxy)-3-trimethylammoniopropane chloride, where the acyl is the same as that of $FA^5$.

The DEQA actives described hereinabove can contain a low level of the fatty acids which can be unreacted starting material and/or by-product of any partial degradation, e.g., hydrolysis, of the softener actives in the finished compositions. It is preferred that the level of free fatty acid be low, preferably below about 10%, more preferably below about 5%, by weight of the softener active.

(3) The DEQA actives described hereinabove also include the neutralized amine softener actives wherein at least one R group is a hydrogen atom. A non-limiting example of actives of this type is the chloride salt of (unsaturated alkoyloxyethyl)(unsaturated alkylamidotrimethylene) methylamine. Other examples of suitable amine softeners are disclosed in copending application Ser. No. 60/054,141, filed Jul. 29, 1997, for CONCENTRATED, STABLE, PREFERABLY CLEAR, FABRIC SOFTENING COMPOSITION CONTAINING AMINE FABRIC SOFTENER by K. A. Grimm et al.

The softener active can also comprise the following:

(3) softener having the formula:

$$R_{4-m}—N^{(+)}—R^1{}_m\ A-$$

wherein each m is 2 or 3, each $R^1$ is a $C_6$–$C_{22}$, preferably $C_{14}$–$C_{20}$, but no more than one being less than about $C_{12}$ and then the other is at least about 16, hydrocarbyl, or substituted hydrocarbyl substituent, preferably $C_{10}$–$C_{20}$ alkyl or alkenyl (unsaturated alkyl, including polyunsaturated alkyl, also referred to sometimes as "alkylene"), most preferably $C_{12}$–$C_{18}$ alkyl or alkenyl, and where the Iodine Value of a fatty acid containing this $R^1$ group is from about 70 to about 140, more preferably from about 80 to about 130; and most preferably from about 90 to about 115 with a cis/trans ratio of from about 1:1 to about 50:1, the minimum being 1:1, preferably from about 2:1 to about 40:1, more preferably from about 3:1 to about 30:1, and even more preferably from about 4:1 to about 20:1; each $R^1$ can also preferably be a branched chain $C_{14}$–$C_{22}$ alkyl group, preferably a branched chain $C_{16}$–$C_{18}$ group; each R is H or a short chain $C_1$–$C_6$, preferably $C_1$–$C_3$ alkyl or hydroxyalkyl group, e.g., methyl (most preferred), ethyl, propyl, hydroxyethyl, and the like, benzyl, or $(R^2\ O)_{2-4}H$; and $A^-$ is a softener compatible anion, preferably, chloride, bromide, methylsulfate, ethylsulfate, sulfate, and nitrate, more preferably chloride and methyl sulfate;

(4) softener having the formula:

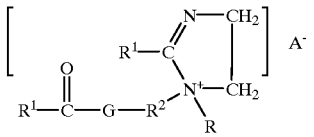

wherein each R, $R^1$, and $A^-$ have the definitions given above; each $R^2$ is a $C_{1-6}$ alkylene group, preferably an ethylene group; and G is an oxygen atom or an —NR-group;

(5) softener having the formula:

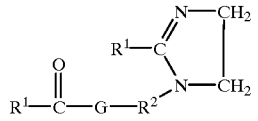

wherein $R^1$, $R^2$ and G are defined as above;

(6) reaction products of substantially unsaturated and/or branched chain higher fatty acids with dialkylenetriamines in, e.g., a molecular ratio of about 2:1, said reaction products containing compounds of the formula:

$$R^1—C(O)—NH—R^2—NH—R^3—NH—C(O)—R^1$$

wherein $R^1$, $R^2$ are defined as above, and each $R^3$ is a $C_{1-6}$ alkylene group, preferably an ethylene group;

(7) softener having the formula:

$$[R^1—C(O)NR—R^2—N(R)R^3—NR—C(O)—R^1]^+A^-$$

wherein R, $R^1$, $R^2$, $R^3$ and A—are defined as above;

(8) the reaction product of substantially unsaturated and/or branched chain higher fatty acid with hydroxyalkylalkylenediamines in a molecular ratio of about 2:1, said reaction products containing compounds of the formula:

$$R^1—C(O)-NH—R^2—N(R^3OH)—C(O)—R^1$$

wherein $R^1$, $R^2$ and $R^3$ are defined as above;

(9) softener having the formula:

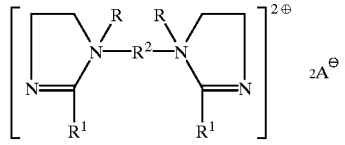

wherein R, $R^1$, $R^2$, and $A^-$ are defined as above; and

(10) mixtures thereof.

Examples of Compound (3) are dialkylenedimethylammonium salts such as dicanoladimethylammonium chloride, dicanoladimethylammonium methylsulfate, dipartially hydrogenated soybean, cis/trans ratio of about 4:1) dimethylammonium chloride, dioleyldimethylammonium chloride. Dioleyldimethylammonium chloride and di(canola)dimethylammonium chloride are preferred. An example of commercially available dialkylenedimethylammonium salts usable in the present invention is dioleyldimethylammonium chloride available from Witco Corporation under the trade name Adogen® 472.

An example of Compound (4) is 1-methyl-1-oleylamidoethyl-2-oleylimidazolinium methylsulfate wherein $R^1$ is an acyclic aliphatic $C_{15}$–$C_{17}$ hydrocarbon group, $R^2$ is an ethylene group, G is a NH group, $R^5$ is a methyl group and A— is a methyl sulfate anion, available commercially from the Witco Corporation under the trade name Varisoft® 3690.

An example of Compound (5) is 1-oleylamidoethyl-2-oleylimidazoline wherein $R^1$ is an acyclic aliphatic $C_{15}$–$C_{17}$ hydrocarbon group, $R^2$ is an ethylene group, and G is a NH group.

An example of Compound (6) is reaction products of oleic acids with diethylenetriamine in a molecular ratio of about 2:1, said reaction product mixture containing N,N"-dioleoyldiethylenetriamine with the formula:

$$R^1—C(O)—NH—CH_2CH_2—NH—CH_2CH_2—NH—C(O)—R^1$$

wherein $R^1$—C(O) is oleoyl group of a commercially available oleic acid derived from a vegetable or animal source, such as Emersol® 223LL or Emersol® 7021, available from Henkel Corporation, and $R^2$ and $R^3$ are divalent ethylene groups.

An example of Compound (7) is a difatty amidoamine based softener having the formula:

$$[R^1—C(O)—NH—CH_2CH_2—N(CH_3)(CH_2CH_2OH)—CH_2CH_2—NH—C(O)—R^1]^+CH_3SO_4—$$

wherein $R^1$—C(O) is oleoyl group, available commercially from the Witco Corporation under the trade name Varisoft® 222LT.

An example of Compound (8) is reaction products of oleic acids with N-2-hydroxyethylethylenediamine in a molecular ratio of about 2:1, said reaction product mixture containing a compound of the formula:

$$R^1—C(O)—NH—CH_2CH_2—N(CH_2CH_2OH)—C(O)—R^1$$

wherein $R^1$—C(O) is oleoyl group of a commercially available oleic acid derived from a vegetable or animal source, such as Emersol® 223LL or Emersol® 7021, available from Henkel Corporation.

An example of Compound (9) is the diquaternary compound having the formula:

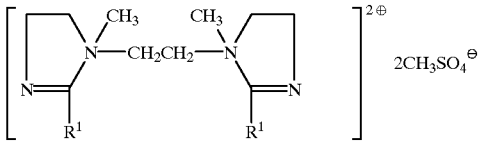

wherein $R^1$ is derived from oleic acid, and the compound is available from Witco Company.

The above individual Compounds (actives) can be used individually or as mixtures.

One type of optional but highly desirable cationic compound which can be used in combination with the above softener actives are compounds containing one long chain acyclic $C_8$–$C_{22}$ hydrocarbon group, selected from the group consisting of:

wherein $R^7$ is hydrogen or a $C_1$–$C_4$ saturated alkyl or hydroxyalkyl group, and $R^1$ and A— are defined as herein above;

(11) acyclic quaternary ammonium salts having the formula:

$$[R^1—N(R^5)_2—R^6]^+ A—$$

wherein $R^5$ and $R^6$ are $C_1$–$C_4$ alkyl or hydroxyalkyl groups, and $R^1$ and A— are defined as herein above;

(12) substituted imidazolinium salts having the formula:

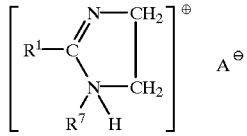

wherein $R^7$ is hydrogen or a $C_1$-$C_4$ saturated alkyl or hydroxyalkyl group, and $R^1$ and $A^-$ are defined as hereinabove;

(13) substituted imidazolinium salts having the formula:

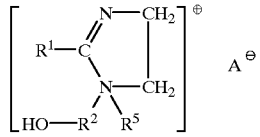

wherein $R^5$ is a $C_1$–$C_4$ alkyl or hydroxyalkyl group, and $R^1$, $R^2$, and $A^-$ are as defined above;

(14) alkylpyridinium salts having the formula:

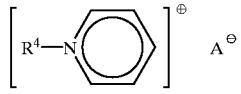

wherein $R^4$ is an acyclic aliphatic $C_8$–$C_{22}$ hydrocarbon group and $A^-$ is an anion; and

(15) alkanamide alkylene pyridinium salts having the formula:

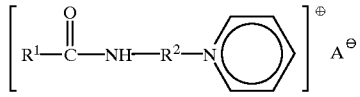

wherein $R^1$, $R^2$ and $A^-$ are defined as herein above; and mixtures thereof.

Examples of Compound (11) are the monoalkenyltrimethylammonium salts such as monooleyltrimethylammonium chloride, monocanolatrimethylammonium chloride, and soyatrimethylammonium chloride. Monooleyltrimethylammonium chloride and monocanolatrimethylammonium chloride are preferred. Other examples of Compound (11) are soyatrimethylammonium chloride available from Witco Corporation under the trade name Adogen® 415, erucyltrimethylammonium chloride wherein $R^1$ is a $C_{22}$ hydrocarbon group derived from a natural source; soyadimethylethylammonium ethylsulfate wherein $R^1$ is a $C_{16}$–$C_1$ 8 hydrocarbon group, $R^5$ is a methyl group, $R^6$ is an ethyl group, and $A^-$ is an ethylsulfate anion; and methyl bis(2-hydroxyethyl) oleylammonium chloride wherein $R^1$ is a $C_{18}$ hydrocarbon group, $R^5$ is a 2-hydroxyethyl group and $R^6$ is a methyl group.

An example of Compound (13) is 1-ethyl-1-(2-hydroxyethyl)-2-isoheptadecylimidazolinium ethylsulfate wherein $R^1$ is a $C_{17}$ hydrocarbon group, $R^2$ is an ethylene group, $R^5$ is an ethyl group, and $A^-$ is an ethylsulfate anion.

Anion A

In the cationic nitrogenous salts herein, the anion $A^-$, which is any softener compatible anion, provides electrical neutrality. Most often, the anion used to provide electrical neutrality in these salts is from a strong acid, especially a halide, such as chloride, bromide, or iodide. However, other anions can be used, such as methylsulfate, ethylsulfate, acetate, formate, sulfate, carbonate, and the like. Chloride and methylsulfate are preferred herein as anion A.

IV. COMPOSITIONS

The compositions herein can comprise liquid compositions that can be either dispersions or clear.

A. DISPERSION COMPOSITIONS

Stable "dispersion" compositions can be prepared like those disclosed in copending U.S. patent application S.N. Serial No. 08/461,207, filed Jun. 5, 1995, by E. H. Wahl et al., said application being incorporated herein by reference. Suitable optional components in addition to the softener active are disclosed hereinafter.

The dispersion liquid compositions herein can be both dilute and concentrated, but are preferably concentrated. They can contain:

I. from about 2% to about 40%, preferably from about 13% to about 35%, more preferably from about 17% to about 30%, and even more preferably from about 19% to about 28%, by weight of the composition, of any of the fabric softening actives disclosed above, said fabric softener active being in the form of a stable dispersion;

II. optionally, from 0% to about 10%, preferably from about 0.1% to about 5%, and more preferably from about 0.2% to about 2.5%, of perfume;

III. optionally, from 0% to about 2%, preferably from about 0.01% to about 0.2%, and more preferably from about 0.035% to about 0.1%, of stabilizer; and IV. the balance being a liquid carrier comprising water and, optionally, from about 5% to about 30%, preferably from about 8% to about 25%, more preferably from about 10% to about 20%, by weight of the composition of water soluble organic solvent; the viscosity of the composition being less than about 500 cps, preferably less than about 400 cps, more preferably less than about 200 cps, and recovering to less than about 1000 cps, preferably less than about 500 cps, more preferably less than about 200 cps after freezing and thawing.

B. CLEAR COMPOSITIONS

The compositions can be clear and comprise:

1. from about 5% to about 80%, preferably from about 13% to about 75%, more preferably from about 17% to about 70%, and even more preferably from about 19% to about 65%, by weight of the composition, of any of the fabric softening actives disclosed above, and especially biodegradable fabric softener active selected from the group consisting of:

1. softener having the formula:

$$\{R_{4-m}—N^+—[(CH_2)_n—Y—R^1]_m\}\ A^-$$

wherein each R substituent is a short chain $C_1$–$C_6$, preferably $C_1$–$C_3$ alkyl or hydroxyalkyl group, e.g., methyl (most preferred), ethyl, propyl, hydroxyethyl, and the like, benzyl, or mixtures thereof, each m is 2 or 3; each n is from 1 to about 4; each Y is —G—(O)C—, or —C(O)—G—, where G is an oxygen atom or —NR—; the sum of carbons in each $R^1$, plus one when Y is —O—(O)C—, is $C_{12}$–$C_{22}$, preferably $C_{14}$–$C_{20}$, with each $R^1$ being a hydrocarbyl, or substituted hydrocarbyl, group, preferably, alkyl, monounsaturated alkylene, and polyunsaturated alkylene groups, the IV being from about 70 to about 140, more preferably from about 80 to about 130; and most preferably from about 90 to about 115 and the cis/trans ratio being from about 1:1 to about 50:1, the minimum being 1:1, preferably from about 2:1 to about 40:1, more preferably from about 3:1 to about 30:1, and even more preferably from about 4:1 to about 20:1, with the softener active containing polyunsaturated alkylene groups preferably being at least about 3% by weight of the total softener active present and the level of tri-unsaturated acyl groups is limited as discussed hereinbefore; and wherein the counterion, $A^-$, can be any softener-compatible anion, preferably, chloride, bromide, methyl sulfate, or nitrate, more preferably chloride;

2. softener having the formula:

$$[R_3N^+CH_2CH(YR^1)(CH_2YR^1)]\ A^-$$

wherein each Y, R, $R^1$, and $X^{(-)}$ have the same meanings as before; and 3. mixtures thereof;

II. less than about 40%, preferably from about 10% to about 38%, more preferably from about 12% to about 25%, and even more preferably from about 14% to about 20%, by weight of the composition of principal solvent having a ClogP of from about 0.15 to about 0.64, preferably from about 0.25 to about 0.62, and more preferably from about 0.40 to about 0.60, and preferably having some degree of asymmetry, said principal solvent preferably comprising 1,2-hexanediol, or, alternatively, 2,2,4-trimethyl-1,3-pentanediol (TMPD) and 1,4-cyclohexanedimethanol the ratio range of TMPD to 1,4-cyclohexanedimethanol for good phase stability, especially low temperature phase stability, preferably being from about 80:20 to about 50:50, more preferably about 75:25;

III. optionally, but preferably, from 0% to about 15%, preferably from about 0.1% to about 8%, and more preferably from about 0.2% to about 5%, of perfume;

IV. optionally, from 0% to about 2%, preferably from about 0.01% to about 0.2%, and more preferably from about 0.035% to about 0.1%, of stabilizer;

V. optionally, but preferably, an effective amount, sufficient to improve clarity, of low molecular weight water soluble solvents like ethanol; isopropanol; propylene glycol; 1,3-propanediol; propylene carbonate; hexylene glycol; etc., said water soluble solvents being at a level that will not form clear compositions by themselves;

VI. optionally, but preferably, an effective amount to improve clarity, of water soluble calcium and/or magnesium salt, preferably chloride; and VII. the balance being water.

The pH of the compositions should be from about 1.5 to about 5, preferably from about 2.5 to about 4.5, more preferably from about 3 to about 4.

Principal Solvent For Clear Compositions

The suitability of any principal solvent for the formulation of the liquid, concentrated, preferably clear, fabric softener compositions herein with the requisite stability is surprisingly selective. Suitable solvents can be selected based upon their octanol/water partition coefficient (P). Octanol/water partition coefficient of a principal solvent is the ratio between its equilibrium concentration in octanol and in water. The partition coefficients of the principal solvent ingredients of this invention are conveniently given in the form of their logarithm to the base 10, logP.

The logP of many ingredients has been reported; for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference). The fragment approach is based on the chemical structure of each ingredient, and takes into account the numbers and types of atoms, the atom connectivity, and chemical bonding. The ClogP values, which are the most reliable and widely used estimates for this physicochemical property, are preferably used instead of the experimental logP values in the selection of the principal solvent ingredients which are useful in the present invention.

Solvents that have a low molecular weight and are biodegradable are also desirable for some purposes. The more asymmetric solvents appear to be very desirable, whereas the highly symmetrical solvents, having a center of symmetry, such as 1,7-heptanediol, or 1,4-bis (hydroxymethyl)cyclohexane, appear to be unable to provide the essentially clear compositions when used alone, even though their ClogP values fall in the preferred range. One can select the most suitable principal solvent by determining whether a composition containing about 27% di(oleoyloxyethyl)dimethylammonium chloride, about 16–20% of principal solvent, and about 4–6% ethanol remains clear during storage at about 40° F. (about 4.4° C.) and recovers from being frozen at about 0° F. (about −18° C.).

Suitable solvents include: 2,2,4-trimethyl-1,3-pentanediol; the ethoxylate, diethoxylate, or triethoxylate derivatives of 2,2,4-trinmethyl-1,3-pentanediol; and/or 2-ethyl-1,3-hexanediol, and/or mixtures thereof;

I. mono-ols including:

a. n-propanol; and/or b. 2-butanol and/or 2-methyl-2-propanol;

II. hexane diol isomers including: 2,3-butanediol, 2,3-dimethyl-; 1,2-butanediol, 2,3-dimethyl-; 1,2-butanediol, 3,3-dimethyl-; 2,3-pentanediol, 2-methyl-; 2,3-pentanediol, 3-methyl-; 2,3-pentanediol, 4-methyl-; 2,3-hexanediol; 3,4-hexanediol; 1,2-butanediol, 2-ethyl-; 1,2-pentanediol, 2-methyl-; 1,2-pentanediol, 3-methyl-; 1,2-pentanediol, 4-methyl-; and/or 1,2-hexanediol;

III. heptane diol isomers including: 1,3-propanediol, 2-butyl-; 1,3-propanediol, 2,2-diethyl-; 1,3-propanediol, 2-(1-methylpropyl)-; 1,3-propanediol, 2-(2-methylpropyl)-; 1,3-propanediol, 2-methyl-2-propyl-; 1 ,2-butanediol, 2,3,3-trimethyl-; 1,4-butanediol, 2-ethyl-2-methyl-; 1,4-butanediol, 2-ethyl-3-methyl-; 1,4-butanediol, 2-propyl-; 1,4-butanediol, 2-isopropyl-; 1,5-pentanediol, 2,2-dimethyl-; 1,5-pentanediol, 2,3-dimethyl-; 1,5-pentanediol, 2,4-dimethyl-; 1,5-pentanediol, 3,3-dimethyl-; 2,3-pentanediol, 2,3-dimethyl-; 2,3-pentanediol, 2,4-dimethyl-; 2,3-pentanediol, 3,4-dimethyl-; 2,3-pentanediol, 4,4-dimethyl-; 3,4-pentanediol, 2,3-dimethyl-; 1,5-pentanediol, 2-ethyl-; 1,6-hexanediol, 2-methyl-; 1,6-hexanediol, 3-methyl-; 2,3-hexanediol, 2-methyl-; 2,3-hexanediol, 3-methyl-; 2,3-hexanediol, 4-methyl-; 2,3-hexanediol, 5-methyl-; 3,4-hexanediol, 2-methyl-; 3,4-hexanediol, 3-methyl-; 1,3-heptanediol; 1,4-heptanediol; 1,5-heptanediol; and/or 1,6-heptanediol;

IV. octane diol isomers including: 1,3-propanediol, 2-(2-methylbutyl)-; 1,3-propanediol, 2-(1,1-dimethylpropyl)-1,3-propanediol, 2-(1,2-dimethylpropyl)-; 1,3-propanediol, 2-(1-ethylpropyl)-; 1,3-propanediol, 2-(1-methylbutyl)-; 1,3-propanediol, 2-(2,2-dimethylpropyl)-; 1,3-propanediol, 2-(3-methylbutyl)-; 1,3-propanediol, 2-butyl-2-methyl-; 1,3-propanediol, 2-ethyl-2-isopropyl-; 1,3-propanediol, 2-ethyl-2-propyl-; 1,3-propanediol, 2-methyl-2-(1-methylpropyl)-; 1,3-propanediol, 2-methyl-2-(2-methylpropyl)-; 1,3-propanediol, 2-tertiary-butyl-2-methyl-; 1,3-butanediol, 2,2-diethyl-; 1,3-butanediol, 2-(1-methylpropyl)-; 1,3-butanediol, 2-butyl-; 1,3-butanediol, 2-ethyl-2,3-dimethyl-; 1,3-butanediol, 2-(1,1-dimethylethyl)-; 1,3-butanediol, 2-(2-methylpropyl)-; 1,3-butanediol, 2-methyl-2-isopropyl-; 1,3-butanediol, 2-methyl-2-propyl-; 1,3-butanediol, 3-methyl-2-isopropyl-; 1,3-butanediol, 3-methyl-2-propyl-; 1,4-butanediol, 2,2-diethyl-; 1,4-butanediol, 2-methyl-2-propyl-; 1,4-butanediol, 2-(1-methylpropyl)-; 1,4-butanediol, 2-ethyl-2,3-dimethyl-; 1,4-butanediol, 2-ethyl-3,3-dimethyl-; 1,4-butanediol, 2-(1,1-dimethylethyl)-; 1,4-butanediol, 2-(2-methylpropyl)-; 1,4-butanediol, 2-methyl-3-propyl-; 1,4-butanediol, 3-methyl-2-isopropyl-; 1,3-pentanediol, 2,2,3-trimethyl-; 1,3-pentanediol, 2,2,4-trimethyl-; 1,3-pentanediol, 2,3,4-trimethyl-; 1,3-pentanediol, 2,4,4-trimethyl-; 1,3-pentanediol, 3,4,4-trimethyl-; 1,4-pentanediol, 2,2,3-trimethyl-; 1,4-pentanediol, 2,2,4-trimethyl-; 1,4-pentanediol, 2,3,3-trimethyl-; 1,4-pentanediol, 2,3,4-trimethyl-; 1,4-pentanediol, 3,3,4-trimethyl-; 1,5-pentanediol, 2,2,3-trimethyl-; 1,5-pentanediol, 2,2,4-trimethyl-; 1,5-pentanediol, 2,3,3-trimethyl-; 1,5-pentanediol, 2,3,4-trimethyl-; 2,4-pentanediol, 2,3,3-trimethyl-; 2,4-pentanediol, 2,3,4-trimethyl-; 1,3-pentanediol, 2-ethyl-2-methyl-; 1,3-pentanediol, 2-ethyl-3-methyl-; 1,3-pentanediol, 2-ethyl-4-methyl-; 1,3-pentanediol, 3-ethyl-2-methyl-; 1,4-pentanediol, 2-ethyl-2-methyl-; 1,4-pentanediol, 2-ethyl-3-methyl-; 1,4-pentanediol, 2-ethyl-4-methyl-; 1,4-pentanediol, 3-ethyl-2-methyl-; 1,4-pentanediol, 3-ethyl-3-methyl-; 1,5-pentanediol, 2-ethyl-2-methyl-; 1,5-pentanediol, 2-ethyl-3-methyl-; 1,5-pentanediol, 2-ethyl-4-methyl-; 1,5-pentanediol, 3-ethyl-3-methyl-; 2,4-pentanediol, 3-ethyl-2-methyl-; 1,3-pentanediol, 2-isopropyl-; 1,3-pentanediol, 2-propyl-; 1,4-pentanediol, 2-isopropyl-; 1,4-pentanediol, 2-propyl-; 1,4-pentanediol, 3-isopropyl-; 1,5-pentanediol, 2-isopropyl-; 2,4-pentanediol, 3-propyl-; 1,3-hexanediol, 2,2-dimethyl-; 1,3-hexanediol, 2,3-dimethyl-; 1,3-hexanediol, 2,4-dimethyl-; 1,3-hexanediol, 2,5-dimethyl-; 1,3-hexanediol, 3,4-dimethyl-; 1,3-hexanediol, 3,5-dimethyl-; 1,3-hexanediol, 4,5-dimethyl-; 1,4-hexanediol, 2,2-dimethyl-; 1,4-hexanediol, 2,3-dimethyl-; 1,4-hexanediol, 2,4-dimethyl-; 1,4-hexanediol, 2,5-dimethyl-; 1,4-hexanediol, 3,3-dimethyl-; 1,4-hexanediol, 3,4-dimethyl-; 1,4-hexanediol, 3,5-dimethyl-; 1,3-hexanediol, 4,4-dimethyl-; 1,4-hexanediol, 4,5-dimethyl-; 1,4-hexanediol, 5,5-dimethyl-; 1,5-hexanediol, 2,2-dimethyl-; 1,5-hexanediol, 2,3-dimethyl-; 1,5-hexanediol, 2,4-dimethyl-; 1,5-hexanediol, 2,5-dimethyl-; 1,5-hexanediol, 3,3-dimethyl-; 1 ,5-hexanediol, 3,4-dimethyl-; 1 ,5-hexanediol, 3,5-dimethyl-; 1,5-hexanediol, 4,5-dimethyl-; 1,6-hexanediol, 2,2-dimethyl-; 1,6-hexanediol, 2,3-dimethyl-; 1,6-hexanediol, 2,4-dimethyl-; 1,6-hexanediol, 2,5-dimethyl-; 1,6-hexanediol, 3,3-dimethyl-; 1,6-hexanediol, 3,4-dimethyl-; 2,4-hexanediol, 2,3-dimethyl-; 2,4-hexanediol, 2,4-dimethyl-; 2,4-hexanediol, 2,5-dimethyl-; 2,4-hexanediol, 3,3-dimethyl-; 2,4-hexanediol, 3,4-dimethyl-; 2,4-hexanediol, 3,5-dimethyl-; 2,4-hexanediol, 4,5-dimethyl-; 2,4-hexanediol, 5,5-dimethyl-; 2,5-hexanediol, 2,3-dimethyl-; 2,5-hexanediol, 2,4-dimethyl-; 2,5-hexanediol, 2,5-dimethyl-; 2,5-hexanediol, 3,3-dimethyl-; 2,5-hexanediol, 3,4-dimethyl-; 2,6-hexanediol, 3,3-dimethyl-; 1,3-hexanediol, 2-ethyl-; 1,3-hexanediol, 4-ethyl-; 1,4-hexanediol, 2-ethyl-; 1,4-hexanediol, 4-ethyl-; 1,5-hexanediol, 2-ethyl-; 2,4-hexanediol, 3-ethyl-; 2,4-hexanediol, 4-ethyl-; 2,5-hexanediol, 3-ethyl-; 1,3-heptanediol, 2-methyl-; 1,3-heptanediol, 3-methyl-; 1,3-heptanediol, 4-methyl-; 1,3-heptanediol, 5-methyl-; 1,3-heptanediol, 6-methyl-; 1,4-heptanediol, 2-methyl-; 1,4-heptanediol, 3-methyl-; 1,4-heptanediol, 4-methyl-; 1,4-heptanediol, 5-methyl-; 1,4-heptanediol, 6-methyl-; 1,5-heptanediol, 2-methyl-; 1,5-heptanediol, 3-methyl-; 1,5-heptanediol, 4-methyl-; 1,5-heptanediol, 5-methyl-; 1,5-heptanediol, 6-methyl-; 1,6-heptanediol, 2-methyl-; 1,6-heptanediol, 3-methyl-; 1,6-heptanediol, 4-methyl-; 1,6-heptanediol, 5-methyl-; 1,6-heptanediol, 6-methyl-; 2,4-heptanediol, 2-methyl-; 2,4-heptanediol, 3-methyl-; 2,4-heptanediol, 4-methyl-; 2,4-heptanediol, 5-methyl-; 2,4-heptanediol, 6-methyl-; 2,5-heptanediol, 2-methyl-; 2,5-heptanediol, 3-methyl-; 2,5-heptanediol, 4-methyl-; 2,5-heptanediol, 5-methyl-; 2,5-heptanediol, 6-methyl-; 2,6-heptanediol, 2-methyl-; 2,6-heptanediol, 3-methyl-; 2,6-heptanediol, 4-methyl-; 3,4-heptanediol, 3-methyl-; 3,5-heptanediol, 2-methyl-; 3,5-heptanediol, 3-methyl-; 3,5-heptanediol, 4-methyl-; 2,4-octanediol; 2,5-octanediol; 2,6-octanediol; 2,7-octanediol; 3,5-octanediol; and/or 3,6-octanediol;

V. nonane diol isomers including: 2,4-pentanediol, 2,3,3,4-tetramethyl-; 2,4-pentanediol, 3-tertiarybutyl-; 2,4-hexanediol, 2,5,5-trimethyl-; 2,4-hexanediol, 3,3,4-trimethyl-; 2,4-hexanediol, 3,3,5-trimethyl-; 2,4-hexanediol, 3,5,5-trimethyl-; 2,4-hexanediol, 4,5,5-trimethyl-; 2,5-hexanediol, 3,3,4-trimethyl-; and/or 2,5-hexanediol, 3,3,5-trimethyl-;

VI. glyceryl ethers and/or di(hydroxyalkyl)ethers including: 1,2-propanediol, 3-(n-pentyloxy)-; 1,2-propanediol, 3-(2-pentyloxy)-; 1,2-propanediol, 3-(3-pentyloxy)-; 1,2-propanediol, 3-(2-methyl-1-butyloxy)-; 1,2-propanediol, 3-(iso-amyloxy)-; 1,2-propanediol, 3-(3-methyl-2-butyloxy)-; 1,2-propanediol, 3-(cyclohexyloxy)-; 1,2-propanediol, 3-(i-cyclohex-1-enyloxy)-; 1,3-propanediol, 2-(pentyloxy)-; 1,3-propanediol, 2-(2-pentyloxy)-; 1,3-propanediol, 2-(3-pentyloxy)-; 1,3-propanediol, 2-(2-methyl-1-butyloxy)-; 1,3-propanediol, 2-(iso-amyloxy)-; 1,3-propanediol, 2-(3-methyl-2-butyloxy)-; 1,3-propanediol, 2-(cyclohexyloxy)-; 1,3-propanediol, 2-(i-cyclohex-1-enyloxy)-; 1,2-propanediol, 3-(butyloxy)-, triethoxylated; 1,2-propanediol, 3-(butyloxy)-, tetraethoxylated; 1,2-propanediol, 3-(butyloxy)-, pentaethoxylated; 1,2-propanediol, 3-(butyloxy)-, hexaethoxylated; 1,2-propanediol, 3-(butyloxy)-, heptaethoxylated; 1,2-propanediol, 3-(butyloxy)-, octaethoxylated; 1,2-propanediol, 3-(butyloxy)-, nonaethoxylated; 1,2-propanediol, 3-(butyloxy)-, monopropoxylated; 1,2-propanediol, 3-(butyloxy)-, dibutyleneoxylated; 1,2-propanediol, 3-(butyloxy)-, tributyleneoxylated; 1,2-propanediol, 3-phenyloxy-; 1,2-propanediol, 3-benzyloxy-; 1,2-propanediol, 3-(2-phenylethyloxy)-; 1,2-propanediol, 3-(1-phenyl-2-propanyloxy)-; 1,3-propanediol, 2-phenyloxy-; 1,3-propanediol, 2-(m-cresyloxy)-; 1,3-propanediol, 2-(p-cresyloxy)-; 1,3-propanediol, -benzyloxy-; 1,3-propanediol, 2-(2-phenylethyloxy)-; 1,3-propanediol, 2-(1-phenylethyloxy)-; bis(2-hydroxybutyl) ether; and/or bis(2-hydroxycyclopentyl)ether;

VII. saturated and unsaturated alicyclic diols and their derivatives including:

(a) the saturated diols and their derivatives, including:

1-isopropyl-1 ,2-cyclobutanediol; 3-ethyl-4-methyl-1,2-cyclobutanediol; 3-propyl-1,2-cyclobutanediol; 3-isopropyl-1 ,2-cyclobutanediol; 1-ethyl-1,2-cyclopentanediol; 1,2-dimethyl-1,2-cyclopentanediol; 1,4-dimethyl-1,2-cyclopentanediol; 2,4,5-trimethyl-1,3-cyclopentanediol; 3,3-dimethyl-1,2-cyclopentanediol; 3,4-dimethyl-1,2-cyclopentanediol; 3,5-dimethyl-1,2-cyclopentanediol; 3-ethyl-1,2-cyclopentanediol; 4,4-dimethyl-1,2-cyclopentanediol; 4-ethyl-1,2-cyclopentanediol; 1,1-bis(hydroxymethyl)cyclohexane; 1,2-bis(hydroxymethyl)cyclohexane; 1,2-dimethyl-1,3-cyclohexanediol; 1,3-bis(hydroxymethyl)cyclohexane; 1,3-dimethyl-1,3-cyclohexanediol; 1,6-dimethyl-1,3-cyclohexanediol; 1-hydroxy-cyclohexaneethanol; 1-hydroxy-cyclohexanemethanol; 1-ethyl-1,3-cyclohexanediol; 1-methyl-1,2-cyclohexanediol; 2,2-dimethyl-1,3-cyclohexanediol; 2,3-dimethyl-1,4-cyclohexanediol; 2,4-dimethyl-1,3-cyclohexanediol; 2,5-dimethyl-1,3-cyclohexanediol; 2,6-dimethyl-1,4-cyclohexanediol; 2-ethyl-1,3-cyclohexanediol; 2-hydroxycyclohexaneethanol; 2-hydroxyethyl-1-cyclohexanol; 2-hydroxymethylcyclohexanol; 3-hydroxyethyl-1-cyclohexanol; 3-hydroxycyclohexaneethanol; 3-hydroxymethylcyclohexanol; 3-methyl-1,2-cyclohexanediol; 4,4-dimethyl-1,3-cyclohexanediol; 4,5-dimethyl-1,3-cyclohexanediol; 4,6-dimethyl-1,3-cyclohexanediol; 4-ethyl-1,3-cyclohexanediol; 4-hydroxyethyl-1-cyclohexanol; 4-hydroxymethylcyclohexanol; 4-methyl-1,2-cyclohexanediol; 5,5-dimethyl-1,3-cyclohexanediol; 5-ethyl-1,3-cyclohexanediol; 1,2-cycloheptanediol; 2-methyl-1,3-cycloheptanediol; 2-methyl-1,4-cycloheptanediol; 4-methyl-1 ,3-cycloheptanediol; 5-methyl-1 ,3-cycloheptanediol; 5-methyl-1,4-cycloheptanediol; 6-methyl-1,4-cycloheptanediol; ; 1,3-cyclooctanediol; 1,4-cyclooctanediol; 1,5-cyclooctanediol; 1,2-cyclohexanediol, diethoxylate; 1,2-cyclohexanediol, triethoxylate; 1,2-cyclohexanediol, tetraethoxylate; 1,2-cyclohexanediol, pentaethoxylate; 1,2-cyclohexanediol, hexaethoxylate; 1,2-cyclohexanediol, heptaethoxylate; 1,2-cyclohexanediol, octaethoxylate; 1,2-cyclohexanediol, nonaethoxylate; 1,2-cyclohexanediol, monopropoxylate; 1,2-cyclohexanediol, monobutylenoxylate; 1,2-cyclohexanediol, dibutylenoxylate; and/or 1,2-cyclohexanediol, tributylenoxylate; and (b). the unsaturated alicyclic diols including: 1,2-cyclobutanediol, 1-ethenyl-2-ethyl-; 3-cyclobutene-1,2-diol, 1,2,3,4-tetramethyl-; 3-cyclobutene-1,2-diol, 3,4-diethyl-; 3-cyclobutene-1,2-diol, 3-(1,1-dimethylethyl)-; 3-cyclobutene-1,2-diol, 3-butyl-; 1,2-cyclopentanediol, 1,2-dimethyl-4-methylene-; 1,2-cyclopentanediol, 1-ethyl-3-methylene-; 1,2-cyclopentanediol, 4-(1-propenyl); 3-cyclopentene-1,2-diol, 1-ethyl-3-methyl-; 1,2-cyclohexanediol, 1-ethenyl-; 1,2-cyclohexanediol, 1-methyl-3-methylene-; 1,2-cyclohexanediol, 1-methyl-4-methylene-; 1,2-cyclohexanediol, 3-ethenyl-; 1,2-cyclohexanediol, 4-ethenyl-; 3-cyclohexene-1,2-diol, 2,6-dimethyl-; 3-cyclohexene-1,2-diol, 6,6-dimethyl-; 4-cyclohexene-1,2-diol, 3,6-dimethyl-; 4-cyclohexene-1,2-diol, 4,5-dimethyl-; 3-cyclooctene-1,2-diol; 4-cyclooctene-1,2-diol; and/or 5-cyclooctene-1,2-diol;

VIII. Alkoxylated derivatives of $C_{3-8}$ diols [In the following disclosure, "EO" means polyethoxylates, i.e., —$(CH_2CH_2O)_nH$; Me-$E_n$ means methyl-capped polyethoxylates —$(CH_2CH_2O)_nCH_3$; "2(Me-En)" means 2 Me-En groups needed; "PO" means polypropoxylates, —$(CH(CH_3)CH_2O)_nH$ ; "BO" means polybutyleneoxy groups, $(CH(CH_2CH_3)CH_2O)_nH$ ; and "n-BO" means poly (n-butyleneoxy) or poly(tetramethylene)oxy groups —$(CH_2CH_2CH_2CH_2O)_nH$. The use of the term "(Cx)" herein refers to the number of carbon atoms in the base material which is alkoxylated.] including:

1. 1,2-propanediol (C3) 2(Me-$E_{1-4}$); 1,2-propanediol (C3) $PO_4$; 1,2-propanediol, 2-methyl-(C4) (Me-E4-10); 1,2-propanediol, 2-methyl-(C4) 2(Me-$E_1$); 1,2-propanediol, 2-methyl-($C_4$) $PO_3$; 1,2-propanediol, 2-methyl-(C4) $BO_1$; 1,3-propanediol (C3) 2(Me-E6-8); 1,3-propanediol (C3) $PO_{5-6;\ 1,3}$-propanediol, 2,2-diethyl-(C7) $E_1$ -7; 1,3-propanediol, 2,2-diethyl-(C7) PO1; 1,3-propanediol, 2,2-diethyl-(C7) n-$BO_{1-2;\ 1,3}$-propanediol, 2,2-dimethyl-(C5) 2(Me $E_{1-2}$); 1,3-propanediol, 2,2-dimethyl-(C5) $PO_{3-4}$; 1,3-propanediol, 2-(1-methylpropyl)-(C7) $E_1$7; 1,3-propanediol, 2-(1-methylpropyl)-(C7) PO1; 1,3-propanediol, 2-(1-methylpropyl)-(C7) n-$BO_{1-2}$; 1,3-propanediol, 2-(2-methylpropyl)-(C7) $E_1$7; 1,3-propanediol, 2-(2-methylpropyl)-(C7) $PO_1$; 1,3-propanediol, 2-(2-methylpropyl)-(C7) n-$BO_{1-2}$; 1,3-propanediol, 2-ethyl-(C5) (Me E6-10); 1,3-propanediol, 2-ethyl-(C5) 2(Me $E_1$); 1,3-propanediol, 2-ethyl-(C5) $PO_3$; 1,3-propanediol, 2-ethyl-2-methyl-(C6) (Me $E_{1-6}$); 1,3-propanediol, 2-ethyl-2-methyl-(C6) $PO_2$; 1,3-propanediol, 2-ethyl-2-methyl-(C6) $BO_1$; 1,3-propanediol, 2-isopropyl-(C6) (Me $E_{1-6}$); 1,3-propanediol, 2-isopropyl-(C6) $PO_2$; 1,3-propanediol, 2-isopropyl-(C6) $BO_1$; 1,3-propanediol, 2-methyl-(C4) 2(Me $E_{2-5}$); 1,3-propanediol, 2-methyl-(C4) $PO_{4-5}$; 1,3-propanediol, 2-methyl-(C4) $BO_2$; 1,3-propanediol, 2-methyl-2-isopropyl-(C7) $E_{2-9}$; 1,3-propanediol, 2-methyl-2-isopropyl-(C7) PO1; 1,3-propanediol, 2-methyl-2-isopropyl-(C7) n-$BO_{1-3}$; 1,3-propanediol, 2-methyl-2-propyl-(C7) $E_{1-7}$; 1,3-propanediol, 2-methyl-2-propyl-(C7) P01; 1,3-propanediol, 2-methyl-2-propyl-(C7) n-$BO_{1-2}$; 1,3-propanediol, 2-propyl-(C6) (Me $E_1$4); 1,3-propanediol, 2-propyl-(C6) $PO_2$; 1,3-propanediol, 2-propyl-(C6) $BO_1$;

2. 1,2-butanediol (C4) (Me $E_{2-8}$); 1,2-butanediol (C4) PO2 3; 1,2-butanediol (C4) BO1; 1,2-butanediol, 2,3-dimethyl-(C6) El6; 1,2-butanediol, 2,3-dimethyl-(C6) n-$BO_{1-2}$; 1,2-butanediol, 2-ethyl-(C6) $E_{1-3}$; 1,2-butanediol, 2-ethyl-(C6) n-$BO_{1-2}$; 1,2-butanediol, 2-methyl-(C5) (Me $E_{1-2}$); 1,2-butanediol, 2-methyl-(C5) $PO_1$; 1,2-butanediol, 3,3-dimethyl-(C6) El-6; 1,2-butanediol, 3,3-dimethyl-(C6) n-$BO_{1-2}$; 1,2-butanediol, 3-methyl-(C5) (Me $E_1$-2); 1,2-butanediol, 3-methyl-(C5) $PO_1$; 1,3-butanediol (C4) 2(Me $E_{3-6}$); 1,3-butanediol (C4) $PO_5$; 1,3-butanediol (C4) $BO_2$; 1,3-butanediol, 2,2,3-trimethyl-(C7) (Me $E_{13}$); 1,3-butanediol, 2,2,3-trimethyl-(C7) $PO_{1-2}$; 1,3-butanediol, 2,2-dimethyl-(C6) (Me $E_{3-8}$); 1,3-butanediol, 2,2-dimethyl-(C6) $PO_3$; 1,3-butanediol, 2,3-dimethyl-(C6) (Me $E_{3-8}$); 1,3-butanediol, 2,3-dimethyl-(C6) $PO_3$; 1,3-butanediol, 2-ethyl-(C6) (Me $E_{1-6}$); 1,3-butanediol, 2-ethyl-(C6) $PO_{2-3}$; 1,3-butanediol, 2-ethyl-(C6) $BO_1$; 1,3-butanediol, 2-ethyl-2-methyl-(C7) (Me $E_1$); 1,3-butanediol, 2-ethyl-2-methyl-(C7) $PO_1$; 1,3-butanediol, 2-ethyl-2-methyl-(C7) n-$BO_{2-4}$; 1,3-butanediol, 2-ethyl-3-methyl-(C7) (Me $E_1$); 1,3-butanediol, 2-ethyl-3-methyl-(C7) PO1; 1,3-butanediol, 2-ethydroxycyclohexaneethanol;hyl-3-methyl-(C7) n-$BO_{2-4}$; 1,3-butanediol, 2-isopropyl-(C7) (Me $E_1$); 1,3-butanediol, 2-isopropyl-(C7) $PO_1$; 1,3-butanediol, 2-isopropyl-(C7) n-$BO_{2-4}$; 1,3-butanediol, 2-methyl-(C5) 2(Me $E_1$3); 1,3-butanediol, 2-methyl-(C5) $PO_4$; 1,3-butanediol, 2-propyl-(C7) $E_{2-9}$; 1,3-butanediol, 2-propyl-(C7) $PO_1$; 1,3-butanediol, 2-propyl-(C7) n-$BO_{1-3}$; 1,3-butanediol, 3-methyl-(C5) 2(Me $E_{1-3}$); 1,3-butanediol, 3-methyl-(C5) $PO_4$; 1,4-butanediol (C4) 2(Me E2-4); 1,4-butanediol C4) $PO_{4-5}$; 1,4-butanediol (C4) $BO_2$; 1,4-butanediol, 2,2,3-trimethyl-(C7) $E_{2-9}$; 1,4-butanediol, 2,2,3-trimethyl-(C7) $PO_1$; 1,4-butanediol, 2,2,3-trimethyl-(C7) n-$BO_{1-3}$; 1,4-butanediol, 2,2-dimethyl-(C6) (Me $E_{1-6}$); 1,4-butanediol, 2,2-dimethyl-(C6) $PO_2$; 1,4-butanediol, 2,2-dimethyl-(C6) $BO_1$; 1,4-butanediol, 2,3-dimethyl-(C6) (Me $E_{1-6}$); 1,4-butanediol, 2,3-dimethyl-(C6) $PO_2$; 1,4-butanediol, 2,3-dimethyl-(C6) $BO_1$; 1,4-butanediol, 2-ethyl-(C6) (Me $E_{1-4}$); 1,4-butanediol, 2-ethyl-(C6) $PO_2$; 1,4-butanediol, 2-ethyl-(C6) $BO_1$; 1,4-butanediol, 2-ethyl-2-methyl-(C7) $E_{1-7}$; 1,4-butanediol, 2-ethyl-2-methyl-(C7) $PO_1$; 1,4-butanediol, 2-ethyl-2-methyl-(C7) n-$BO_{1-2}$; 1,4-butanediol, 2-ethyl-3-methyl-(C7) $E_{1-7}$; 1,4-butanediol, 2-ethyl-3-methyl-(C7) $PO_1$; 1,4-butanediol, 2-ethyl-3-methyl-(C7) n-$BO_{1-2}$; 1,4-butanediol, 2-isopropyl-(C7) $E_{1-7}$; 1,4-butanediol, 2-isopropyl-(C7) $PO_1$; 1,4-butanediol, 2-isopropyl-(C7) n-$BO_{1-2}$; 1,4-butanediol, 2-methyl-(C5) (Me $E_{6-10}$); 1,4-butanediol, 2-methyl-(C5) 2(Me $E_1$); 1,4-butanediol, 2-methyl-(C5) $PO_3$; 1,4-butanediol, 2-methyl-(C5) $BO_1$; 1,4-butanediol, 2-propyl-(C7) $E_{1-5}$; 1,4-butanediol, 2-propyl-(C7) n-$BO_{1-2}$; 1,4-butanediol, 3-ethyl-1-methyl-(C7) $E_{2-9}$; 1,4-butanediol, 3-ethyl-1-methyl-(C7) $PO_1$; 1,4-butanediol, 3-ethyl-1-methyl-(C7) n-$BO_{1-3}$; 2,3-butanediol (C4) (Me $E_{6-10}$); 2,3-butanediol (C4) 2(Me $E_1$); 2,3-butanediol (C4) $PO_{3-4}$; 2,3-butanediol (C4) BO1; 2,3-butanediol, 2,3-dimethyl-(C6) $E_{3-9}$; 2,3-butanediol, 2,3-dimethyl-(C6) $PO_1$; 2,3-butanediol, 2,3-dimethyl-(C6) n-$BO_{1-3}$; 2,3-butanediol, 2-methyl-(C5) (Me $E_{15}$); 2,3-butanediol, 2-methyl-(C5) $PO_2$; 2,3-butanediol, 2-methyl-(CS) $BO_1$;

3. 1,2-pentanediol (CS) $E_{3-10}$; 1,2-pentanediol, (CS) $PO_1$; 1,2-pentanediol, (C5) n-$BO_{2-3}$; 1,2-pentanediol, 2-methyl (C6) $E_{1-3}$; 1,2-pentanediol, 2-methyl (C6) n-$BO_1$; 1,2-pentanediol, 2-methyl (C6) BO1; 1,2-pentanediol, 3-methyl (C6) $E_{1-3}$; 1,2-pentanediol, 3-methyl (C6) n-BO; 1,2-pentanediol, 4-methyl (C6) $E_{1-3}$; 1,2-pentanediol, 4-methyl (C6) n-$BO_1$; 1,3-pentanediol (CS) 2(Me-$E_{1-2}$); 1,3-pentanediol (C5) $PO_{3-4}$; 1,3-pentanediol, 2,2-dimethyl-(C7) (Me-El); 1,3-pentanediol, 2,2-dimethyl-(C7) $PO_1$; 1,3-pentanediol, 2,2-dimethyl-(C7) n-$BO_{2-4}$; 1,3-pentanediol, 2,3-dimethyl-(C7) (Me-$E_1$); 1,3-pentanediol, 2,3-dimethyl-(C7) $PO_1$; 1,3-pentanediol, 2,3-dimethyl-(C7) n-$BO_{2-4}$; 1,3-pentanediol, 2,4-dimethyl-(C7) (Me-$E_1$); 1,3-pentanediol, 2,4-dimethyl-(C7) $PO_1$; 1,3-pentanediol, 2,4-dimethyl-(C7) n-$BO_{2-4}$; 1,3-pentanediol, 2-ethyl-(C7) $E_{2-9}$; 1,3-pentanediol, 2-ethyl-(C7) $PO_1$; 1,3-pentanediol, 2-ethyl-(C7) n-$BO_{1-3}$; 1,3-pentanediol, 2-methyl-(C6) 2(Me-$E_{1-6}$); 1,3-pentanediol, 2-methyl-(C6) $PO_{2-3}$; 1,3-pentanediol, 2-methyl-(C6) $BO_1$; 1,3-pentanediol, 3,4-dimethyl-(C7) (Me-$E_1$); 1,3-pentanediol, 3,4-dimethyl-(C7) $PO_1$; 1,3-pentanediol, 3,4-dimethyl-(C7) n-$BO_{2-4}$; 1,3-pentanediol, 3-methyl-(C6) (Me-$E_{1-6}$); 1,3-pentanediol, 3-methyl-(C6) $PO_{2-3}$; 1,3-pentanediol, 3-methyl-(C6) $BO_1$; 1,3-pentanediol, 4,4-dimethyl-(C7) (Me-$E_1$); 1,3-pentanediol, 4,4-dimethyl-(C7) $PO_1$; 1,3-pentanediol, 4,4-dimethyl-(C7) n-$BO_{2-4}$; 1,3-pentanediol, 4-methyl-(C6) (Me-$E_{1-6}$); 1,3-pentanediol, 4-methyl-(C6) $PO_{2-3}$; 1,3-pentanediol, 4-methyl-(C6) $BO_1$; 1,4-pentanediol, (CS) 2(Me-$E_{1-2}$); 1,4-pentanediol (C5) $PO_{3-4}$; 1,4-pentanediol, 2,2-dimethyl-(C7) (Me-$E_1$); 1,4-pentanediol, 2,2-dimethyl-(C7) $PO_1$; 1,4-pentanediol, 2,2-dimethyl-(C7) n-$BO_{2-4}$; 1,4-pentanediol, 2,3-dimethyl-(C7) (Me-$E_1$); 1,4-pentanediol, 2,3-dimethyl-(C7) $PO_1$; 1,4-pentanediol, 2,3-dimethyl-(C7) n-$BO_{2-4}$; 1,4-pentanediol, 2,4-dimethyl-(C7) (Me-$E_1$); 1,4-pentanediol, 2,4-dimethyl-(C7) $PO_1$; 1,4-pentanediol, 2,4-dimethyl-(C7) n-$BO_{2-4}$; 1,4-pentanediol, 2-methyl-(C6) (Me-$E_{1-6}$); 1,4-pentanediol, 2-methyl-(C6) $PO_{2-3}$; 1,4-pentanediol, 2-methyl-(C6) $BO_1$; 1,4-pentanediol, 3,3-dimethyl-(C7) (Me-$E_1$); 1,4-pentanediol, 3,3-dimethyl-(C7) $PO_1$; 1,4-pentanediol, 3,3-dimethyl-(C7) n-$BO_{2-4}$; 1,4-pentanediol, 3,4-dimethyl-(C7) (Me-$E_1$); 1,4-pentanediol, 3,4-dimethyl-(C7) $PO_1$; 1,4-pentanediol, 3,4-dimethyl-(C7) n-$BO_{2-4}$; 1,4-pentanediol, 3-methyl-(C6) 2(Me-$E_{1-6}$); 1,4-pentanediol, 3-methyl-(C6) $PO_{2-3}$; 1,4-pentanediol, 3-methyl-(C6) $BO_1$; 1,4-pentanediol, 4-methyl-(C6) 2(Me-$E_{1-6}$); 1,4-pentanediol, 4-methyl-(C6) $PO_{2-3}$; 1,4-pentanediol, 4-methyl-(C6) $BO_1$; 1,5-pentanediol, (CS) (Me-$E_{4-10}$); 1,5-pentanediol (CS) 2(Me-$E_1$); 1,5-pentanediol (CS) $PO_3$; 1,5-pentanediol, 2,2-dimethyl-(C7) $E_{1-7}$; 1,5-pentanediol, 2,2-dimethyl-(C7) PO1; 1,5-pentanediol, 2,2-dimethyl-(C7) n-$BO_{1-2}$; 1,5-pentanediol, 2,3-dimethyl-(C7) $E_{1-7}$; 1,5-pentanediol, 2,3-dimethyl-(C7) $PO_1$; 1,5-pentanediol, 2,3-dimethyl-(C7) n-$BO_{1-2}$; 1,5-pentanediol, 2,4-dimethyl-(C7) $E_{1-7}$; 1,5-pentanediol, 2,4-dimethyl-(C7) $PO_1$; 1,5-pentanediol, 2,4-dimethyl-(C7) n-$BO_{1-2}$; 1,5-pentanediol, 2-ethyl-(C7) $E_{1-5}$; 1,5-pentanediol, 2-ethyl-(C7) n-$BO_{1-2}$; 1,5-pentanediol, 2-methyl-(C6) (Me-$E_{1-4}$); 1,5-pentanediol, 2-methyl-(C6) $PO_2$; 1,5-pentanediol, 3,3-dimethyl-(C7) $E_{1-7}$; 1,5-pentanediol, 3,3-dimethyl-(C7) $PO_1$; 1,5-pentanediol, 3,3-dimethyl-(C7) n-$BO_{1-2}$; 1,5-pentanediol, 3-methyl-(C6) (Me-$E_{1-4}$); 1,5-pentanediol, 3-methyl-(C6) $PO_2$; 2,3-pentanediol, (CS) (Me-$E_{1-3}$); 2,3-pentanediol, (CS) $PO_2$; 2,3-pentanediol, 2-methyl-(C6) $E_{1-7}$; 2,3-pentanediol, 2-methyl-(C6) $PO_1$; 2,3-pentanediol, 2-methyl-(C6) n-$BO_{1-2}$; 2,3-pentanediol, 3-methyl-(C6) $E_{1-7}$; 2,3-pentanediol, 3-methyl-(C6) $PO_1$; 2,3-pentanediol, 3-methyl-(C6) n-$BO_{1-2}$; 2,3-pentanediol, 4-methyl-(C6) $E_{1-7}$; 2,3-pentanediol, 4-methyl-(C6) $PO_1$; 2,3-pentanediol, 4-methyl-(C6) n-$BO_{1-2}$; 2,4-pentanediol, (CS) 2(Me-$E_{1-4}$); 2,4-pentanediol (CS) $PO_4$; 2,4-pentanediol, 2,3-dimethyl-(C7) (Me-$E_{1-4}$); 2,4-pentanediol, 2,3-dimethyl-(C7) $PO_2$; 2,4-pentanediol, 2,4-dimethyl-(C7) (Me-$E_{1-4}$); 2,4-pentanediol, 2,4-dimethyl-(C7) $PO_2$; 2,4-pentanediol, 2-methyl-(C7) (Me-$E_{5-10}$); 2,4-pentanediol, 2-methyl-(C7) $PO_3$; 2,4-pentanediol, 3,3-dimethyl-(C7) (Me-$E_{1-4}$); 2,4-pentanediol, 3,3-dimethyl-(C7) P02; 2,4-pentanediol, 3-methyl-(C6) (Me-$E_{5-10}$); 2,4-pentanediol, 3-methyl-(C6) $PO_3$;

4. 1,3-hexanediol (C6) (Me-$E_{1-5}$); 1,3-hexanediol (C6) $PO_2$; 1,3-hexanediol (C6) $BO_1$; 1,3-hexanediol, 2-methyl-(C7) $E_{2-9}$; 1,3-hexanediol, 2-methyl-(C7) $PO_1$; 1,3-hexanediol, 2-methyl-(C7) n-$BO_{1-3}$; 1,3-hexanediol, 2-methyl-(C7) $BO_1$; 1,3-hexanediol, 3-methyl-(C7) $E_{2-9}$; 1,3-hexanediol, 3-methyl-(C7) $PO_1$; 1,3-hexanediol, 3-methyl-(C7) n-$BO_{1-3}$; 1,3-hexanediol, 4-methyl-(C7) $E_{2-9}$; 1,3-hexanediol, 4-methyl-(C7) $PO_1$; 1,3-hexanediol, 4-methyl-(C7) n-$BO_{1-3}$; 1,3-hexanediol, 5-methyl-(C7) $E_{2-9}$; 1,3-hexanediol, 5-methyl-(C7) $PO_1$; 1,3-hexanediol, 5-methyl-(C7) n-$BO_{1-3}$; 1,4-hexanediol (C6) (Me-$E_{1-5}$); 1,4-hexanediol (C6) $PO_2$; 1,4-hexanediol (C6) $BO_1$; 1,4-hexanediol, 2-methyl-(C7) $E_{2-9}$; 1,4-hexanediol, 2-methyl-(C7) $PO_1$; 1,4-hexanediol, 2-methyl-($C_7$) n-$BO_{1-3}$; 1,4-hexanediol, 3-methyl-(C7) $E_{2-9}$; 1,4-hexanediol, 3-methyl-(C7) $PO_1$; 1,4-hexanediol, 3-methyl-(C7) n-$BO_{1-3}$; 1,4-hexanediol, 4-methyl-(C7) $E_{2-9}$; 1,4-hexanediol, 4-methyl-(C7) $PO_1$; 1,4-hexanediol, 4-methyl-(C7) n-$BO_{1-3}$; 1,4-hexanediol, 5-methyl-(C7) $E_{2-9}$; 1,4-hexanediol, 5-methyl-(C7) $PO_1$; 1,4-hexanediol, 5-methyl-(C7) n-$BO_{1-3}$; 1,5-hexanediol (C6) (Me-$E_{1-5}$); 1,5-hexanediol (C6) $PO_2$; 1,5-hexanediol (C6) $BO_1$; 1,5-hexanediol, 2-methyl-(C7) $E_{2-9}$; 1,5-hexanediol, 2-methyl-(C7) $PO_1$; 1,5-hexanediol, 2-methyl-(C7) n-$BO_{1-3}$; 1,5-hexanediol, 3-methyl-(C7) $E_{2-9}$; 1,5-hexanediol, 3-methyl-(C7) $PO_1$; 1,5-hexanediol, 3-methyl-(C7) n-$BO_{1-3}$; 1,5-hexanediol, 4-methyl-(C7) $E_{2-9}$; 1,5-hexanediol, 4-methyl-(C7) $PO_1$; 1,5-hexanediol, 4-methyl-(C7) n-$BO_{1-3}$; 1,5-hexanediol, 5-methyl-(C7) $E_{2-9}$; 1,5-hexanediol, 5-methyl-(C7) $PO_1$; 1,5-hexanediol, 5-methyl-(C7) n-$BO_{1-3}$; 1,6-hexanediol (C6) (Me-$E_{1-2}$); 1,6-hexanediol (C6) $PO_{1-2}$; 1,6-hexanediol (C6) n-$BO_4$; 1,6-hexanediol, 2-methyl-(C7) $E_{1-5}$; 1,6-hexanediol, 2-methyl-(C7) n-$BO_{1-2}$; 1,6-hexanediol, 3-methyl-(C7) $E_{1-5}$; 1,6-hexanediol, 3-methyl-(C7) n-$BO_{1-2}$; 2,3-hexanediol (C6) $E_{1-5}$; 2,3-hexanediol (C6) n-$BO_1$; 2,3-hexanediol (C6) $BO_1$; 2,4-hexanediol (C6) (Me-E3-8); 2,4-hexanediol (C6) $PO_3$; 2,4-hexanediol, 2-methyl-(C7) (Me-$E_{1-2}$); 2,4-hexanediol 2-methyl-(C7) $PO_{1-2}$; 2,4-hexanediol, 3-methyl-(C7) (Me-$E_{1-2}$); 2,4-hexanediol 3-methyl-(C7) $PO_{1-2}$; 2,4-hexanediol, 4-methyl-(C7) (Me-$E_{1-2}$); 2,4-hexanediol 4-methyl-(C7) $PO_{1-2}$; 2,4-hexanediol, 5-methyl-(C7) (Me-$E_{1-2}$); 2,4-hexanediol 5-methyl-(C7) $PO_{1-2}$; 2,5-hexanediol (C6) (Me-$E_{3-8}$); 2,5-hexanediol (C6) $PO_3$; 2,5-hexanediol, 2-methyl-(C7) (Me-$E_{1-2}$); 2,5-hexanediol 2-methyl-(C7) $PO_{1-2}$; 2,5-hexanediol, 3-methyl-(C7) (Me-$E_{1-2}$); 2,5-hexanediol 3-methyl-(C7) $PO_{1-2}$; 3,4-hexanediol (C6) $EO_{1-5}$; 3,4-hexanediol (C6) n-$BO_1$; 3,4-hexanediol (C6) $BO_1$;

5. 1,3-heptanediol (C7) $E_{1-7}$; 1,3-heptanediol (C7) $PO_1$; 1,3-heptanediol (C7) n-$BO_{1-2}$; 1,4-heptanediol (C7) $E_{1-7}$; 1,4-heptanediol (C7) $PO_1$; 1,4-heptanediol (C7) n-$BO_{1-2}$; 1,5-heptanediol (C7) $E_{1-7}$; 1,5-heptanediol (C7) $PO_1$; 1,5-heptanediol (C7) n-$BO_{1-2}$; 1,6-heptanediol (C7) $E_{1-7}$; 1,6-heptanediol (C7) $PO_1$; 1,6-heptanediol (C7) n-$BO_{1-2}$; 1,7-heptanediol (C7) $E_{1-2}$; 1,7-heptanediol (C7) n-$BO_1$; 2,4-heptanediol (C7) $E_{3-10}$; 2,4-heptanediol (C7) (Me-$E_1$); 2,4-heptanediol (C7) $PO_1$; 2,4-heptanediol (C7) n-$BO_3$; 2,5-heptanediol (C7) $E_{3-10}$; 2,5-heptanediol (C7) (Me-$E_1$); 2,5-heptanediol (C7) $PO_1$; 2,5-heptanediol (C7) n-B03; 2,6-heptanediol (C7) $E_{3-10}$; 2,6-heptanediol (C7) (Me-$E_1$); 2,6-heptanediol (C7) $PO_1$; 2,6-heptanediol (C7) n-$BO_3$; 3,5-heptanediol (C7) $E_{3-10}$; 3,5-heptanediol (C7) (Me-$E_1$); 3,5-heptanediol (C7) $PO_1$; 3,5-heptanediol (C7) n-$BO_3$;

6. 1,3-butanediol, 3-methyl-2-isopropyl-(C8) $PO_1$; 2,4-pentanediol, 2,3,3-trimethyl-(C8) $PO_1$; 1,3-butanediol, 2,2-diethyl-(C8) $E_{2-5}$; 2,4-hexanediol, 2,3-dimethyl-(C8) $E_{2-5}$; 2,4-hexanediol, 2,4-dimethyl-(C8) $E_{2-5}$; 2,4-hexanediol, 2,5-dimethyl-(C8) $E_{2-5}$; 2,4-hexanediol, 3,3-dimethyl-(C8) $E_{2-5}$; 2,4-hexanediol, 3,4-dimethyl-(C8) $E_{2-5}$; 2,4-hexanediol, 3,5-dimethyl-(C8) $E_{2-5}$; 2,4-hexanediol, 4,5-dimethyl-(C8) $E_{2-5}$; 2,4-hexanediol, 5,5-dimethyl-(C8) $E_{2-5}$; 2,5-hexanediol, 2,3-dimethyl-(C8) $E_{2-5}$; 2,5-hexanediol, 2,4-dimethyl-(C8) $E_{2-5}$; 2,5-hexanediol, 2,5-dimethyl-(C8) $E_{2-5}$; 2,5-hexanediol, 3,3-dimethyl-(C8) $E_{2-5}$; 2,5-hexanediol, 3,4-dimethyl-(C8) $E_{2-5}$; 3,5-heptanediol, 3-methyl-(C8) $E_{2-5}$; 1,3-butanediol, 2,2-diethyl-(C8) n-$BO_{1-2}$; 2,4-hexanediol, 2,3-dimethyl-(C8) n-$BO_{1-2}$; 2,4-hexanediol, 2,4-dimethyl-(C8) n-$BO_{1-2}$; 2,4-hexanediol, 2,5-dimethyl-(C8) n-$BO_{1-2}$; 2,4-hexanediol, 3,3-dimethyl-(C8) n-$BO_{1-2}$; 2,4-hexanediol, 3,4-dimethyl-(C8) n-$BO_{1-2}$; 2,4-hexanediol, 3,5-dimethyl-(C8) n-$BO_{1-2}$; 2,4-hexanediol, 4,5-dimethyl-(C8) n-$BO_{1-2}$; 2,4-hexanediol, 5,5-dimethyl-, n-$BO_{1-2}$; 2,5-hexanediol, 2,3-dimethyl-(C8) n-$BO_{1-2}$; 2,5-hexanediol, 2,4-dimethyl-(C8) n-$BO_{1-2}$; 2,5-hexanediol, 2,5-dimethyl-(C8) n-$BO_{1-2}$; 2,5-hexanediol, 3,3-dimethyl-(C8) n-$BO_{1-2}$; 2,5-hexanediol, 3,4-dimethyl-(C8) n-$BO_{1-2}$; 3,5-heptanediol, 3-methyl-(C8) n-$BO_{1-2}$; 1,3-propanediol, 2-(1,2-dimethylpropyl)-(C8) n-$BO_1$; 1,3-butanediol, 2-ethyl-2,3-dimethyl-(C8) n-$BO_1$; 1,3-butanediol, 2-methyl-2-isopropyl-(C8) n-$BO_1$; 1,4-butanediol, 3-methyl-2-isopropyl-(C8) n-$BO_1$; 1,3-pentanediol, 2,2,3-trimethyl-(C8) n-$BO_1$; 1,3-pentanediol, 2,2,4-trimethyl-(C8) n-$BO_1$; 1,3-pentanediol, 2,4,4-trimethyl-(C8) n-$BO_1$; 1,3-pentanediol, 3,4,4-trimethyl-(C8) n-$BO_1$; 1,4-pentanediol, 2,2,3-trimethyl-(C8) n-$BO_1$; 1,4-pentanediol, 2,2,4-trimethyl-(C8) n-$BO_1$; 1,4-pentanediol, 2,3,3-trimethyl-(C8) n-$BO_1$; 1,4-pentanediol, 2,3,4-trimethyl-(C8) n-$BO_1$; 1,4-pentanediol, 3,3,4-trimethyl-(C8) n-$BO_1$; 2,4-pentanediol, 2,3,4-trimethyl-(C8) n-$BO_1$; 2,4-hexanediol, 4-ethyl-(C8) n-$BO_1$; 2,4-heptanediol, 2-methyl-(C8) n-$BO_1$; 2,4-heptanediol, 3-methyl-(C8) n-$BO_1$; 2,4-heptanediol, 4-methyl-(C8) n-$BO_1$; 2,4-heptanediol, 5-methyl-(C8) n-$BO_1$; 2,4-heptanediol, 6-methyl-(C8) n-$BO_1$; 2,5-heptanediol, 2-methyl-(C8) n-$BO_1$; 2,5-heptanediol, 3-methyl-(C8) n-$BO_1$; 2,5-heptanediol, 4-methyl-(C8) n-$BO_1$; 2,5-heptanediol, 5-methyl-(C8) n-$BO_1$; 2,5-heptanediol, 6-methyl-(C8) n-$BO_1$; 2,6-heptanediol, 2-methyl-(C8) n-$BO_1$; 2,6-heptanediol, 3-methyl-(C8) n-$BO_1$; 2,6-heptanediol, 4-methyl-(C8) n-$BO_1$; 3,5-heptanediol, 2-methyl-(C8) n-$BO_1$; 1,3-propanediol, 2-(1,2-dimethylpropyl)-(C8) $E_{1-3}$; 1,3-butanediol, 2-ethyl-2,3-dimethyl-(C8) $E_{1-3}$; 1,3-butanediol, 2-methyl-2-isopropyl-(C8) $E_{1-3}$; 1,4-butanediol, 3-methyl-2-isopropyl-(C8) $E_{1-3}$; 1,3-pentanediol, 2,2,3-trimethyl-(C8) $E_{1-3}$; 1,3-pentanediol, 2,2,4-trimethyl-(C8) $E_{1-3}$; 1,3-pentanediol, 2,4,4-trimethyl-(C8) $E_{1-3}$; 1,3-pentanediol, 3,4,4-trimethyl-(C8) $E_{1-3}$; 1,4-pentanediol, 2,2,3-trimethyl-(C8) $E_{1-3}$; 1,4-pentanediol, 2,2,4-trimethyl-(C8) $E_{1-3}$; 1,4-pentanediol, 2,3,3-trimethyl-(C8) $E_{1-3}$; 1,4-pentanediol, 2,3,4-trimethyl-(C8) $E_{1-3}$; 1,4-pentanediol, 3,3,4-trimethyl-(C8) $E_{1-3}$; 2,4-pentanediol, 2,3,4-trimethyl-(C8) $E_{1-3}$; 2,4-hexanediol, 4-ethyl-(C8) $E_{1-3}$; 2,4-heptanediol, 2-methyl-(C8) $E_{1-3}$; 2,4-heptanediol, 3-methyl-(C8) $E_{1-3}$; 2,4-heptanediol, 4-methyl-(C8) $E_{1-3}$; 2,4-heptanediol, 5-methyl-(C8) $E_{1-3}$; 2,4-heptanediol, 6-methyl-(C8) $E_{1-3}$; 2,5-heptanediol, 2-methyl-(C8) $E_{1-3}$; 2,5-heptanediol, 3-methyl-(C8) $E_{1-3}$; 2,5-heptanediol, 4-methyl-(C8) $E_{1-3}$; 2,5-heptanediol, 5-methyl-(C8) $E_{1-3}$; 2,5-heptanediol, 6-methyl-(C8) $E_{1-3}$; 2,6-heptanediol, 2-methyl-(C8) $E_{1-3}$; 2,6-heptanediol, 3-methyl-(C8) $E_{1-3}$; 2,6-heptanediol, 4-methyl-(C8) $E_{1-3}$; and/or 3,5-heptanediol, 2-methyl-(C8) $E_{1-3}$; and 7. mixtures thereof;

IX. aromatic diols including: 1-phenyl-1,2-ethanediol; 1-phenyl-1,2-propanediol; 2-phenyl-1,2-propanediol; 3-phenyl-1,2-propanediol; 1-(3-methylphenyl)-1,3-propanediol; 1-(4-methylphenyl)-1,3-propanediol; 2-methyl-1-phenyl-1,3-propanediol; 1-phenyl-1,3-butanediol; 3-phenyl-1,3-butanediol; 1-phenyl-1,4-butanediol; 2-phenyl-1,4-butanediol; and/or 1-phenyl-2,3-butanediol;

X. principal solvents which are homologs, or analogs, of the above structures where one, or more, $CH_2$ groups are added while, for each $CH_2$ group added, two hydrogen atoms are removed from adjacent carbon atoms in the molecule to form one carbon-carbon double bond, thus holding the number of hydrogen atoms in the molecule constant, including the following:

1,3-Propanediol, 2,2-di-2-propenyl-; 1,3-Propanediol, 2-(i-pentenyl)-; 1,3-Propanediol, 2-(2-methyl-2-propenyl)-2-(2-propenyl)-; 1,3-Propanediol, 2-(3-methyl-1-butenyl)-; 1,3-Propanediol, 2-(4-pentenyl)-; 1,3-Propanediol, 2-ethyl-2-(2-methyl-2-propenyl)-; 1,3-Propanediol, 2-ethyl-2-(2-propenyl)-; 1,3-Propanediol, 2-methyl-2-(3-methyl-3-butenyl)-; 1,3-Butanediol, 2,2-diallyl-; 1,3-Butanediol, 2-(1-ethyl-1-propenyl)-; 1,3-Butanediol, 2-(2-butenyl)-2-methyl-; 1,3-Butanediol, 2-(3-methyl-2-butenyl)-; 1,3-Butanediol, 2-ethyl-2-(2-propenyl)-; 1,3-Butanediol, 2-methyl-2-(1-methyl-2-propenyl)-; 1,4-Butanediol, 2,3-bis(1-methylethylidene)-; 1,4-Butanediol, 2-(3-methyl-2-butenyl)-3-methylene-; 2-Butene-1,4-diol, 2-(1,1-dimethylpropyl)-; 2-Butene-1,4-diol, 2-(1-methylpropyl)-; 2-Butene-1,4-diol, 2-butyl-; 1,3-Pentanediol, 2-ethenyl-3-ethyl-; 1,3-Pentanediol, 2-ethenyl-4,4-dimethyl-; 1,4-Pentanediol, 3-methyl-2-(2-propenyl)-; 1,5-Pentanediol, 2-(1-propenyl)-; 1,5-Pentanediol, 2-(2-propenyl)-; 1,5-Pentanediol, 2-ethylidene-3-methyl-; 1,5-Pentanediol, 2-propylidene-; 2,4-Pentanediol, 3-ethylidene-2,4-dimethyl-; 4-Pentene-1,3-diol, 2-(1,1-dimethylethyl)-; 4-Pentene-1,3-diol, 2-ethyl-2,3-dimethyl-; 1,4-Hexanediol, 4-ethyl-2-methylene-; 1,5-Hexadiene-3,4-diol, 2,3,5-trimethyl-; 1,5-Hexadiene-3,4-diol, 5-ethyl-3-methyl-; 1,5-Hexanediol, 2-(1-methylethenyl)-; 1,6-Hexanediol, 2-ethenyl-; 1-Hexene-3,4-diol, 5,5-dimethyl-; 1-Hexene-3,4-diol, 5,5-dimethyl-; 2-Hexene-1,5-diol, 4-ethenyl-2,5-dimethyl-; 3-Hexene-1,6-diol, 2-ethenyl-2,5-dimethyl-; 3-Hexene-1,6-diol, 2-ethyl-; 3-Hexene-1,6-diol, 3,4-dimethyl-; 4-Hexene-2,3-diol, 2,5-dimethyl-; 4-Hexene-2,3-diol, 3,4-dimethyl-; 5-Hexene-1,3-diol, 3-(2-propenyl)-; 5-Hexene-2,3-diol, 2,3-dimethyl-; 5-Hexene-2,3-diol, 3,4-dimethyl-; 5-Hexene-2,3-diol, 3,5-dimethyl-; 5-Hexene-2,4-diol, 3-ethenyl-2,5-dimethyl-; 1,4-Heptanediol, 6-methyl-5-methylene-; 1,5-Heptadiene-3,4-diol, 2,3-dimethyl-; 1,5-Heptadiene-3,4-diol, 2,5-dimethyl-; 1,5-Heptadiene-3,4-diol, 3,5-dimethyl-; 1,7-Heptanediol, 2,6-bis(methylene)-; 1,7-Heptanediol, 4-methylene-; 1-Heptene-3,5-diol, 2,4-dimethyl-; 1-Heptene-3,5-diol, 2,6-dimethyl-; 1-Heptene-3,5-diol, 3-ethenyl-5-methyl; 1-Heptene-3,5-diol, 6,6-dimethyl-; 2,4-Heptadiene-2,6-diol, 4,6-dimethyl-; 2,5-Heptadiene-1,7-diol, 4,4-dimethyl-; 2,6-Heptadiene-1,4-diol, 2,5,5-trimethyl-; 2-Heptene-1,4-diol, 5,6-dimethyl-; 2-Heptene-1,5-diol, 5-ethyl-; 2-Heptene-1,7-diol, 2-methyl-; 3-Heptene-1,5-diol, 4,6-dimethyl-; 3-Heptene-1,7-diol, 3-methyl-6-methylene-; 3-Heptene-2,5-diol, 2,4-dimethyl-; 3-Heptene-2,5-diol, 2,5-dimethyl-; 3-Heptene-2,6-diol, 2,6-dimethyl-; 3-Heptene-2,6-diol, 4,6-dimethyl-; 5-Heptene-1,3-diol, 2,4-dimethyl-; 5-Heptene-1,3-diol, 3,6-dimethyl-; 5-Heptene-1,4-diol, 2,6-dimethyl-; 5-Heptene-1,4-diol, 3,6-dimethyl-; 5-Heptene-2,4-diol, 2,3-dimethyl-; 6-Heptene-1,3-diol, 2,2-dimethyl-; 6-Heptene-1,4-diol, 4-(2-propenyl)-; 6-Heptene-1,4-diol, 5,6-dimethyl-; 6-Heptene-1,5-diol, 2,4-dimethyl-; 6-Heptene-1,5-diol, 2-ethylidene-6-methyl-; 6-Heptene-2,4-diol, 4-(2-propenyl)-; 6-Heptene-2,4-diol, 5,5-dimethyl-; 6-Heptene-2,5-diol, 4,6-dimethyl-; 6-Heptene-2,5-diol, 5-ethenyl-4-methyl-; 1,3-Octanediol, 2-methylene-; 1,6-Octadiene-3,5-diol, 2,6-dimethyl-; 1,6-Octadiene-3,5-diol, 3,7-dimethyl-; 1,7-Octadiene-3,6-diol, 2,6-dimethyl-; 1,7-Octadiene-3,6-diol, 2,7-dimethyl-; 1,7-Octadiene-3,6-diol, 3,6-dimethyl-; 1-Octene-3,6-diol, 3-ethenyl-; 2,4,6-Octatriene-1,8-diol, 2,7-dimethyl-; 2,4-Octadiene-1,7-diol, 3,7-dimethyl-; 2,5-Octadiene-1,7-diol, 2,6-dimethyl-; 2,5-Octadiene-1,7-diol, 3,7-dimethyl-; 2,6-Octadiene-1,4-diol, 3,7-dimethyl-(Rosiridol); 2,6-Octadiene-1,8-diol, 2-methyl-; 2,7-Octadiene-1,4-diol, 3,7-dimethyl-; 2,7-Octadiene-1 ,5-diol, 2,6-dimethyl-; 2,7-Octadiene-1 ,6-diol, 2,6-dimethyl-(8-Hydroxylinalool); 2,7-Octadiene-1,6-diol, 2,7-dimethyl-; 2-Octene-1,4-diol; 2-Octene-1,7-diol; 2-Octene-1,7-diol, 2-methyl-6-methylene-; 3,5-Octadiene-1,7-diol, 3,7-dimethyl-; 3,5-Octadiene-2,7-diol, 2,7-dimethyl-; 3,5-Octanediol, 4-methylene-; 3,7-Octadiene-1,6-diol, 2,6-dimethyl-; 3,7-Octadiene-2,5-diol, 2,7-dimethyl-; 3,7-Octadiene-2,6-diol, 2,6-dimethyl-; 3-Octene-1,5-diol, 4-methyl-; 3-Octene-1,5-diol, 5-methyl-; 4,6-Octadiene-1,3-diol, 2,2-dimethyl-; 4,7-Octadiene-2,3-diol, 2,6-dimethyl-; 4,7-Octadiene-2,6-diol, 2,6-dimethyl-; 4-Octene-1,6-diol, 7-methyl-; 2,7-bis(methylene)-; 2-methylene-; 5,7-Octadiene-1,4-diol, 2,7-dimethyl-; 5,7-Octadiene-1,4-diol, 7-methyl-; 5-Octene-1,3-diol; 6-Octene-1,3-diol, 7-methyl-; 6-Octene-1,4-diol, 7-methyl-; 6-Octene-1,5-diol; 6-Octene-1,5-diol, 7-methyl-; 6-Octene-3,5-diol, 2-methyl-; 6-Octene-3,5-diol, 4-methyl-; 7-Octene-1,3-diol, 2-methyl-;

7-Octene-1,3-diol, 4-methyl-; 7-Octene-1,3-diol, 7-methyl-; 7-Octene-1,5-diol; 7-Octene-1,6-diol; 7-Octene-1,6-diol, 5-methyl-; 7-Octene-2,4-diol, 2-methyl-6-methylene-; 7-Octene-2,5-diol, 7-methyl-; 7-Octene-3,5-diol, 2-methyl-; 1-Nonene-3,5-diol; 1-Nonene-3,7-diol; 3-Nonene-2,5-diol; 4,6-Nonadiene-1,3-diol, 8-methyl-; 4-Nonene-2,8-diol; 6,8-Nonadiene-1,5-diol; 7-Nonene-2,4-diol; 8-Nonene-2,4-diol; 8-Nonene-2,5-diol; 1,9-Decadiene-3,8-diol; and/or 1,9-Decadiene-4,6-diol; and XI. mixtures thereof.

The principal solvents are desirably kept to the lowest levels that are feasible in the present compositions for obtaining translucency or clarity. The presence of water exerts an important effect on the need for the principal solvents to achieve clarity of these compositions. The higher the water content, the higher the principal solvent level (relative to the softener level) is needed to attain product clarity. Inversely, the less the water content, the less principal solvent (relative to the softener) is needed. Thus, at low water levels of from about 5% to about 15%, the oftener active-to-principal solvent weight ratio is preferably from about 55:45 to about 85:15, more preferably from about 60:40 to about 80:20. At water levels of from about 15% to about 70%, the softener active-to-principal solvent weight ratio is preferably from about 45:55 to about 70:30, more preferably from about 55:45 to about 70:30. But at high water levels of from about 70% to about 80%, the softener active-to-principal solvent weight ratio is preferably from about 30:70 to about 55:45, more preferably from about 35:65 to about 45:55. At even higher water levels, the softener to principal solvent ratios should also be even higher.

Mixtures of the above principal solvents are particularly preferred, since one of the problems associated with large amounts of solvents is safety. Mixtures decrease the amount of any one material that is present. Odor and flammability can also be minimized by use of mixtures, especially when one of the principal solvents is volatile and/or has an odor, which is more likely for low molecular weight materials. Preferred mixtures are those where the majority of the solvent is one, or more, that are within the ClogP range identified hereinbefore as most preferred. The use of mixtures of solvents is also preferred, especially when one, or more, of the preferred principal solvents are solid at room temperature. In this case, the mixtures are fluid, or have lower melting points, thus improving processability of the softener compositions.

It is also discovered that it is possible, and desirable, to substitute for part of a principal solvent or a mixture of principal solvents of this invention with a secondary solvent, or a mixture of secondary solvents, which by themselves are not operable as a principal solvent of this invention, as long as an effective amount of the operable principal solvent(s) of this invention is still present in the liquid concentrated, clear fabric softener composition. An effective amount of the principal solvent(s) of this invention is at least greater than about 5%, preferably more than about 7%, more preferably more than about 10% of the composition, when at least about 15% of the softener active is also present. The substitute solvent(s) can be used at any level, but preferably about equal to, or less than, the amount of operable principal solvent, as defined hereinbefore, that is present in the fabric softener composition.

For example, even though 1,4-cyclohexanedimethanol, 1,2-pentanediol, 1,3-octanediol, and hydroxy pivalyl hydroxy pivalate (HPHP) having the following formula $HO—CH_2—C(CH_3)_2—CH_2—O—CO—C(CH_3)_2—CH_2—OH$, are inoperable solvents according to this invention, mixtures of these solvents with the principal solvent, e.g., with 2,2,4-trimethyl-1,3-pentanediol, also provide liquid concentrated, clear fabric softener compositions. 1,4-Cyclohexanedimethanol is desirable since it has a low odor. The principal advantage of the principal solvent is that it provides the maximum advantage for a given weight of solvent. It is understood that "solvent", as used herein, refers to the effect of the principal solvent and not to its physical form at a given temperature, since some of the principal solvents are solids at ambient temperature.

The optional water soluble organic solvents have been described above. The clear compositions can also contain the perfume and stabilizer systems described above and all of the compositions can contain the following optional components.

Some of the clear compositions appear to create dilute dispersions of fabric softener that exhibit a more unilamellar appearance than conventional fabric softener compositions. The closer to unilamellar the appearance, the better the compositions seem to perform.

V. ADDITIONAL COLOR PROTECTANT ADDITIVES

A. Chlorine scavengers

Chlorine scavengers are actives that react with chlorine, or with chlorine-generating materials, such as hypochlorite, to eliminate or reduce the bleaching activity of the chlorine materials. For the dryer-added fabric softener compositions, it is suitable to incorporate enough chlorine scavenger to neutralize at least about 1 ppm (art per million) chlorine in the next wash water, preferably to neutralize about 2 ppm chlorine, and even more preferably to neutralize about 3 ppm in wash water. For rinse-added fabric softeners, it is suitable to incorporate enough chlorine scavenger to neutralize about 1 ppm, preferably 2 ppm, more preferably 3 ppm, and even more preferably 10 ppm of chlorine in rinse water.

Chlorine is used in many parts of the world to sanitize water. To make sure that the water is safe, a small amount, typically about 1 to 2 ppm of chlorine is left in the water. It has been found that this small amount of chlorine in the tap water can cause fading of some fabric dyes. Incorporation of a chlorine scavenger in a dryer-added fabric softener product can provide a benefit by placing the chlorine scavenger at a point where it can intercept the chlorine in the wash water of the following wash cycle, especially when the chlorine scavenger is highly water soluble, e.g., an ammonium salt as disclosed hereinafter. Also, if the detergent composition does not contain a chlorine scavenger, or if it is slow to dissolve, the chorine scavenger applied in the dryer will provide protection. The chlorine scavenger herein can be used as part of any prior dryer-added fabric softener composition. Better distribution provides better protection by spreading the chlorine scavenger over the fabric more evenly. The chlorine scavenger in the rinse-added compositions neutralizes the chlorine in the rinse water where there is no other product added.

Where any ingredient herein can be classified in more than one place, it should be classified in the place where it can first be mentioned. Typically, the dryer-added softener compositions should provide enough chlorine scavenger to react with about 0.1 ppm to about 40 ppm, preferably from about 0.2 ppm to about 20 ppm, and more preferably from about 0.3 ppm to about 10 ppm of chlorine present in an average wash liquor. Suitable levels of optional chlorine scavengers in the dryer-added softener composition of the present invention range from about 0.1% to about 25%, preferably from about 0.5% to about 15%, most preferably from about 1% to about 8%. If both the cation and the anion of the scavenger react with chlorine, which is desirable, the level is adjusted to react with an equivalent amount of available chlorine. Suitable levels of the optional chlorine scavengers in the liquid softener composition of the present invention range from about 0.01% to about 10%, preferably from about 0.02% to about 5%, more preferably from about 0.05% to about 4%.

The fabric softener compositions, and especially the preferred compositions herein, can contain an effective amount of chlorine scavenger, preferably selected from the group consisting of:

a. amines and their salts;

b. ammonium salts;

c. amino acids and their salts;

d. polyamino acids and their salts;

e. polyethyleneimines and their salts;

f. polyamines and their salts;

g. polyamineamides and their salts;

h. polyacrylamides; and i. mixtures thereof

Non-limiting examples of chlorine scavengers include amines, preferably primary and secondary amines, including primary and secondary fatty amines, and alkanolamines; and their salts; ammonium salts, e.g., chloride, bromide, citrate, sulfate; amine-functional polymers and their salts; amino acid homopolymers with amino groups and their salts, such as polyarginine, polylysine, polyhistidine; amino acid copolymers with amino groups and their salts, including 1,5-di-ammonium-2-methyl-panthene dichloride and lysine monohydrochloride; amino acids and their salts, preferably those having more than one amino group per molecule, such as arginine, histidine, and lysine, reducing anions such as sulfite, bisulfite, thiosulfate, and nitrite, antioxidants such as ascorbate, carbamate, phenols; and mixtures thereof.

Preferred chlorine scavengers are water soluble, especially, low molecular weight primary and secondary amines of low volatility, e.g., monoethanolamine, diethanolamine, tris(hydroxymethyl)aminomethane, hexamethylenetetramine, and their salts, and mixtures thereof. Suitable chlorine scavenger polymers include: water soluble amine-functional polymers, e.g., polyethyleneimines, polyamines, polyamineamides, polyacrylamides, and their salts, and mixtures thereof. The preferred polymers are polyethyleneimines, the polyamines, including di(higher alkyl)cyclic amines and their condensation products, polyamineamides, and their salts, and mixtures thereof. Preferred polymers for use in the fabric softening compositions of the present invention are polyethyleneimines and their salts. Preferred polyethyleneimines have a molecular weight of less than about 2000, more preferably from about 200 to about 1500. The water solubility is preferably at least about 1 g/100 g water, more preferably at least about 3 g/100 g water, even more preferably at least about 5 g/100 g water.

Some polyamines with the general formula $(R^1)_2N(CX_2)_nN(R^2)_2$ can serve both as a chlorine scavenger and a "chelant" color care agent. Non-limiting examples of such preferred polyamines are N,N,N',N'-tetrakis(2-hydroxypropyl) ethylenediamine and N,N,N',N",N"-penta (2-hydroxypropyl)diethylenetriamine. Other suitable dual agents of this type are disclosed herein after in the Chelants section.

Chlorine scavengers for use in the solid dryer-added fabric softener compositions preferably are solid, e.g., water soluble amines, amine salts, and/or polymers. It is preferred that the chlorine scavenging amine-functional materials be neutralized by an acid, before they are added into the compositions. This neutralization actually converts the amines into ammonium salts. In the salt form, even simple amines and ammonia ($NH_3$) can be used. Preferred salts of this kind are the ammonium salts such as $NH_4Cl$, $(NH_4)_2SO_4$, and the like. Preferred polymeric chlorine scavengers have an average molecular weight of less than about 5,000, more preferably from about 200 to about 2,000, even more preferably from about 200 to about 1,000. Low molecular weight polymers are easier to remove from fabrics, resulting in less buildup of the chlorine scavenger and therefore less discoloration of the fabrics. The above chlorine scavenger are also suitable for use in liquid softener compositions of this invention. Liquid chlorine scavengers can be used in liquid softener compositions, but amine-functional chlorine scavengers are preferably neutralized by an acid, before they are added into the compositions.

Many of the preferred chlorine scavengers are at least fairly water soluble. When these chlorine scavenger actives are present in the compositions of the present invention, the softener composition's dissolution rate criterion (as defined herein before) is determined with the composition not containing the chlorine scavengers.

The fabric conditioning composition for use with the chlorine scavengers can be any of those known in the art and/or previously disclosed by others in patent applications. Compositions that are suitable are disclosed both hereinbefore, and in U.S. Pat. No. : 3,944,694, McQueary; U.S. Pat. No. 4,073,996, Bedenk et al.; U.S. Pat. No. 4,237,155, Kardouche; U.S. Pat. No. 4,711,730, Gosselink et al.; U.S. Pat. No. 4,749,596, Evans et al.; U.S. Pat. No. 4,808,086, Evans et al.; U.S. Pat. No. 4,818,569, Trinh et al.; U.S. Pat. No. 4,877,896, Maldonado et al.; U.S. Pat. No. 4,976,879, Maldonado et al.; U.S. Pat. No. 5,041,230, Borcher, Sr. et al.; U.S. Pat. No. 5,094,761, Trinh et al.; U.S. Pat. No. 5,102,564, Gardlik et al.; and U.S. Pat. No. 5,234,610, Gardlik et al., all of said patents being incorporated herein by reference.

B. Dye Transfer Inhibitors

Dye transfer inhibitors (DTI), such as polyvinyl pyrrolidone (PVP), appear to solubilize into the rinse and/or wash water to scavenge the free dye molecules, thus suspending the dyes and preventing them from redepositing onto fabrics.

DTI may interact with some detergent actives. It is therefore advantageous to provide DTI by adding them to a dryer-added fabric softener composition to place them on the fabric near the dyes, thus minimizing the interaction with surfactants. DTIs can also be of use in rinse-added fabric softeners as disclosed in P&G Case 4768C.

The composition of the present invention optionally, but preferably, contains an effective amount of polymeric dye transfer inhibiting agent (dye transfer inhibitor or DTI). An effective amount is typically an amount of DTI which will provide at least about 0.1 ppm, preferably from about 0.1 ppm to about 100 ppm, more preferably from about 0.2 ppm to about 20 ppm, in the subsequent wash or rinse liquor. Preferably, the dryer-added compositions contain from about 0.1% to about 25% of dye transfer inhibitor, more preferably from about 0.5% to about 15%, and even more preferably from about 1% to about 10% for normal dryer-added fabric softener compositions. Rinse-added softener compositions of this invention optionally contain from about 0.03% to about 25%, preferably from about 0.1% to about 15%, more preferably from about 0.3% to about 10%, of water-soluble polymeric dye transfer inhibitor.

Suitable polymer DTIs are disclosed in WO 94/11482, published May 26 1994, which is the same as copending, U.S. patent application of Trinh et al., Ser. No. 08/209,694, filed Mar. 10, 1994, for FABRIC SOFTENING COMPOSITIONS WITH DYE TRANSFER INHIBITORS FOR IMPROVED FABRIC APPEARANCE (P&G Case 4768C), said application having been indicated as allowable.

As disclosed in said application, dye transfer inhibitors useful in the present invention include water-soluble polymers containing nitrogen and oxygen atoms, selected from the group consisting of:

(1) polymers, which preferably are not enzymes, with one or more monomeric units containing at least one ═N—C(═O)-group;

(2) polymers with one or more monomeric units containing at least one N-oxide group;

(3) polymers containing both ═N—C(═O)-and N-oxide groups of (A) and (B); and (4) mixtures thereof;

wherein the nitrogen of the ═N—C(═O)-group can be bonded to either one or two other atoms (i.e., can have two single bonds or one double bond).

Dye transfer inhibitors useful in the present invention include water-soluble polymers having the structure:

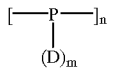

wherein each P is selected from homopolymerizable and copolymerizable moieties which attach to form the polymer backbone, preferably each P being selected from the group consisting of:

vinyl moieties, e.g., [—$C(R)_2$—$C(R)_2$—]; other monomeric moieties, e.g., —[[$C(R)_2$]$_x$—L—], wherein each x is an integer from 1 to 6 and each L is independently selected from the group consisting of:

—N(R)—; —O—; —S—; —O—(O)C—; —C(O)—O—; —S(→O)—; —S(→O)$_2$—; —S(O)—O—; —O—(O)S—; —O—S(O)$_2$—O—;

—O—[Si($R_2$)—O]$_p$—; —C(O)—; and —O—C(O)—O—; and DTI-active groups —N(→O)(R)—; —N(R)C(O)—; —C(O)—N(R)—.

wherein each R is H, C1 $_{12}$ (preferably $C_{1-4}$) alkyl(ene), $C_6$–$C_{12}$ aryl(ene) and/or D, m is from 0 to 2, and p is from 1 to about 6;

wherein each D contains moieties selected from the group consisting of: L moieties; structural moieties selected from the group consisting of linear and cyclic $C_{1-12}$ (preferably $C_{1-4}$) alkyl; $C_{1-12}$ alkylene; $C_{1-12}$ heterocyclic groups, which can also contain the DTI active groups; aromatic $C_{6-12}$ groups; and Rs to complete the group, wherein any linking groups which are attached to each other form linkages that are substantially stable under conditions of use; and wherein the nitrogen atoms can be attached to one, two, or three other atoms, the number of ═N—C(O)— and/or ≡N→O groups present being sufficient to provide dye transfer inhibition, the total molecular weight being from about 500 to about 1,000,000, preferably from about 1,000 to about 500,000, n being selected to provide the indicated molecular weight, and the water solubility being at least about 100 ppm, preferably at least about 300 ppm, and more preferably at least about 1,000 ppm in water at ambient temperature of about 25° C.

(1). Polymers with Active ═N—C(═O)— Groups

The most common polymer of this type is polyvinyl pyrrolidone (PVP). PVP is available from ISP, Wayne, N.J., and BASF Corp., Parsippany, N.J., as a powder or aqueous solutions in several viscosity grades, designated as, e.g., K-12, K-15, K-25, and K-30. These K-values indicate the viscosity average molecular weight, as follows: PVP Viscosity Avg. Mol. Wt.=2,500 (K-12); 10,000 (K-15) ; 24,000 (K-25) ; and 40,000 T-30). PVP K-12, K-15, and K-30 are also available from Polysciences, Inc. Warrington, Pa., and PVP K-15, K-25, and K-30 and poly(2-ethyl-2-oxazoline) are available from Aldrich Chemical Co., Inc., Milwaukee, Wis.

The average molecular weight for water-soluble polymers with ═N—C(═O)— groups useful in the present invention is from about 500 to about 100,000, preferably from about 500 to about 40,000, and more preferably from about 1,000 to about 30,000.

(2) Polymers with Active N-Oxide Groups

Another useful group of polymeric DTI include water-soluble polymers containing active ≡N→O groups. The nitrogen of the ≡N→O group can be bonded to either one, two, or three other atoms.

One or more of the ≡N→O groups can be part of the pendant D group or one or more ≡N→O groups can be part of the polymerizable P unit or a combination of both.

Where the ≡N→O group is part of the pendant D group, preferred D groups contain cyclic structures with the nitrogen atom of the ≡N→O group being part of the ring or outside the ring. The ring in the D group may be saturated, unsaturated, or aromatic.

Examples of D groups containing the nitrogen atom of the ≡N→O group include N-oxides of heterocyclic compounds such as the N-oxides of pyridine, pyrrole, imidazole, pyrazole, pyrazine, pyrimidine, pyridazine, piperidine, pyrrolidone, azolidine, morpholine, and derivatives thereof. A preferred dye transfer inhibitor is poly(4-vinylpyridine N-oxide) (PVNO). Examples of D groups with the nitrogen atom of the ≡N→O group being outside the ring include aniline oxide and N-substituted aniline oxides.

An example of a polymer wherein the ≡N→O group is part of the monomeric P backbone group is polyethyleneimine N-oxide.

Mixtures of these groups can be present in the polymeric DTIs of (2) and (3).

The amine N-oxide polymers of the present invention typically have a ratio of amine N-oxide to the amine of from about 1:0 to about 1:2. The amount of amine oxide groups present in the polyamine oxide polymer can be varied by appropriate copolymerization or by appropriate degree of N-oxidation. Preferably, the ratio of amine N-oxide to amine is from about 1:0 to about 1:1, most preferred from 1:0 to about 3:1.

The amine oxide unit of the polyamine N-oxides has a PKa of ≦10, preferably PKa≦7, more preferably PKa≦6.

The average molecular weight of (2) useful in the present invention is from about 500 to about 1,000,000; more preferably from about 1,000 to about 500,000; most preferably from about 2,000 to about 100,000.

Any polymer backbone above can be used in (1) or (2) as long as the polymer formed is water soluble and has dye transfer inhibiting properties. Examples of suitable polymeric backbones are polyvinyls, polyalkylenes, polyesters, polyethers, polyamide, polyimides, polyacrylates, and copolymers and block copolymers thereof, and mixtures thereof.

(3). Copolymers Including Active ═N—C(═O)— and/or ═N→O Groups

Effective polymeric DTI agents can include those formed by copolymerizing mixtures of monomeric, oligomeric, and/ or polymeric units containing active ═N—C(═O)— and/or active ≡N→O groups (e.g., copolymers and/or block copolymers of PVP and PVNO). Other suitable DTI copolymers include those in which an effective amount of monomeric, oligomeric, and/or polymeric units containing active ═N—C(═O)— groups and/or active ≡N→O groups is copolymerized with "filler" monomeric, oligomeric, and/or polymeric units which do not contain active ═N—C(═O)— or ≡N→O groups but which impart other desirable properties to the DTI copolymer, such as increased water solubility or enhanced fabric substantivity [e.g., block copolymer of PVP (≧about 60%) and polyvinylimidazole].

Some of the preferred dye transfer inhibitors are fairly water soluble. When these dye transfer inhibitors are present in the compositions of the present invention, the softener composition's dissolution rate criterion (as defined herein before) is determined with the composition not containing the dye transfer inhibitors.

C. Dye Fixatives

Dye fixatives are similar to dye transfer inhibitors, but tend to be more water insoluble. They act primarily by inhibiting removal of the dye rather than intercepting it in the water phase and keeping it suspended like the dye transfer inhibitors.

Suitable dye fixatives are disclosed in U.S. Pat. No. 5,632,781, Shinichi et al., issued May 27, 1997; U.S. Pat. No. 4,583,989, Toshio et al., issued April 22, 1986; U.S. Pat. No. 3,957,574, Edward, issued May 18, 1975; U.S. Pat. No. 3,957,427, Chambers, issued May 18, 1976; and U.S. Pat. No. 3,940,247, Derwin et al., issued Feb. 24, 1976, all of said patents being incorporated by reference.

The dye fixatives are used in at least an effective amount, typically from about 0.1% to about 50%, preferably from about 0.5% to about 30%, more preferably from about 1% to about 10% for dryer-added compositions and from about 0.01% to about 10%, preferably from about 0.03% to about 7%, more preferably from about 0.1% to about 3%, for rinse-added compositions.

D. Chelants

The composition can also comprise from about 0.1% to about 50% of by weight of the composition, preferably from about 0.2% to about 20%, more preferably about 0.5% to about 10%, and most preferably from about 1% to about 7% by weight of the composition for dryer-added compositions and from about 0.01% to about 10%, preferably from about 0.1% to about 8%, more preferably from about 0.5% to about 5%, for rinse-added compositions, of "chelant" color care agent, preferably color care agent having the formula:

$$(R^1)_2N(CX_2)_nN(R^2)_2$$

wherein each X is selected from the group consisting of hydrogen (preferred), linear or branched, substituted or unsubstituted alkyl groups having from 1 to about 10 (preferably 1 or 2) carbons atoms and substituted or unsubstituted aryl having at least 6 carbon atoms (preferably from 6 to about 22), and mixtures thereof; n is an integer from 0 to 6, preferably 2 or 3; each $R^1$ and $R^2$ is independently selected from the group consisting of hydrogen; alkyl; aryl; alkaryl; aralkyl; hydroxyalkyl; polyhydroxyalkyl; $C_{1-10}$, preferably $C_{2-3}$, alkyl groups substituted with one (preferred), or more (preferably 2 or 3) carboxylic acid or phosphonic acid groups, or salts thereof; polyalkylether having the formula $—((CH_2)_yO)_zR^3$ where each $R^3$ is hydrogen (preferred) or a linear, branched, substituted or unsubstituted alkyl chain having from 1 to about 10 (preferably from about 1 to about 4) carbon atoms and where y is an integer from 2 to about 10 (preferably 2 or 3) and z is an integer from 1 to 30 (preferably from 2 to about 5); the group $—C(O)R^4$ where each $R^4$ is selected from the alkyl; alkaryl; aralkyl; hydroxyalkyl; polyhydroxyalkyl, polyalkylether, and alkyl groups substituted with one (preferred), or more (preferably 2 or 3) carboxylic acid or phosphonic acid groups, or salts thereof as defined in $R^1$ and $R^2$; and $—CX_2CX_2N(R^5)_2$ with no more than one of $R^1$ and $R^2$ being $CX_2CX_2N(R^5)_2$ and wherein each $R^5$ is selected from the alkyl; alkaryl; aralkyl; hydroxyalkyl; polyhydroxyalkyl, polyalkylether, and alkyl groups substituted with one (preferred), or more (preferably 2 or 3) carboxylic acid or phosphonic acid groups, or salts thereof as defined in $R^1$ and $R^2$; and one $R^1$ and one $R^2$ can combine to form a cyclic compound.

The available alkyl groups include linear or branched, substituted or unsubstituted alkyl groups typically having from about 1 to about 22 carbon atoms, preferably from about 1 to about 10 carbon atoms. Most preferred alkyl groups include methyl, ethyl, propyl, isopropyl, and mixtures thereof. The available aryl groups include substituted or unsubstituted aryl groups typically having from 6 to about 22 carbon atoms. Substitutions can include alkyl chains as earlier described thereby providing alkaryl or aralkyl groups having from about 6 to about 22 carbon atoms. Preferred aryl, aralkyl and alkaryl groups include phenyl, benzyl and mesityl. The available hydroxyalkyl and polyhydroxyalkyl groups include linear or branched, hydroxy substituted groups typically having from 1 to about 22 carbon atoms. Preferred groups include hydroxymethyl, hydroxyethyl, 1-hydroxypropyl and 2-hydroxypropyl. The available polyalkoxy (polyalkylether) groups include those having the formula: $—((CH_2)_yO)_zR^3$ wherein the integer y typically ranges from 2 to about 10 with 2 and 3 the most preferred; the group $—(CH_2)_y—$ can include both linear and branched chains; preferred groups include ethoxy and isopropoxy groups; the integer z typically ranges from about 1 to about 30 with lower levels of alkoxylation, preferably ethoxylation, being preferred; $R^3$ is typically hydrogen or an alkyl groups having 1 to 5 carbon atoms. The group $—C(O)R^4$ can also be employed where $R^4$ is alkyl; alkaryl; aralkyl; hydroxyalkyl; polyhydroxyalkyl, polyalkylether, carboxylic acid, alkyl dicarboxylic acid, phosphonic acid, alkyl phosphonic acid as defined above, and mixtures thereof.

Remaining $R^1$ and $R^2$ possibilities include linear or branched alkyl carboxylic acid groups and water soluble salts thereof having the general formula $—(CH_p(R^7)_q)_tC(O)O^{(-)}—M^{(+)}$ wherein t is an integer from 1 to about 5, p is an integer from 1 to 3, p+q=2 and $M^{(+)}$ is a water soluble monovalent cation such as hydrogen, alkali metal, etc. As t typically ranges from about 1 to about 5, the total number of carbons typically does not exceed 6 and $M^{(+)}$ is a water soluble cation such as alkali metal or other available groups such as ammonium or substituted ammonium. Also available are dicarboxylic acid groups, including the water soluble salts, which have from about 2 to about 5 carbons atoms, and linear, branched or polyfunctional substituted branched alkyldicarboxylic acids and water soluble salts thereof also having from about 2 to about 5 carbon atoms. Preferred carboxylate chelants include ethylenediaminetetraacetic acid (EDTA), N-hydroxyethylethylenediaminetriacetic acid, nitrilotriacetic acid (NTA), ethylenediamine tetraproprionic acid, ethylenediamine-N,N'-diglutamic acid, 2-hydroxypropylenediamine-N,N'-disuccinic acid, triethylenetetraaminehexaacetic acid, diethylenetriaminepentaacetic acid (DETPA), and ethanoldiglycines, including their water-soluble salts such as the alkali metal, ammonium, and substituted ammonium salts thereof, and mixtures thereof Phosphonic acid chelants and water soluble salts thereof and linear, branched or polyfunctional substituted branched alkylphosphonic acids and water soluble salts thereof can be employed as $R^1$ and $R^2$. In both cases, the number of carbon atoms typically ranges from about 1 to about 5. Preferred groups include ethylenediaminetetrakis (methylenephosphonic acid), diethylenetriamine-N,N,N',N",N"-pentakis(methane phosphonic acid) (DETMP) and 1-hydroxyethane-1,1-diphosphonic acid (HEDP), including their water-soluble salts such as the alkali metal, ammonium, and substituted ammonium salts thereof, and mixtures thereof.

$R^1$ and $R^2$ can also be the group $CX_2CX_2N(R^5)_2$. However, when the group is present, no more than one of $R^1$ and $R^2$ at any one time can be the group $CX_2CX_2N(R^5)_2$. Furthermore, each $R^5$ can be alkyl; alkaryl; aralkyl; hydroxyalkyl; polyhydroxyalkyl, polyalkylether, alkoxy, polyalkoxy alkyl carboxylic acid, alkyl dicarboxylic acid, phosphonic acid and alkyl phosphonic acid as defined above for $R^1$ and $R^2$. Preferably, when any one of $R^1$ and $R^2$ is present as the group $CX_2CX_2N(R^5)_2$, then each $R^5$ is preferably, alkyl or hydroxyalkyl group as defined above. Additionally, either of $R^1$ and of $R^2$ can combine to form a cyclic substituent. Suitable examples include the moiety:

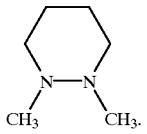

To provide suitable color care properties, the preferred color care chelants according to the present invention consist of at least about 3% by weight of the compound of nitrogen, preferably at least about 7% and more preferably at least about 9% by weight of the compound. The preferred color care chelants according to the present invention have a total number of carbon atoms in the groups $R^1$ and $R^2$ of about 50 or less, more preferably of about 40 or less and more preferably of about 20 or less.

Most preferably, each $R^1$ and $R^2$ is independently selected from the group consisting of hydrogen, linear alkyl groups having from 1 to 5 carbon atoms and linear hydroxyalkyl groups having from I to 5 carbon atoms. Especially preferred are the groups ethyl, methyl, hydroxyethyl, hydroxypropyl, and mixtures thereof. While each of $R^1$ and $R^2$ can be individually selected, the preferred color care component according to the present invention involves the situation wherein each of $R^1$ and $R^2$ is hydroxyalkyl group having from 1 to 5 carbon atoms. A preferred list of chelants includes N,N,N',N'-tetraethylethylenediamine, 2-{[2-(dimethylamino)ethyl]-methylamino}ethanol, bis-(2-hydroxyethyl)N,N'-dimethylethylenediamine, bis(octyl)-N,N'-dimethylethylenediamine, N,N,N'N'-tetrakis(2-hydroxypropyl) ethylenediamine, N,N,N',N",N"-penta(2-hydroxypropyl)diethlyenetriamine, N,N'-diethylethyldiamine, N,N,N'-trimethylethylenediamine, 1,3-pentadiamine, N,N-dimethylethylenediamine, 2-(2-aminoethylamino)ethanol, N,N'-dimethylethylenediamine, 1,3-diamino-2-hydroxypropane, N'-methyl-2,2'-diaminodiethylamine, N-(2-aminoethyl)-1,3-propanediamine. Particularly preferred are N,N,N',N'-tetrakis(2-hydroxypropyl) ethylenediamine and N,N,N',N",N"-penta(2-hydroxypropyl)diethylenetriamine. Such materials are commercially available from a number of sources including BASF of Washington, N.J. under the tradename QUADROL and PENTROL.

These compounds are believed to provide protection as chelants and are preferred. However, other chelants can also be used, so long as they are compatible and can bind with metals that cause hue shifts in fabric dyes. Other suitable chelants are described in the copending allowed U.S. Patent application of Rusche et al., Ser. No. 08/753,167, filed Nov. 25, 1996 for CHELATING AGENTS FOR IMPROVED COLOR FIDELITY said application being incorporated herein by reference.

These chelants (which as used herein also includes materials effective not only for binding metals in solution but also those effective for precipitating metals from solution) include citric acid, citrate salts (e.g., trisodium citrate), isopropyl citrate, 1-hydroxyethylidene-1,1-diphosphonic acid (etidronic acid), available from Monsanto as Dequest RTM 2010, 4,5-dihydroxy-m-benzene-sulfonic acid/sodium salt, available from Kodak as Tiron RTM, diethylenetriaminepentaacetic acid, available from Aldrich, ethylene diaminetetraacetic acid (EDTA), ethylene diamine-N,N'-disuccinic acid (EDDS, preferably the S, S isomer), 8-hydroxyquinoline, sodium dithiocarbamate, sodium tetraphenylboron, ammonium nitrosophenyl hydroxylamine, and mixtures thereof. Most preferred of these chelants are EDTA and especially citric acid and citrate salts.

Chelants can also be used at very low levels, typically from about 0.005% to about 0.02%, in clear, liquid compositions of this invention which contain highly unsaturated softener actives to minimize discoloration and/or odor formation.

E. Brighteners

The premix, and especially the finished dispersion compositions herein can also optionally contain from about 0.005% to 5% by weight of certain types of hydrophilic optical brighteners which also provide a dye transfer inhibition action. If used, the dispersion compositions herein will preferably comprise from about 0.001% to 1% by weight of such optical brighteners.

The hydrophilic optical brighteners useful in the present invention are those having the structural formula:

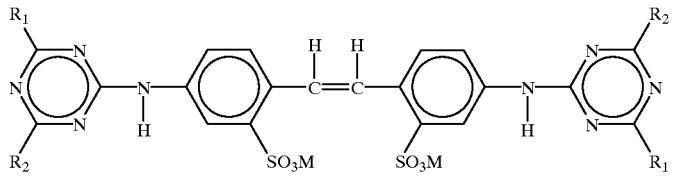

wherein $R_1$ is selected from anilino, N-2-bis-hydroxyethyl and NH-2-hydroxyethyl; $R_2$ is selected from N-2-bis-hydroxyethyl, N-2-hydroxyethyl-N-methylamino, morphilino, chloro and amino; and M is a salt-forming cation such as sodium or potassium.

When in the above formula, $R_1$ is anilino, $R_2$ is N-2-bis-hydroxyethyl and M is a cation such as sodium, the brightener is 4,4',-bis[(4-anilino-6-(N-2-bis-hydroxyethyl)-s-triazine-2-yl)amino]-2,2'-stilbenedisulfonic acid and disodium salt. This particular brightener species is commercially marketed under the tradename Tinopal-UNPA-GX® by Ciba-Geigy Corporation. Tinopal-UNPA-GX is the preferred hydrophilic optical brightener useful in the rinse added dispersion compositions herein.

When in the above formula, $R_1$ is anilino, $R_2$ is N-2-hydroxyethyl-N-2-methylamino and M is a cation such as sodium, the brightener is 4,4'-bis[(4-anilino-6-(N-2-hydroxyethyl-N-methylamino)-s-triazine-2-yl)amino]2,2'-stilbenedisulfonic acid disodium salt. This particular brightener species is commercially marketed under the tradename Tinopal 5BM-GX® by Ciba-Geigy Corporation.

When in the above formula, $R_1$ is anilino, $R_2$ is morphilino and M is a cation such as sodium, the brightener is 4,4'-bis[(4-anilino-6-morphilino-s-triazine-2-yl)amino]2,2'-stilbenedisulfonic acid, sodium salt. This particular brightener species is commercially marketed under the tradename Tinopal AMS-GX® by Ciba Geigy Corporation.

VI. OTHER OPTIONAL INGREDIENTS

A. PERFUME

The compositions of the present invention can contain any softener compatible perfume. Preferred perfumes are disclosed in U.S. Pat. No. 5,500,138, Bacon et al., issued Mar. 19, 1996, said patent being incorporated herein by reference. Perfume is optionally present at a level of from about 0% to about 10%, preferably from about 0.1% to about 5%, more preferably from about 0.2% to about 3%, by weight of the finished composition.

B. STABILIZERS

Stabilizers are highly desirable, and even essential, in the finished dispersion and/or clear compositions, and, optionally, the raw materials, of the present invention. The term "stabilizer," as used herein, includes antioxidants and reductive agents. These agents are present at a level of from 0% to about 2%, preferably from about 0.01% to about 0.2%, more preferably from about 0.035% to about 0.1% for antioxidants, and preferably from about 0.01% to about 0.2% for reductive agents, in the final composition. For the premix, the levels are adjusted, depending on the concentrations of the softener active in the premix and the finished composition. These assure good odor stability under long term storage conditions. Antioxidants and reductive agent stabilizers are especially critical for unscented or low scent products (no or low perfume).

Examples of antioxidants that can be added to the dispersion compositions of this invention include a mixture of ascorbic acid, ascorbic palmitate, propyl gallate, available from Eastman Chemical Products, Inc., under the trade names Tenox® PG and Tenox® S-1; a mixture of BHT (butylated hydroxytoluene), BHA (butylated hydroxyanisole), propyl gallate, and citric acid, available from Eastman Chemical Products, Inc., under the trade name Tenox®-6; butylated hydroxytoluene, available from UOP Process Division under the trade name Sustane® BHT; tertiary butylhydroquinone, Eastman Chemical Products, Inc., as Tenox® TBHQ; natural tocopherols, Eastman Chemical Products, Inc., as Tenox® GT-1/GT-2; and butylated hydroxyanisole, Eastman Chemical Products, Inc., as BHA; long chain esters ($C_8$–$C_{22}$) of gallic acid, e.g., dodecyl gallate; Irganox(® 1010; Irganox® 1035; Irganox® B 1171; Irganox® 1425; Irganox® 3114; Irganox® 3125; and mixtures thereof; preferably Irganox® 3125, Irganox® 1425, Irganox® 3114, and mixtures thereof; more preferably Irganox 3125 alone or mixed with citric acid and/or other chelators such as isopropyl citrate, Dequest® 2010, available from Monsanto with a chemical name of 1-hydroxyethylidene-1, 1-diphosphonic acid (etidronic acid), and Tiron®, available from Kodak with a chemical name of 4,5-dihydroxy-m-benzene-sulfonic acid/sodium salt, and DTPA®, available from Aldrich with a chemical name of diethylenetriaminepentaacetic acid.

C. WATER AND WATER SOLUBLE ORGANIC SOLVENT

The dispersion, and clear, compositions of the present invention contain water and, optionally, comprise up to about 30% of water soluble solvent, The dispersions can contain from about 5% to about 30%, preferably from about 8% to about 25%, more preferably from about 10% to about 20%, by weight of the composition of water soluble organic solvent. The solvent is preferably mixed with the fabric softener active, e.g., DEQA to help provide a low viscosity for ease of processing, e.g., pumping and/or mixing, even at ambient temperatures.

The water soluble organic solvent is preferably water soluble solvent, e.g., ethanol; isopropanol; 1,2-propanediol; 1,3-propanediol; propylene carbonate; hexylene glycol, diethylene glycol n-butyl ether; etc.

It is possible to create finished concentrated compositions with conventional mixing at ambient temperatures, e.g., from about 10° C. to about 40° C., preferably from about 20° C. to about 35° C., with only low levels of water soluble solvents, is possible with the highly unsaturated fabric softener compounds.

D. DISPERSIBILITY AIDS

The dispersion compositions of the present invention can optionally contain dispersibility aids, e.g., those selected from the group consisting of mono-long chain alkyl cationic quaternary ammonium compounds, mono-long chain alkyl amine oxides, and mixtures thereof, to, e.g., assist in the formation of finished dispersion compositions. When said dispersibility aid is present , it is typically present at a total level of from about 2% to about 25%, preferably from about 3% to about 17%, more preferably from about 4% to about 15%, and even more preferably from 5% to about 13% by weight of the composition. These materials can either be added as part of the active softener raw material, (I), or added as a separate component. The total level of dispersibility aid includes any amount that may be present as part of component (I).

(1) Mono-Alkyl Cationic Quaternary Ammonium Compound

When the mono-alkyl cationic quaternary ammonium compound is present, it is typically present at a level of from about 2% to about 25%, preferably from about 3% to about 17%, more preferably from about 4% to about 15%, and even more preferably from 5% to about 13% by weight of the composition, the total mono-alkyl cationic quaternary ammonium compound being at least at an effective level.

Such mono-alkyl cationic quaternary ammonium compounds usefull in the present invention are, preferably, quaternary ammonium salts of the general formula:

$$[R^4N^+(R^5)_3]\,A^-$$

wherein $R^4$ is $C_8$–$C_{22}$ alkyl or alkenyl group, preferably $C_{10}$–$C_{18}$ alkyl or alkenyl group; more preferably $C_{10}$–$C_{14}$ or $C_{16}$–$C_{18}$ alkyl or alkenyl group; each $R^5$ is a $C_1$–$C_6$ alkyl or substituted alkyl group (e.g., hydroxy alkyl), preferably $C_1$–$C_3$ alkyl group, e.g., methyl (most preferred), ethyl, propyl, and the like, a benzyl group, hydrogen, a polyethoxylated chain with from about 2 to about 20 oxyethylene units, preferably from about 2.5 to about 13 oxyethylene units, more preferably from about 3 to about 10 oxyethylene units, and mixtures thereof; and $A^-$ is as defined hereinbefore for (Formula (I)).

Especially preferred dispersibility aids are monolauryl trimethyl ammonium chloride and monotallow trimethyl ammonium chloride available from Witco under the trade name Varisoft® 471 and monooleyl trimethyl ammonium chloride available from Witco under the tradename Varisoft® 417.

The $R^4$ group can also be attached to the cationic nitrogen atom through a group containing one, or more, ester, amide, ether, amine, etc., linking groups which can be desirable for increased concentratability of component (I), etc. Such linking groups are preferably within from about one to about three carbon atoms of the nitrogen atom.

Mono-alkyl cationic quaternary ammonium compounds also include $C_8$–$C_{22}$ alkyl choline esters. The preferred dispersibility aids of this type have the formula:

$$R^1C(O)—O—CH_2CH_2N^+(R)_3\ A^-$$

wherein $R^1$, R and $A^-$ are as defined previously.

Highly preferred dispersibility aids include $C_{12}$–$C_{14}$ coco choline ester and $C_{16}$–$C_{18}$ tallow choline ester.

Suitable biodegradable single-long-chain alkyl dispersibility aids containing an ester linkage in the long chains are described in U.S. Pat. No. 4,840,738, Hardy and Walley, issued Jun. 20, 1989, said patent being incorporated herein by reference.

When the dispersibility aid comprises alkyl choline esters, preferably the dispersion compositions also contain a small amount, preferably from about 2% to about 5% by weight of the composition, of organic acid. Organic acids are described in European Patent Application No. 404,471, Machin et al., published on Dec. 27, 1990, supra, which is herein incorporated by reference. Preferably the organic acid is selected from the group consisting of glycolic acid, acetic acid, citric acid, and mixtures thereof.

Ethoxylated quaternary ammonium compounds which can serve as the dispersibility aid include ethylbis (polyethoxy ethanol)alkylammonium ethyl-sulfate with 17 moles of ethylene oxide, available under the trade name Variquat® 66 from Sherex Chemical Company; polyethylene glycol (15) oleammonium chloride, available under the trade name Ethoquad® 0/25 from Akzo; and polyethylene glycol (15) cocomonium chloride, available under the trade name Ethoquad® C/25 from Akzo.

Although the main function of the dispersibility aid is to increase the dispersibility of the ester softener, preferably the dispersibility aids of the present invention also have some softening properties to boost softening performance of the composition. Therefore, preferably the dispersion compositions of the present invention are essentially free of non-nitrogenous ethoxylated nonionic dispersibility aids which will decrease the overall softening performance of the dispersion compositions.

Also, quaternary compounds having only a single long all chain, can protect the cationic softener from interacting with anionic surfactants and/or detergent builders that are carried over into the rinse from the wash solution. It is highly desirable to have sufficient single long chain quaternary compound, or cationic polymer to tie up the anionic surfactant. This provides improved wrinkle control. The ratio of fabric softener active to single long chain compound is typically from about 100:1 to about 2:1, preferably from about 50:1 to about 5:1, more preferably from about 13:1 to about 8:1. Under high detergent carry-over conditions, the ratio is preferably from about 5:1 to about 7:1. Typically the single long chain compound is present at a level of about 10 ppm to about 25 ppm in the rinse.

(2) Arnine Oxides

Suitable amine oxides include those with one alkyl or hydroxyalkyl moiety of about 8 to about 22 carbon atoms, preferably from about 10 to about 18 carbon atoms, more preferably from about 8 to about 14 carbon atoms, and two alkyl moieties selected from the group consisting of alkyl groups and hydroxyalkyl groups with about 1 to about 3 carbon atoms.

Examples include dimethyloctylamine oxide, diethyldecylamine oxide, bis-(2-hydroxyethyl)dodecyl-amine oxide, dimethyldodecylamine oxide, dipropyl-tetradecylamine oxide, methylethylhexadecylamine oxide, dimethyl-2-hydroxyoctadecylamine oxide, and coconut fatty alkyl dimethylamine oxide.

These dispersibility aids can also enable one to make higher concentration dispersion compositions and/or to meet higher stability standards depending on the other ingredients. These concentration aids which typically can be viscosity modifiers may be needed, or preferred, for ensuring stability under extreme conditions when particular softener active levels are used. The surfactant concentration aids are typically selected from the group consisting of the single long chain alkyl cationic surfactants and amine oxides disclosed hereinbefore; nonionic surfactants; fatty acids; and mixtures thereof. These aids are described in P&G Copending Application Ser. No. 08/461,207, filed Jun. 5, 1995, Wahl et al., specifically on page 14, line 12 to page 20, line 12, which is herein incorporated by reference.

E. SOIL RELEASE AGENT

In the present invention, an optional soil release agent can be added, especially to the finished dispersion compositions. The addition of the soil release agent can occur in combination with the premix, in combination with the acid/water seat, before or after electrolyte addition, or after the final composition is made. The finished softening composition prepared by the process of the present invention herein can contain from 0% to about 10%, preferably from 0.2% to about 5%, of a soil release agent. The concentration in the premix is adjusted to provide the desired end concentration. Preferably, such a soil release agent is a polymer. Polymeric soil release agents useful in the present invention include copolymeric blocks of terephthalate and polyethylene oxide or polypropylene oxide, and the like.

A preferred soil release agent is a copolymer having blocks of terephthalate and polyethylene oxide. More specifically, these polymers are comprised of repeating units of ethylene terephthalate and polyethylene oxide terephthalate at a molar ratio of ethylene terephthalate units to polyethylene oxide terephthalate units of from 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials Zelcon 4780 ® (from Dupont) and Milease T® (from ICI).

Highly preferred soil release agents are polymers of the generic formula:

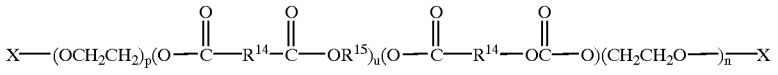

in which each X can be a suitable capping group, with each X typically being selected from the group consisting of H, and alkyl or acyl groups containing from about 1 to about 4 carbon atoms. p is selected for water solubility and generally is from about 6 to about 113, preferably from about 20 to about 50. u is critical to formulation in a liquid composition having a relatively high ionic strength. There should be very little material in which u is greater than 10. Furthermore, there should be at least 20%, preferably at least 40%, of material in which u ranges from about 3 to about 5.

The $R^{14}$ moieties are essentially 1,4-phenylene moieties. As used herein, the term "the $R^{14}$ moieties are essentially 1,4-phenylene moieties" refers to compounds where the $R^{14}$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2-biphenylene, 4,4-biphenylene, and mixtures thereof. Alkylene and alkenylene moieties which can be partially substituted include 1,2-propylene, 1,4-butylene, 1,5-pentylene, 1,6-hexamethylene, 1,7-heptainethylene, 1,8-octamethylene, 1,4-cyclohexylene, and mixtures thereof.

For the $R^{14}$ moieties, the degree of partial substitution with moieties other than 1,4-phenylene should be such that the soil release properties of the compound are not adversely affected to any great extent. Generally the degree of partial substitution which can be tolerated will depend upon the backbone length of the compound, i.e., longer backbones can have greater partial substitution for 1,4-phenylene moieties. Usually, compounds where the $R^{14}$ comprise from about 50% to about 100% 1,4-phenylene moieties (from 0% to about 50% moieties other than 1,4-phenylene) have adequate soil release activity. For example, polyesters made according to the present invention with a 40:60 mole ratio of isophthalic (1,3-phenylene) to terephthalic (1,4-phenylene) acid have adequate soil release activity. However, because most polyesters used in fiber making comprise ethylene terephthalate units, it is usually desirable to minimize the degree of partial substitution with moieties other than 1,4-phenylene for best soil release activity. Preferably, the $R^{14}$ moieties consist entirely of (i.e., comprise 100%) 1,4-phenylene moieties, i.e., each $R^{14}$ moiety is 1,4-phenylene.

For the $R^{15}$ moieties, suitable ethylene or substituted ethylene moieties include ethylene, 1,2-propylene, 1,2-butylene, 1,2-hexylene, 3-methoxy-1,2-propylene, and mixtures thereof. Preferably, the $R^{15}$ moieties are essentially ethylene moieties, 1,2-propylene moieties, or mixtures thereof. Inclusion of a greater percentage of ethylene moieties tends to improve the soil release activity of compounds. Surprisingly, inclusion of a greater percentage of 1,2-propylene moieties tends to improve the water solubility of compounds.

Therefore, the use of 1,2-propylene moieties or a similar branched equivalent is desirable for incorporation of any substantial part of the soil release component in the liquid fabric softener dispersion compositions. Preferably, from about 75% to about 100%, are 1,2-propylene moieties.

The value for each p is at least about 6, and preferably is at least about 10. The value for each n usually ranges from about 12 to about 113. Typically the value for each p is in the range of from about 12 to about 43.

A more complete disclosure of soil release agents is contained in U.S. Pat. No. 4,661,267, Decker, Konig, Straathof, and Gosselink, issued Apr. 28, 1987; U.S. Pat. No. 4,711,730, Gosselink and Diehl, issued Dec. 8, 1987; U.S. Pat. No. 4,749,596, Evans, Huntington, Stewart, Wolf, and Zimmerer, issued Jun. 7, 1988; U.S. Pat. No. 4,818,569, Trinh, Gosselink, and Rattinger, issued Apr. 4, 1989; U.S. Pat. No. 4,877,896, Maldonado, Trinh, and Gosselink, issued Oct. 31, 1989; U.S. Pat. No. 4,956,447, Gosselink et al., issues Sep. 11, 1990; and U.S. Pat. No. 4,976,879, Maldonado, Trinh, and Gosselink, issued Dec. 11, 1990, all of said patents being incorporated herein by reference.

These soil release agents can also act as scum dispersants.

F. SCUM DISPERSANT

The compositions can also contain an optional scum dispersant, other than the soil release agent. Scum dispersants are desirable components of the finished dispersion compositions herein.

The preferred scum dispersants herein are formed by highly ethoxylating hydrophobic materials. The hydrophobic material can be a fatty alcohol, fatty acid, fatty amine, fatty acid amide, amine oxide, quaternary ammonium compound, or the hydrophobic moieties used to form soil release polymers. The preferred scum dispersants are highly ethoxylated, e.g., more than about 17, preferably more than about 25, more preferably more than about 40, moles of ethylene oxide per molecule on the average, with the polyethylene oxide portion being from about 76% to about 97%, preferably from about 81% to about 94%, of the total molecular weight.

The level of scum dispersant is sufficient to keep the scum at an acceptable, preferably unnoticeable to the consumer, level under the conditions of use, but not enough to adversely affect softening. For some purposes it is desirable that the scum is nonexistent. Depending on the amount of anionic or nonionic detergent, etc., used in the wash cycle of a typical laundering process, the efficiency of the rinsing steps prior to the introduction of the dispersion compositions herein, and the water hardness, the amount of anionic or nonionic detergent surfactant and detergency builder (especially phosphates and zeolites) entrapped in the fabric (laundry) will vary. Normally, the minimum amount of scum dispersant should be used to avoid adversely affecting softening properties. Typically scum dispersion requires at least about 2%, preferably at least about 4% (at least 6% and preferably at least 10% for maximum scum avoidance) based upon the level of softener active. However, at levels of about 10% (relative to the softener material) or more, one risks loss of softening efficacy of the product especially when the fabrics contain high proportions of nonionic surfactant which has been absorbed during the washing operation.

Preferred scum dispersants are: Brij 700®; Varonic U-250®; Genapol T-500®, Genapol T-800®; Plurafac A-79®; and Neodol 25-50®.

G. BACTERICIDES

Examples of bactericides used in the premixes and/or finished dispersion compositions of this invention include glutaraldehyde, formaldehyde, 2-bromo-2-nitro-propane-1, 3-diol sold by Inolex Chemicals, located in Philadelphia, Pa., under the trade name Bronopol®, and a mixture of 5-chloro-2-methyl-4-isothiazoline-3-one and 2-methyl-4-isothiazoline-3-one sold by Rohm and Haas Company under the trade name Kathon CG/ICP®. Typical levels of bactericides used in the present dispersion compositions are from about 1 to about 1,000 ppm by weight of the agent.

H. CATIONIC POLYMERS

Composition herein can contain from about 0.001% to about 10%, preferably from about 0.01% to about 5%, more preferably from about 0.1% to about 2%, of cationic polymer, typically having a molecular weight of from about 500 to about 1,000,000, preferably from about 1,000 to about 500,000, more preferably from about 1,000 to about 250,000, and even more preferably from about 2,000 to about 100,000 and a charge density of at least about 0.01 meq/gm., preferably from about 0.1 to about 8 meq/gm., more preferably from about 0.5 to about 7, and even more preferably from about 2 to about 6. In order to provide the benefits of the cationic polymers, and especially cationic polymers containing amine, or imine, groups, said cationic polymer is preferably primarily in the continuous aqueous phase.

The cationic polymers of the present invention can be amine salts or quaternary ammonium salts. Preferred are quaternary ammonium salts. They include cationic derivatives of natural polymers such as some polysaccharide, gums, starch and certain cationic synthetic polymers such as polymers and co-polymers of cationic vinyl pyridine or vinyl pyridinium halides. Preferably the polymers are water soluble, for instance to the extent of at least 0.5% by weight at 20° C. Preferably they have molecular weights of from about 600 to about 1,000,000, more preferably from about 600 to about 500,000, even more preferably from about 800 to about 300,000, and especially from about 1000 to 10,000. As a general rule, the lower the molecular weight the higher the degree of substitution (D.S.) by cationic, usually quaternary groups, which is desirable, or, correspondingly, the lower the degree of substitution the higher the molecular weight which is desirable, but no precise relationship appears to exist. In general, the cationic polymers should have a charge density of at least about 0.01 meq/gm., preferably from about 0.1 to about 8 meq/gm., more preferably from about 0.5 to about 7, and even more preferably from about 2 to about 6.

Suitable desirable cationic polymers are disclosed in "CTFA International Cosmetic Ingredient Dictionary, Fourth Edition, J. M. Nikitakis, et al, Editors, published by the Cosmetic, Toiletry, and Fragrance Association, 1991, incorporated herein by reference. The list includes the following:

Of the polysaccharide gums, guar and locust bean gums, which are galactomannam gums are available commercially, and are preferred. Thus guar gums are marketed under Trade Names CSAA M/200, CSA 200/50 by Meyhall and Stein-Hall, and hydroxyalkylated guar gums are available from the same suppliers. Other polysaccharide gums commercially available include: Xanthan Gum; Ghatti Gum; Tamarind Gum; Gum Arabic; and Agar.

Cationic guar gums and methods for making them are disclosed in British Pat. No. 1,136,842 and U.S. Pat. No. 4,031,307. Preferably they have a D.S. of from 0.1 to about 0.5.

An effective cationic guar gum is Jaguar C-13S (Trade Name—Meyhall). Cationic guar gums are a highly preferred group of cationic polymers in compositions according to the invention and act both as scavengers for residual anionic surfactant and also add to the softening effect of cationic textile softeners even when used in baths containing little or no residual anionic surfactant. The other polysaccharide-based gums can be quaternized similarly and act substantially in the same way with varying degrees of effectiveness. Suitable starches and derivatives are the natural starches such as those obtained from maize, wheat, barley etc., and from roots such as potato, tapioca etc., and dextrins, particularly the pyrodextrins such as British gum and white dextrin.

Some very effective individual cationic polymers are the following: Polyvinyl pyridine, molecular weight about 40,000, with about 60% of the available pyridine nitrogens quaternized.; Co-polymer of 70/30 molar proportions of vinyl pyridine/styrene, molecular weight about 43,000, with about 45% of the available pyridine nitrogens quaternized as above.; Co-polymers of 60/40 molar proportions of vinyl pyridine/acrylamide, with about 35% of the available pyridine nitrogens quaternized as above. Co-polymers of 77/23 and 57/43 molar proportions of vinyl pyridine/methyl methacrylate, molecular weight about 43,000, with about 97% of the available pyridine nitrogens quaternized as above.

These cationic polymers are effective in the compositions at very low concentrations for instance from 0.001% by weight to 0.2% especially from about 0.02% to 0.1%. In some instances the effectiveness seems to fall off, when the content exceeds some optimum level, such as for polyvinyl pyridine and its styrene co-polymer about 0.05%.

Some other effective cationic polymers are: Co-polymer of vinyl pyridine and N-vinyl pyrrolidone (63/37) with about 40% of the available pyridine nitrogens quaternized.; Co-polymer of vinyl pyridine and acrylonitrile (60/40), quaternized as above.; Co-polymer of N,N-dimethyl amino ethyl methacrylate and styrene (55/45) quaternized as above at about 75% of the available amino nitrogens. Eudragit E (Trade Name of Rohm GmbH) quaternized as above at about 75% of the available amino nitrogens. Eudragit E is believed to be co-polymer of N,N-dialkyl amino alkyl methacrylate and a neutral acrylic acid ester, and to have molecular weight about 100,000 to 1,000,000.; Co-polymer of N-vinyl pyrrolidone and N,N-diethyl amino methyl methacrylate (40/50), quaternized at about 50% of the available amino nitrogens.; These cationic polymers can be prepared in a known manner by quaternising the basic polymers.

Yet other cationic polymeric salts are quaternized polyethyleneimines. These have at least 10 repeating units, some or all being quaternized. Commercial examples of polymers of this class are also sold under the generic Trade Name Alcostat by Allied Colloids.

Typical examples of polymers are disclosed in U.S. Pat. 4,179,382, incorporated herein by reference.

Each polyamine nitrogen whether primary, secondary or tertiary, is further defined as being a member of one of three general classes; simple substituted, quaternized or oxidized.

The polymers are made neutral by water soluble anions such as chlorine ($Cl^-$), bromine ($Br^-$), iodine ($I^-$) or any other negatively charged radical such as sulfate ($SO_4^{2-}$) and methosulfate ($CH_3SO_{3-}$).

Specific polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S.

Pat. No. 2,806,839, Crowther, issued Sep. 17, 1957; and U.S. Pat. No. 2,553,696, Wilson, issued May 21, 1951; all herein incorporated by reference.

Examples of modified polyamine cationic polymers of the present invention comprising PEI's, are illustrated in Formulas I–II:

Formula I depicts a polyamine cationic polymer comprising a PEI backbone wherein all substitutable nitrogens are modified by replacement of hydrogen with a polyoxyalkyleneoxy unit, —$(CH_2CH_2O)_7H$, having the formula Formula I

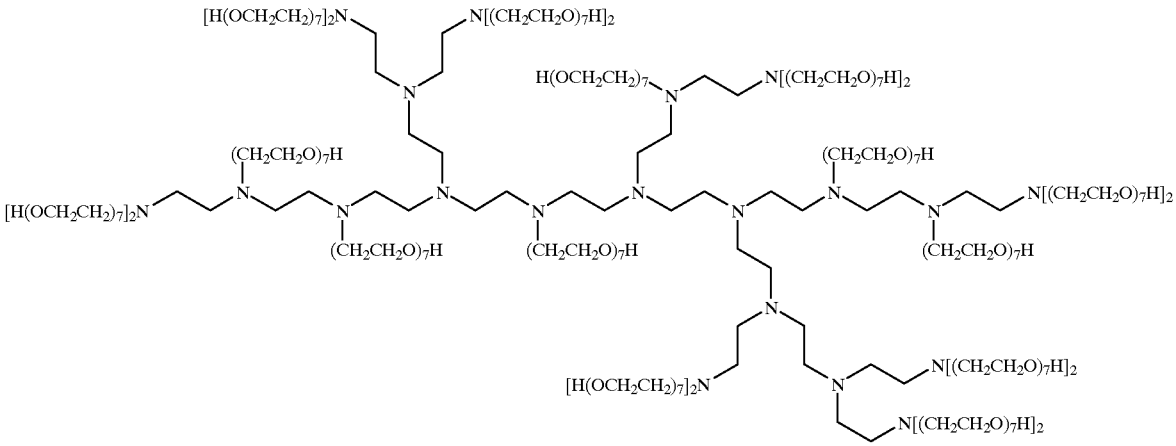

This is an example of a polyamine cationic polymer that is fully modified by one type of moiety.

Formula II depicts a polyamine cationic polymer comprising a PEI backbone wherein all substitutable primary amine nitrogens are modified by replacement of hydrogen with a polyoxyalkyleneoxy unit, —$(CH_2CH_2O)_7H$, the molecule is then modified by subsequent oxidation of all oxidizable primary and secondary nitrogens to N-oxides, said polyamine cationic polymer having the formula Formula II

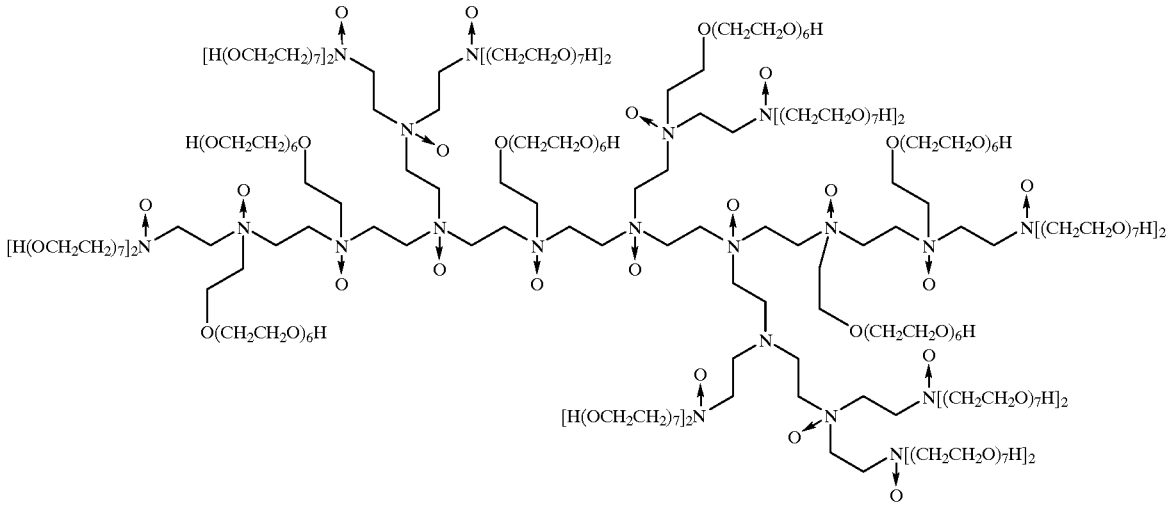

Another related polyamine cationic polymer comprises a PEI backbone wherein all backbone hydrogen atoms are substituted and some backbone amine units are quaternized. The substituents are polyoxyalkyleneoxy units, —$(CH_2CH_2O)_7H$, or methyl groups. Yet another related polyamine cationic polymer comprises a PEI backbone wherein the backbone nitrogens are modified by substitution (i.e. by —$(CH_2CH_2O)_7H$ or methyl), quaternized, oxidized to N-oxides or combinations thereof.

Of course, mixtures of any of the above described cationic polymers can be employed, and the selection of individual polymers or of particular mixtures can be used to control the physical properties of the compositions such as their viscosity and the stability of the aqueous dispersions.

In order to be most effective, the cationic polymers herein should be, at least to the level disclosed herein, in the continuous aqueous phase. In order to ensure that the polymers are in the continuous aqueous phase, they are preferably added at the very end of the process for making the compositions. The fabric softener actives are normally present in the form of vesicles. After the vesicles have formed, and while the temperature is less than about 85° F., the polymers are added.

I. SILICONES

The silicone herein can be either a polydimethyl siloxane (polydimethyl silicone or PDMS), or a derivative thereof, e.g., amino silicones, ethoxylated silicones, etc. The PDMS, is preferably one with a low molecular weight, e.g., one having a viscosity of from about 2 to about 5000 cSt, preferably from about 5 to about 500 cSt, more preferably from about 25 to about 200 cSt Silicone emulsions can conveniently be used to prepare the compositions of the present invention. However, preferably, the silicone is one that is, at least initially, not emulsified. I.e., the silicone should be emulsified in the composition itself. In the process of preparing the compositions, the silicone is preferably added to the "water seat", which comprises the water and, optionally, any other ingredients that normally stay in the aqueous phase.

Low molecular weight PDMS is preferred for use in the fabric softener compositions of this invention. The low molecular weight PDMS is easier to formulate without preemulsification.

Silicone derivatives such as amino-functional silicones, quaternized silicones, and silicone derivatives containing Si—OH, Si—H, and/or Si—Cl bonds, can be used. However, these silicone derivatives are normally more substantive to fabrics and can build up on fabrics after repeated treatments to actually cause a reduction in fabric absorbency.

When added to water, the fabric softener composition deposits the biodegradable cationic fabric softening active on the fabric surface to provide fabric softening effects. However, in a typical laundry process, using an automatic washer, cotton fabric water absorbency is appreciably reduced when there is more than about 40 ppm, especially when there is more than about 50 ppm, of the biodegradable cationic fabric softening active in the rinse water. The silicone improves the fabric water absorbency, especially for freshly treated fabrics, when used with this level of fabric softener without adversely affecting the fabric softening performance. The mechanism by which this improvement in water absorbency occurs is not understood, since the silicones are inherently hydrophobic. It is very surprising that there is any improvement in water absorbency, rather than additional loss of water absorbency.

The amount of PDMS needed to provide a noticeable improvement in water absorbency is dependent on the initial rewettability performance, which, in turn, is dependent on the detergent type used in the wash. Effective amounts range from about 2 ppm to about 50 ppm in the rinse water, preferably from about 5 to about 20 ppm. The PDMS to softener active ratio is from about 2:100 to about 50:100, preferably from about 3:100 to about 35:100, more preferably from about 4:100 to about 25:100. As stated hereinbefore, this typically requires from about 0.2% to about 20%, preferably from about 0.5% to about 10%, more preferably from about 1% to about 5% silicone.

The PDMS also improves the ease of ironing in addition to improving the rewettability characteristics of the fabrics. When the fabric care composition contains an optional soil release polymer, the amount of PDMS deposited on cotton fabrics increases and PDMS improves soil release benefits on polyester fabrics. Also, the PDMS improves the rinsing characteristics of the fabric care compositions by reducing the tendency of the compositions to foam during the rinse. Surprisingly, there is little, if any, reduction in the softening characteristics of the fabric care compositions as a result of the presence of the relatively large amounts of PDMS.

J. OTHER OPTIONAL INGREDIENTS

The finished dispersion compositions of the present invention can include optional components conventionally used in textile treatment dispersion compositions, for example: colorants; preservatives; surfactants; anti-shrinkage agents; fabric crisping agents; spotting agents; germicides; fungicides; anti-oxidants such as butylated hydroxy toluene, anti-corrosion agents, and the like.

Particularly preferred ingredients include water soluble calcium and/or magnesium compounds, as described above for the clear compositions, which provide additional stability. The chloride salts are preferred, but acetate, nitrate, etc. salts can be used. The level of said calcium and/or magnesium salts is from 0% to about 2%, preferably from about 0.05% to about 0.5%, more preferably from about 0.1% to about 0.25%. These materials are desirably added to the water and/or acid (water seat) used to prepare the finished dispersion compositions to help adjust the finished viscosity.

The present invention can also include other compatible ingredients, including those as disclosed in copending applications Ser. Nos.: 08/372,068, filed Jan. 12, 1995, Rusche, et al.; Ser. No. 08/372,490, filed Jan. 12, 1995, Shaw, et al.; and Ser. No. 08/277,558, filed Jul. 19, 1994, Hartman, et al., incorporated herein by reference.

The Horizontal Gravimetric Wicking Test

The Horizontal Gravimetric Wicking (HGW) test is a point source demand wettability test that gives a measure of the water absorbency of a dry fabric sample. The test measures the uptake of water by a round, dry cotton terry sample as a function of time. The procedures of and equipment used in a typical HGW test are described in greater detail in Chatterjee, *Absorbency Textile Source and Technology*, Vol. 7, 1985 at pp. 60–68, and in Painter, TAPPI 68:12, Dec. 1985 at pp. 54–59. Both of these publications are incorporated herein by reference. In this method as used herein, the absorbency of the treated fabrics is measured using treated cotton terries. Round cotton terry samples of diameter of about 2.25 inches (about 5.6 cm) are used. The treated cotton terry samples are allowed to equilibrate in a constant temperature/constant relative humidity environment of about 73° F. (about 23° C.) temperature and about 50% relative humidity for at least 1 hour before using in the HGW test. The terry sample is placed horizontally on a flat stainless steel screen centered with an opening of about 15 mm in diameter and suspended from an electronic balance. A stainless steel supply tube with an approximate 4 mm inner diameter, containing distilled water and connected to a distilled water reservoir, is allowed to contact the lower surface of the sample as a point source and the increase in weight of the sample is used as a measure of the fluid uptake versus time. The height of the reservoir, the top of the stainless steel tube, and the surface of the screen are all at the same level. For the purpose of this invention, the fabric water absorbency is measured by the total water uptake weight after about 10 seconds. The HGW relative water absorbency of a treated fabric, given as a percentage, is the ratio of the water absorbency of the treated cotton terry to that of the untreated cotton terry multiplied by 100. A HGW relative water absorbency of less than 100% means that the treated fabric is less absorbent than the untreated fabric, while a relative water absorbency of more than 100% means that the treated fabric is more absorbent than the untreated fabric.

The preferred unsaturated and/or branched chain actives herein provide an HGW relative water absorbency of at least about 75%, more preferably at least about 85%, and even more preferably at least about 100%.

All parts, percentages, proportions, and ratios herein, including in the following examples, are by weight unless otherwise specified and all numerical values are approximations based upon normal confidence limits. All documents cited are, in relevant part, incorporated herein by reference.

The following are suitable fabric softening actives (FSA and DEQA) that are used hereinafter for preparing the following compositions.

$FSA^1$: dioleyldimethylammonium chloride.

$FSA^2$: di(canola)dimethylammonium chloride.

$FSA^3$: diisostearyldimethylammonium chloride.

$FSA^4$: 1-methyl-1 -oleylamidoethyl-2-oleylimidazolinium methylsulfate (e.g., Varisoft® 3690).

$FSA^5$: 1-methyl-1-(canola)amidoethyl-2-(canola) imidazolinium methylsulfate.

$FSA^6$: 1-oleylamidoethyl-2-oleylimidazoline.

$FSA^7$: 1-(canola)amidoethyl-2-(canola)imidazoline.

$FSA^8$: $[R_1—C(O)—NH—CH_2CH_2—N(CH_3)(CH_2CH_2OH)—CH_2CH_2—NH—C(O)—R_1]^+CH_3SO_4^-$ wherein $R_1$—C(O) is oleoyl group (e.g., Varisoft® 222LT).

$FSA^9$: $[R_8—C(O)—NH—CH_2CH_2—N(CH_3)(CH_2CH_2OH)—CH_2CH_2—NH—C(O)—R_8]^+CH_3SO_4^-$ wherein $R_8$—C(O) is the (canola)alkyloyl group.

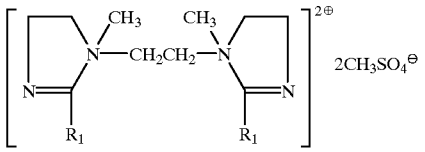

wherein $R_1$ is derived from oleic acid.

$FSA^{11}$ :di(hydrocarbyl)dimethylammonium chloride, wherein the hydrocarbyl group is derived from a mixture of oleic acid (fatty acid of $FSA^1$) and isostearic acid of $FSA^3$ at an approximate 65:35 weight ratio.

$FSA^{12}$:di(hydrocarbyl)dimethylammonium chloride, wherein the hydrocarbyl group is derived from a mixture of canola fatty acid (fatty acid of $FSA^2$) and tallow fatty acid at an approximate 65:35 weight ratio.

$FSA^{13}$: oleyltrimethylammonium chloride.

$EQA^1$ : di(fatty acyloxyethyl)dimethylammonium chloride with fatty acyl group derived from fatty acid $FA^1$ as disclosed herein before, about 85% active in ethanol.

$DEQA^4$: di(fatty acyloxyethyl)dimethylammonium chloride with fatty acyl group derived from fatty acid $FA^4$ as disclosed herein before, about 85% active in ethanol.

$DEQA^6$: di(acyloxyethyl)(2-hydroxyethyl) methylammonium methylsulfate, wherein the acyl group is the same as that of $DEQA^1$, about 85% active in ethanol.

$DEQA^7$: 1,2-di(oleoyloxyethyl)-3-trimethylammoniopropane chloride, wherein the acyl group is the same as that of $DEQA^1$, about 85% active in ethanol.

$DEQA^8$ : di(acyloxyethyl)dimethylammonium chloride, wherein the acyl group is derived from a mixture of partially hydrogenated soya fatty acid and slightly hydrogenated tallow fatty acid at an approximate 65:35 weight ratio, about 85% active in ethanol.

$DEQA^9$ : di(acyloxyethyl)dimethylammonium chloride, wherein the acyl group is derived from a mixture of $FA^1$ and and isostearic acid at an approximate 65:35 weight ratio, about 85% active in ethanol.

$DEQA^{10}$ : di(acyloxyethyl)(2-hydroxyethyl) methylammonium methylsulfate, wherein the acyl group has the same distribution as in $FA^{10}$, about 85% active in ethanol.

$DEQA^{11}$: di(acyloxyethyl)dimethylammonium chloride, wherein the acyl group is derived from a mixture of $FA^{10}$ and and isostearic acid at an approximate 65:35 weight ratio, about 85% active in ethanol.

The compositions in the Examples below are made by first preparing an oil seat of softener active at ambient temperature. The softener active can be heated, if necessary, to melting if the softener active is not fluid at room temperature. The softener active is mixed using an IKA RW 25® mixer for about 2 to about 5 minutes at about 150 rpm. Separately, an acid/water seat is prepared by mixing the HCl with deionized (DI) water at ambient temperature. If the softener active and/or the principal solvent(s) are not fluid at room temperature and need to be heated, the acid/water seat should also be heated to a suitable temperature, e.g., about 100° F. (about 38° C.) and maintaining said temperature with a water bath. The principal solvent(s) (melted at suitable temperatures if their melting points are above room temperature) are added to the softener premix and said premix is mixed for about 5 minutes. The acid/water seat is then added to the softener premix and mixed for about 20 to about 30 minutes or until the composition is clear and homogeneous. The composition is allowed to air cool to ambient temperature.

EXAMPLE I

| Ingredients | 1 Wt. % | 2 Wt. % | 3 Wt. % | 4 Wt. % | 5 Wt. % | 6 Wt. % | 7 Wt. % | 8 Wt. % |
|---|---|---|---|---|---|---|---|---|
| $FSA^1$ | 24 | — | — | — | — | 9 | 9 | — |
| $FSA^2$ | — | 26.6 | — | — | — | — | — | — |
| $FSA^3$ | — | — | 26.6 | — | — | — | — | — |
| $FSA^4$ | — | — | — | 26.6 | — | — | — | — |
| $FSA^5$ | — | — | — | — | 26.6 | — | — | — |
| $FSA^6$ | — | — | — | — | — | 16.6 | — | — |
| $FSA^7$ | — | — | — | — | — | — | 16.6 | — |
| $FAS^8$ | — | — | — | — | — | — | — | 26.6 |
| $FSA^{13}$ | 2.6 | — | — | — | — | 1 | 1 | — |
| Ethanol | 6 | 6 | 6 | 6 | 6 | 6 | 6 | 6 |
| 1,2-Hexanediol | 17 | 17 | 17 | 17 | 17 | 17 | 17 | 17 |
| HCl | (a) | (a) | (a) | (a) | (a) | (a) | (a) | (a) |
| Perfume | 1.2 | 1.2 | 1.2 | 1.2 | 1.2 | 1.2 | 1.2 | 1.2 |
| Kathon | 3 ppm | 3 ppm | 3 ppm | 3 ppm | 3 ppm | 3 ppm | 3 ppm | 3 ppm |
| DI Water | Bal. | Bal. | Bal. | Bal. | Bal. | Bal. | Bal. | Bal. |

(a) To adjust pH of the Composition to about 3.5–4.0.

The above Examples show clear products with acceptable viscosities.

EXAMPLE II

| Ingredients | 1 Wt. % | 2 Wt. % | 3 Wt. % | 4 Wt. % | 5 Wt. % | 6 Wt. % | 7 Wt. % | 8 Wt. % |
|---|---|---|---|---|---|---|---|---|
| FSA[9] | 26.6 | — | — | — | — | — | — | — |
| FSA[10] | — | 26.6 | — | — | — | — | — | — |
| FSA[11] | — | — | 26.6 | — | — | — | — | — |
| FSA[12] | — | — | — | 26.6 | — | — | — | — |
| FSA[1] | — | — | — | — | 24 | — | — | — |
| FSA[1] | — | — | — | — | — | 24 | — | — |
| FSA[2] | — | — | — | — | — | — | 26.6 | — |
| FSA[2] | — | — | — | — | — | — | — | 26.6 |
| FSA[13] | — | — | — | — | 2.6 | 2.6 | — | — |
| Ethanol | 6 | 6 | 6 | 6 | 6 | 6 | 6 | 6 |
| 1,2-Hexanediol | 17 | 17 | 17 | 17 | 9.2 | 13 | 10 | 10 |
| 1,2-Pentanediol | — | — | — | — | 6.8 | 2 | — | — |
| 1,2-Octanediol | — | — | — | — | — | 1 | — | — |
| 2-Ethyl-1,3-hexanediol | — | — | — | — | — | — | 8 | — |
| 2,2,4-Trimethyl-1,3-pentanediol | — | — | — | — | — | — | — | 8 |
| HCl | (a) | (a) | (a) | (a) | (a) | (a) | (a) | (a) |
| Perfume | 1.2 | 1.2 | 1.2 | 1.2 | 1.2 | 1.2 | 1.2 | 1.2 |
| Kathon | 3 ppm | 3 ppm | 3 ppm | 3 ppm | 3 ppm | 3 ppm | 3 ppm | 3 ppm |
| DI Water | Bal. | Bal. | Bal. | Bal. | Bal. | Bal. | Bal. | Bal. |

(a) To adjust pH of the Composition to about 3.5–4.0.

The above Examples show clear products with acceptable viscosities.

EXAMPLE III

| Ingredients | 1 Wt. % | 2 Wt. % | 3 Wt. % | 4 Wt. % | 5 Wt. % | 6 Wt. % | 7 Wt. % | 8 Wt. % |
|---|---|---|---|---|---|---|---|---|
| FSA[1] | — | — | — | 9 | 39.3 | 14.8 | — | — |
| FSA[1] | — | — | — | — | — | — | — | — |
| FSA[3] | 26 | — | — | — | — | — | — | — |
| FSA[4] | — | 26.6 | — | — | — | — | — | — |
| FSA[5] | — | — | 27.5 | — | — | — | — | — |
| FSA[6] | — | — | — | 16 | — | — | — | — |
| FSA[7] | — | — | — | — | — | 26.9 | | — |
| FSA[8] | — | — | — | — | — | — | 45 | — |
| FSA[9] | — | — | — | — | — | — | — | 43.2 |
| FSA[13] | — | — | — | 1 | 3.9 | 1.5 | — | — |
| 3-(Pentyloxy)-1,2-propanediol | 18 | — | — | — | — | — | — | — |
| 1,2-bis(Hydroxymethyl)cyclohexane | — | 18 | — | — | — | — | — | — |
| 1,2-Hexanediol | — | — | 10 | — | 20 | 20 | 20 | 20 |
| 1,4-bis(Hydroxymethyl)cyclohexane | — | — | 8 | — | — | — | — | — |
| Hexyleneglycol | — | — | — | — | — | 6 | — | — |
| Ethanol | 6 | 6 | 4 | 6 | 10 | 4 | 6 | 10 |
| Isopropanol | — | — | 2 | — | — | — | 4 | — |
| HCl | (a) | (a) | (a) | (a) | (a) | (a) | (a) | (a) |
| Perfume | 1.2 | 1.2 | 1.2 | 1.2 | 1.2 | 1.2 | 1.2 | 1.2 |
| Kathon | 3 ppm | 3 ppm | 3 ppm | 3 ppm | 5 ppm | 5 ppm | 5 ppm | 5 ppm |
| DI Water | Bal. | Bal. | Bal. | Bal. | Bal. | Bal. | Bal. | Bal. |

(a) To adjust pH of the Composition to about 3.5–4.0.

The above Examples show clear products with acceptable viscosities.

EXAMPLE IV

| Ingredients | 1 Wt. % | 2 Wt. % | 3 Wt. % | 4 Wt. % |
|---|---|---|---|---|
| DEQA[1] | 17.7 | 23.5 | 30.6 | 30.6 |
| Perfume | 0.8 | 1 | 1.35 | — |
| Tenox 6 | 0.02 | 0.03 | 0.04 | 0.04 |
| $CaCl_2$ (25% solution) | 1.2 | 1.5 | 2 | 2 |

-continued

| Ingredients | 1 Wt. % | 2 Wt. % | 3 Wt. % | 4 Wt. % |
|---|---|---|---|---|
| HCl 1N | 0.17 | 0.23 | 0.30 | 0.30 |
| Distilled Water | Balance | Balance | Balance | Balance |

Example IV, Compositions 1 to 4-Process

The compositions of Example IV are made at ambient temperature by the following process:

1. Prepare the water seat containing HCl.
2. Separately, mix perfume and Tenox 6® antioxidant to the diester softener active.

3. Add the diester active blend into the water seat with mixing.
4. Add about 10–20% of the $CaCl_2$ solution at approximately halfway through the diester addition.
5. Add the remainder of the $CaCl_2$ solution after the diester addition is complete with mixing.

EXAMPLE V

| Ingredients | 1 Wt. % | 2 Wt. % | 3 Wt. % | 4 Wt. % |
|---|---|---|---|---|
| DEQA[4] | 17.7 | 23.5 | 30.6 | 30.6 |
| Perfume | 0.8 | 1 | 1.35 | — |
| Tenox 6 | 0.02 | 0.03 | 0.04 | 0.04 |
| $CaCl_2$ (25% solution) | 1.2 | 1.5 | 2 | 2 |
| HCl 1N | 0.17 | 0.23 | 0.30 | 0.30 |
| Distilled Water | Balance | Balance | Balance | Balance |

Example V, Compositions 5 to 8 -Process

The compositions of Example V are made similar to those of Examples 1 to 4, except that DEQA[4] is used instead of DEQA[1].

EXAMPLE VI

| Ingredients | 1 Wt. % | 2 Wt. % | 3 Wt. % | 4 Wt. % | 5 Wt. % |
|---|---|---|---|---|---|
| DEQA[6] | 30.6 | — | — | — | — |
| DEQA[7] | — | 30.6 | — | — | — |
| DEQA[9] | — | — | 30.6 | — | — |
| DEQA[10] | — | — | — | 30.6 | — |
| DEQA[11] | — | — | — | — | 30.6 |
| Perfume | 1.35 | 1.35 | 1.35 | 1.35 | 1.35 |
| Tenox 6 | 0.04 | 0.04 | 0.04 | 0.04 | 0.04 |
| $CaCl_2$ (25% solution) | 2 | 2 | 2 | 2 | 2 |
| HCl 1N | 0.3 | 0.3 | 0.3 | 0.3 | 0.3 |
| Distilled Water | Balance | Balance | Balance | Balance | Balance |

Example VI, Compositions 1–4

The compositions of Example VI are made similar to that of Example IV-3, except that DEQA[6], DEQA[7], DEQA[8], and DEQA[9], are used instead of DEQA[1].

EXAMPLE VII

| Ingredients | 1 Wt. % | 2 Wt. % | 3 Wt. % | 4 Wt. % | 5 Wt. % |
|---|---|---|---|---|---|
| DEQA[4] (100%) | 26 | — | 42.5 | 52 | — |
| DEQA[6] (100%) | — | 27.6 | — | — | 26 |
| Ethanol | 2.3 | 4.9 | 3.8 | 4.6 | 2.3 |
| Hexylene Glycol | 2.3 | — | 3.8 | 4.6 | 2.3 |
| TMPD* | 15 | 12 | 22 | 22 | — |
| 1,4-Cyclohexane-dimethanol | 5 | 5 | 8 | 8 | — |
| Butyl Carbitol** | — | — | — | — | 20 |
| HCl (1N) | 0.25 | 0.25 | 0.4 | 0.5 | 0.25 |
| Perfume | 2.2 | 2.5 | 1.25 | 2.5 | 2.5 |
| DTPA*** | 0.012 | 0.01 | 0.01 | 0.01 | — |
| Water Soluble Blue Dye | 0.001 | — | — | — | 0.0015 |
| Kathon (1.5%) | 0.02 | 0.02 | 0.02 | 0.02 | 0.02 |
| DI Water | Balance | Balance | Balance | Balance | Balance |

*2,2,4-Trimethyl-1,3-pentanediol
**Diethylene glycol n-butyl ether
***Diethylenetriaminepentaacetic acid The weight ratio range of TMPD to 1,4-cyclohexanedimethanol for good phase stability, especially low temperature phase stability, is preferably from about 80:20 to about 50:50, more preferably about 75:25.

EXAMPLE VIII

| Ingredients | Softeners on a 100% active basis 1 Wt % | 2 Wt % |
|---|---|---|
| Varisoft-3690 | 26 | — |
| Varisoft-222 LT | — | 26 |
| Isopropanol | — | 2.9 |
| 1,2-Hexanediol | 20 | 20 |
| HCl (1N) | 0.25 | 0.25 |
| Perfume | 1.25 | 1.25 |
| DTPA | 0.01 | 0.01 |
| Kathon (1.5%) | 0.02 | 0.02 |
| DI Water | Balance | Balance |
| Example: | 1 | 2 |
| IV (of starting fatty acid) | 105 | 105 |
| Appearance (ambient) | Clear | Clear |
| Appearance (40° F.) | Clear | Clear |
| Viscosity (cPs – ambient) | 30 | 30 |
| Viscosity (cPs – 40° F.) | 55 | 55 |

EXAMPLE IX

| Ingredients | Wt % |
|---|---|
| DEQA[4] | 26 |
| Ethanol | 2.3 |
| Hexylene Glycol | 2.3 |
| 1,2-Hexanediol | 17 |
| HCl (1N) | 0.25 |
| Perfume | 2.5 |
| Kathon (1.5%) | 0.02 |
| DTPA | 0.01 |
| Water Soluble Blue Dye | 0.0006 |
| DI Water | Balance |

The above composition is used at active levels of 91 ppm, 141 ppm and 182 ppm in aqueous rinse solutions containing about 7 pounds of fabric, including cotton colored fabrics, after conventional wash cycles in which a commercial anionic detergent composition is used to wash the fabrics and the fabrics are dryed in a conventional automatic tumble dryer. After 8 cycles, the fabrics are graded using a scale in panel score units (psu) where: 0=equal; 1=I think one is better; 2=I know one is better; 3=I know that one is a lot better; and 4=I know one is a whole lot better. The fabrics that were used as test fabrics included 100% cotton red and blue jumpers; 100% cotton black turtleneck; and 100% cotton red/green/navy striped shirt.

| | red and blue jumpers | black turtleneck | red/green/navy striped shirt |
|---|---|---|---|
| Control (no treatment) | 0 | 0 | 0 |
| 91 ppm | 1.3 | 1.9 | 1.9 |
| 141 ppm | 3.1 | 2.7 | 2.7 |
| 182 ppm | 3.3 | 3.0 | 3.1 |

Higher positive numbers indicate improved performance compared to the no treatment control. Even normal usage provides some slight benefit, but the higher levels provide superior, noticeable benefit.

EXAMPLE X

| Ingredients | Wt % |
|---|---|
| DEQA[4] | 34.7 |
| Canolaalkyltrimethyl ammonium chloride | 1.2 |
| Ethanol | 4.2 |
| Hexylene Glycol | 3.1 |
| 1,2-Hexanediol | 22 |
| HCl (1N) | 0.4 |
| Perfume | 1.70 |
| Kathon (1.5%) | 0.02 |
| Water Soluble Blue Dye | 0.003 |
| DI Water | Balance |

EXAMPLE XI

| Ingredients | 1 Wt. % | 2 Wt. % | 3 Wt. % | 4 Wt. % |
|---|---|---|---|---|
| DEQA[4] (100%) | 26 | 26 | 26 | 26 |
| Ethanol | 4.6 | 4.6 | 4.6 | 4.6 |
| 1,2-Hexanediol | — | 18 | — | 20 |
| Ammonium Chloride | 0.7 | — | — | — |
| TPED* | — | 0.5 | — | — |
| PVP K-15** | — | — | 8 | 1.2 |
| HCl (1N) | 0.25 | 0.5 | — | — |
| HCl (25%) | — | — | 1.25 | 0.2 |
| Perfume | 1.4 | 2.5 | 1.25 | 2.5 |
| DTPA | — | 0.01 | 0.01 | 0.01 |
| Water Soluble Blue Dye | 0.001 | — | — | — |
| Kathon (1.5%) | 0.02 | 0.02 | 0.02 | 0.02 |
| DI Water | Balance | Balance | Balance | Balance |

*Neutralized N,N,N',N'-tetrakis(2-hydroxypropyl) ethylenediamine, obtained by neutralizing 5 parts of N,N,N',N'-tetrakis(2-hydroxypropyl) ethylenediamine (approximate 50% aqueous solution) with about 2 parts of hydrochloric acid (approximate 25% aqueous solution).
**Polyvinyl pyrrolidone with approximate viscosity average molecular weight of about 10,000.

Following are Examples of aqueous Compositions to be dispensed from a sprayer:

EXAMPLE XII

| Ingredients | 1 Wt. % | 2 Wt. % | 3 Wt. % | 4 Wt. % | 5 Wt. % | 6 Wt. % |
|---|---|---|---|---|---|---|
| DEQA[10] (85% in ethanol) | 0.3 | 1 | 2 | — | — | — |
| DEQA[11] (85% in ethanol) | — | — | — | 0.5 | 1 | 3 |
| 1,2-Hexanediol | — | 0.2 | — | — | — | 4 |
| TMPD | — | — | — | — | 0.3 | — |
| 1,4-Cyclohexanedimethanol | — | — | — | — | 0.1 | — |
| HCl (1N) | to pH 3.5 | to pH 3.5 | to pH 3.5 | to pH 3.5 | to pH 3.5 | to pH 3.5 |
| Perfume | 0.05 | 0.02 | 0.1 | 0.03 | 0.05 | 0.1 |
| DTPA | — | 0.01 | 0.01 | — | 0.01 | 0.01 |
| Kathon (1.5%) | 0.02 | 0.02 | 0.02 | 0.02 | 0.02 | 0.02 |
| DI Water | Balance | Balance | Balance | Balance | Balance | Balance |

EXAMPLE XIII

| Usage Range: | Normal | High | Highest | Comments |
|---|---|---|---|---|
| DEQA Active Dose (g/kg) | 2.4 | 3.0 | 14 | |
| Active on fabric (g/kg) | 2.16 | 2.7 | 12.6 | 90% deposition assumed |

-continued

| Usage Range: | Normal | High | Highest | Comments |
|---|---|---|---|---|
| C18:3 active on fabric-Highest Acceptable (ppm) | 430 | 540 | 2500 | 2% C18:3 in fatty acid |
| C18:3 active on fabric-Preferred Low Amount (ppm) | 43 | 54 | 250 | 0.2% C18:3 in fatty acid |

A typical laundry load is washed with Tide® powder detergent, and DEQA softener actives of the di(acyloxyethyl)methyl(hydroxyethyl)ammonium methyl sulfate type having the following acyl group distributions are dosed into the rinse cycle. These are made from different partially hardened canola fatty acids as shown:

| Component | DEQA-1 (Wt. %) | DEQA-2 (Wt. %) |
|---|---|---|
| C16 | 4.7 | 4.3 |
| C18 | 4.2 | 2.7 |
| C20 + 22 | 0.7 | 0.9 |
| C16:1 | 0.3 | 0.4 |
| C18:1 | 78.3 | 73.4 |
| 1C20:1 + C22:1 | 1.1 | 3.1 |
| C18:2 | 10.3 | 11.7 |
| C18:3 | 0.2 | 3 |
| IV | 95 | 97 |
| Cis:trans ratio (C18:1) | 3.67 | 3.90 |

| Component (Wt %) | A | B |
|---|---|---|
| DEQA-1 | 35.0 | — |
| DEQA-2 | — | 35.0 |
| Ethanol | 2.9 | 2.9 |
| Hexylene Glycol | 3.1 | 3.1 |
| TMPD | 4.0 | 4.0 |
| 2-Ethyl 1-3-Hexanediol | 4.0 | 4.0 |
| PEG 6 Cocamide | 3.0 | 3.0 |
| $CaCl_2$ | 0.125 | 0.125 |
| Perfume | 0.5 | 0.5 |

-continued

| Component (Wt %) | A | B |
|---|---|---|
| Diethylenetriaminepentaacetic acid | 0.01 | 0.01 |
| Blue Dye | 0.0003 | 0.0003 |
| DI Water | qs 100% | qs 100% |

A 7 pound laundry load is used and the dosage for each product is about 300% of normal recommended usage, or about 90g. product (about 31.5 g softener active), or about 8.4 g active/kg., at an estimated about 85% deposition efficiency. In the case of Example A, the level of triple unsaturated species (C1 8:3) on fabric is estimated at about 170 ppm and in the case of DEQA-2, the level of triple unsaturated species (C18:3) on fabric is estimated at about 2520 ppm. After line drying in sunlight, fabric treated with DEQA-1 has a good, acceptable odor; whereas fabrics treated with DEQA-2 and line dried in sunlight has a poorer odor. Thus, to prevent noticeable malodors from forming on fabrics, especially at higher dosages of softener active for improved benefits, the concentration of softener active on fabrics containing triple unsaturated alkyl chains should be less than about 2500 ppm, preferably less than about 250 ppm, and most preferably less than about 50 ppm.

For commercial purposes, the above compositions are introduced into containers, specifically bottles, and more specifically clear bottles (although translucent bottles can be used), made from polypropylene (although glass, polyethylene terephthalate and other polyester polymers, oriented polyethylene, etc., can be substituted), the bottle having a light blue tint to compensate for any yellow color that is present, or that may develop during storage (although, for short times, and perfectly clear products, clear containers with no tint, or other tints, can be used), and having an ultraviolet light absorber in the bottle to minimize the effects of ultraviolet light on the materials inside, especially the highly unsaturated actives (the absorbers can also be on the surface). The overall effect of the clarity and the container being to demonstrate the clarity of the compositions, thus assuring the consumer of the quality of the product.

It is highly desirable to package compositions containing fabric softener actives, and especially the highly unsaturated and/or branched chain fabric softener actives, in containers in association with information that will inform the consumer, by words and/or by pictures, that use of the compositions will provide fabric care benefits which include color maintenance benefits, and, where the fabric softener actives are highly unsaturated and/or branched, this information can comprise the claim of superiority without appreciable loss of water absorbency and/or undesirable "feel". The primary way that the information can be provided is by words and/or pictures on the package itself. However, it is also recognized that many of the functions of this type can be carried out by providing the information in advertisements, e.g., on television, on radio, in newspapers, by means of separate information sheets, either in the package, attached to the package or delivered separately, etc. Without knowledge of this benefit, the consumer that is looking for such a benefit would not know how to obtain it. The compositions can be liquid, as exemplified above, but can also be dryer-added, or dryer-activated, and can also include products that can be sprayed on.

When, in the above Examples, the specific solvents and fabric softener actives mentioned herein are substituted, either wholly, or in part, for the specific materials found in the numbered Examples, substantially identical results are obtained in that the high level of fabric softening active provides the desired results.

What is claimed is:

1. The process of applying fabric softener active to fabric in an amount that is at least about 150% of normal usage to obtain at least one benefit selected from the group consisting of: improved color protection; improved softness; reduced wrinkling; reduced static; and improved fiber integrity, said fabric softener, containing fatty acyl groups, and the maximum amount of active containing C18:3 fatty acyl groups on fabric being less than about 2500 ppm.

2. The process of claim 1 wherein the fabric softener active is applied in an amount that is from about 200% to about 600% of normal usage and the maximum amount of active containing C18:3 fatty acyl groups on fabric being less than about 540 ppm.

3. The process of claim 2 wherein the fabric softener active is applied in an amount that is from about 250% to about 500% of normal usage and the benefits include improved fiber integrity and the maximum amount of active containing C18:3 fatty acyl groups on fabric being less than about 430 ppm.

4. The process of claim 3 wherein the fabric softener active is applied in an amount that is from about 300% to about 400% of normal usage.

5. The process of claim 1 wherein said fabrics comprise colored cotton and cotton blend fabrics.

6. The process of claim 1 wherein the fabric softener active is highly unsaturated, or branched, and the active is applied in a rinse cycle of a wash process to provide a level of softener active in the rinse water as measured by the ratio of softener active weight in grams to fabric weight in kilograms, needed to provide good fabric color maintenance, of at least about 3.

7. The process of claim 6 wherein said level is from about 3.3 to about 14.

8. The process of claim 7 wherein said level is from about 5 to about 12.

9. The process of claim 8 wherein said level is at from about 6 to about 10.

10. The process of claim 1 wherein said fabric softener active has an Iodine Value of from about 70 to about 140.

11. The process of claim 1 wherein said fabric softener active has an Iodine Value of from about 80 to about 130.

12. The process of claim 1 wherein said fabric softener active has an Iodine Value of from about 90 to about 115.

13. The process of claim 1 wherein said fabric softener active has an Iodine Value of from about 70 to about 140 and/or is branched and the fabric has an HGW relative water absorbency of at least about 75%.

14. The process of claim wherein said fabric softener active has an Iodine Value of from about 80 to about 130 and the fabric has an HGW relative water absorbency of at least about 100%.

15. The process of claim 1 wherein said fabric has an HGW relative water absorbency of at least about 75%.

16. The process of claim 15 wherein said fabric has an HGW relative water absorbency of at least about 100%.

17. The process of claim 1 wherein said fabric softener active comprises, as the principal active, compounds of the formula:

$$\{R_{4-m}—N^{+}—[(CH_2)_n—Y—R^1]_m\}\ A^-$$

wherein each R substituent is either hydrogen, a short chain $C_1$–$C_6$ alkyl or hydroxyalkyl group, poly ($C_{2-3}$alkoxy) group, benzyl, or mixtures thereof; each m is 2 or 3; each n is from 1 to about 4; each Y is —O—(O)C—, —C(O)—O—, —NR—C(O)—, or —C(O)—NR—; the sum of carbons in each $R^1$, plus one when Y is —O—(O)C— or —NR—C(O)—, is $C_{12}$–$C_{22}$, with each $R^1$ being a hydrocarbyl, or substituted hydrocarbyl group and the Iodine Value being from about 70 to about 140; and $A^-$ being a softener compatible anion.

* * * * *